US007403734B2

(12) United States Patent
Okamoto et al.

(10) Patent No.: US 7,403,734 B2
(45) Date of Patent: Jul. 22, 2008

(54) DEVELOPING DEVICE, IMAGE FORMING APPARATUS, IMAGE FORMING SYSTEM, AND METHOD OF ASSEMBLING DEVELOPER SUPPLYING ROLLER

(75) Inventors: Katsumi Okamoto, Nagano-ken (JP); Masaharu Inui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 345 days.

(21) Appl. No.: 11/330,715

(22) Filed: Jan. 11, 2006

(65) Prior Publication Data

US 2006/0171736 A1 Aug. 3, 2006

(30) Foreign Application Priority Data

Jan. 11, 2005 (JP) ..... 2005-004185
Jan. 27, 2005 (JP) ..... 2005-019972
Feb. 10, 2005 (JP) ..... 2005-035014

(51) Int. Cl.
*G03G 15/04* (2006.01)

(52) U.S. Cl. ..... 399/119; 399/222

(58) Field of Classification Search ..... 399/119, 399/222, 252, 265, 279
See application file for complete search history.

(56) References Cited

U.S. PATENT DOCUMENTS

2002/0025191 A1* 2/2002 Kitayama ..... 399/222
2005/0180775 A1* 8/2005 Okamoto ..... 399/119
2005/0180779 A1* 8/2005 Okamoto ..... 399/222
2005/0185980 A1* 8/2005 Okamoto ..... 399/103
2006/0045569 A1* 3/2006 Okamoto ..... 399/119

FOREIGN PATENT DOCUMENTS

EP 1574912 A 9/2005
JP 2003-280371 10/2003
JP 2004-086059 3/2004

* cited by examiner

*Primary Examiner*—David M Gray
*Assistant Examiner*—Ryan D. Walsh
(74) *Attorney, Agent, or Firm*—Hogan & Hartson LLP

(57) ABSTRACT

A developing device includes a housing, a developer bearing roller, a first seal member, a second seal member, a second seal supporting member, and an urging member. The housing has an opening and is adapted to contain a developer. The developer bearing roller is arranged facing the opening and adapted to bear the developer. The first seal member abuts against the developer bearing roller along an axial direction thereof to prevent the developer from spilling. The second seal member abuts against an end, in the axial direction, of the developer bearing roller along a circumferential direction thereof to prevent the developer from spilling. The second seal supporting member supports an end, in a longitudinal direction, of the second seal member, and is attached to the housing such that a boundary section between the second seal member and the second seal supporting member faces the housing. The urging member is arranged along the axial direction of the developer bearing roller and is adapted to urge the first seal member toward the developer bearing roller by abutting against the first seal member. The urging member has, at an end in its longitudinal direction, an extending section extending up to a position between the boundary section and the housing.

12 Claims, 36 Drawing Sheets

DEVELOPING DEVICE, IMAGE FORMING APPARATUS, IMAGE FORMING SYSTEM, AND METHOD OF ASSEMBLING DEVELOPER SUPPLYING ROLLER

CROSS-REFERENCE TO RELATED APPLICATIONS

The present application claims priority upon Japanese Patent Application No. 2005-4185 filed on Jan. 11, 2005, Japanese Patent Application No. 2005-19972 filed on Jan. 27, 2005, and Japanese Patent Application No. 2005-35014 filed on Feb. 10, 2005, which are herein incorporated by reference.

BACKGROUND

1. Technical Field

The present invention relates to developing devices, image forming apparatuses, image forming systems, and methods for assembling developer supplying rollers.

2. Related Art (1) Image forming apparatuses such as laser beam printers are well known in the art. Such image forming apparatuses are provided with, for example, an image bearing member for bearing a latent image, and a developing device for developing the latent image borne on the image bearing member with a developer. When the image forming apparatus receives image signals etc. from an external device such as a host computer, it positions the developing device at a developing position which is in opposition to the image bearing member, develops the latent image borne on the image bearing member with the developer contained in the developing device to form a developer image, and transfers the developer image onto a medium to ultimately form an image on the medium.

The developing device of the above-mentioned type is provided with a housing having an opening and adapted to contain a developer, and a developer bearing roller arranged facing the opening and adapted to bear the developer. The developer borne by the developer bearing roller is used for developing the latent image borne by the image bearing member. Further, in order to prevent the developer from spilling from a containing body, the developing device is provided with a first seal member that abuts against the developer bearing roller along the axial direction of the developer bearing roller, and a second seal member that abuts against the end, in the axial direction, of the developer bearing roller along the circumferential direction thereof.

Further, from the viewpoint of preventing the developer from spilling, it is preferable to make the first seal member abut against the developer bearing roller appropriately. To do so, the developing device is provided with an urging member arranged along the axial direction of the developer bearing roller and adapted to urge the first seal member toward the developer bearing roller by abutting against the first seal member. Furthermore, from the viewpoint of preventing the developer from spilling, it is also preferable that the second seal member is supported appropriately. To do so, the developing device is provided with a second seal supporting member that supports the end, in the longitudinal direction, of the second seal member, and the second seal supporting member is attached to the housing such that a boundary section between the second seal member and the second seal supporting member faces the housing. (See, for example, JP-A-2003-280371.)

Depending on, for example, the state in which the second seal supporting member is attached to the housing, there are instances in which a gap is formed between the housing and the boundary section of the second seal member and the second seal supporting member. In cases where such a gap exists between the boundary section and the housing, the developer may spill through the gap, since the developer is a fine particle. In view of this, it is necessary to provide a component member for preventing the developer from spilling through this gap. This, however, may lead to an increase in the number of components of the developing device.

(2) Another type of known developing device that performs development using a developer is provided with a developer supplying roller that supplies the developer to a developer bearing member adapted to bear and carry the developer contained in a developer containing body. (See, for example, JP-A-2004-86059.)

The developer supplying roller of such a developing device is provided inside the developer containing body, which contains the developer. At a position outside the developer containing body, a gear adapted to transmit a motive power for rotating the developer supplying roller from a drive source such as a motor, which is provided outside the developing device, is fixed to a shaft element of the developer supplying roller. In order to prevent the gear and the developer supplying roller from relatively shifting in position in the circumferential direction, a pin is inserted into a pin hole provided in the shaft element in its diameter direction, and the gear and the developer supplying roller are fixed by accommodating the pin, which has been inserted in the shaft element, in a pin-accommodating section provided in the gear. More specifically, the gear is fitted, from the outside, onto the developer supplying roller which projects outward from inside the developer containing body, and the gear is moved up to a position which is more toward the developer containing body than the pin hole provided in the shaft element. After inserting the pin into the pin hole, the gear is moved back to a position where the pin fits into the pin-accommodating section provided in the gear. Then, an E-shaped retaining ring, for example, is fitted into a groove, which is provided in the shaft element on the developer-containing-body-side of the gear, to fix the gear in order to prevent the gear from moving in the axial direction.

Such a developing device is used attached to an image forming apparatus that forms images using the developer. Since there is a demand for downsizing of the image forming apparatus, downsizing of the developing device, which is attached to this image forming apparatus, is also desired.

In the above-described developing device, however, in order to fix the gear to the developer supplying roller, it is necessary to first move the gear closer to the developer containing body than the final fixing position where the gear would be positioned after assembly, and then move the gear back to its final fixing position after insertion of the pin into the pin hole. That is, the developing device contains a space that is used only for assembling the gear to the developer supplying roller and that becomes unnecessary when actually using the developing device. Therefore, such a developing device inevitably becomes large in size.

(3) Another example of a known developing device used in laser printers, which are an example of image forming apparatuses, is a developing device for developing latent images formed on a photoconductor, which is an example of an image bearing member. (See, for example, JP-A-2004-86059.) This type of developing device includes: a housing that has an opening and in which a developer is contained; a developing roller, which is an example of a developer bearing roller that bears the developer and that is arranged facing the opening; and a developer supplying roller adapted to supply the developer contained in the housing to the developing roller.

Such a developing device is further provided with a seal member that abuts against the developing roller to prevent the developer from spilling. The seal member and the developing roller are supported by a support member, and the support member is attached to the housing at both ends in the axial direction of the developing roller.

Further, the developing device is provided with an urging member for urging the seal member toward the developing roller. The urging member urges the seal member toward the developing roller with its urging force to make the seal member abut against the developing roller.

In order to prevent the developer from spilling using the seal member of the above-described type, it is necessary to make the abutting pressure of the seal member against the developing roller even.

Incidentally, a pressing force is applied to the developer supplying roller and the developing roller at both ends thereof where they are supported, so that the developer supplying roller and the developing roller are pressed against one another for the developer supplying roller to supply the developer to the developing roller. This pressing force is applied in a direction in which both ends of the developer supplying roller and the developing roller come closer to one another. Therefore, the developer supplying roller and the developing roller deform at their central sections such that they move away from each other. As a result, even when the seal member is arranged such that it exerts its abutting pressure evenly against the developing roller, the abutting pressure at the central section of the developing roller may become different from the other sections.

Further, if, for example, the developing device is inadvertently dropped during shipping, then the support member that is supported at both ends may become deformed due to the shock applied when the device is dropped. In that case, the support member, which is attached to the housing at both ends in the axial direction of the developing roller, will deform most significantly at the central section. As a result, even when the abutting pressure of the seal member against the developing roller is even at the time of manufacturing the device, the abutting pressure of the seal member at the central section of the developing roller may become different from the other sections at the point of attaching the developing device to the image forming apparatus.

SUMMARY

The present invention has been made in light of the foregoing issues.

(1) An advantage of some aspects of the present invention is that it is possible to achieve a developing device that can appropriately prevent the developer from spilling from between the boundary section and the housing without increasing the number of components of the developing device.

An aspect of the invention is a developing device including: a housing having an opening and adapted to contain a developer; a developer bearing roller arranged facing the opening and adapted to bear the developer; a first seal member abutting against the developer bearing roller along an axial direction of the developer bearing roller to prevent the developer from spilling; a second seal member abutting against an end, in the axial direction, of the developer bearing roller along a circumferential direction of the developer bearing roller to prevent the developer from spilling; a second seal supporting member that supports an end, in a longitudinal direction, of the second seal member, and that is attached to the housing such that a boundary section between the second seal member and the second seal supporting member faces the housing; and an urging member that is arranged along the axial direction of the developer bearing roller and that is adapted to urge the first seal member toward the developer bearing roller by abutting against the first seal member, the urging member having, at an end in its longitudinal direction, an extending section that extends up to a position between the boundary section and the housing.

(2) Another advantage of some aspects of the present invention is that it is possible to achieve a developing device that is reduced in size by reducing unnecessary space that is used only when assembling the developing device, an image forming apparatus having such a developing device, an image forming system, and a method of assembling a developer supplying roller.

Another aspect of the invention is a developing device including: a developer containing body adapted to contain a developer; a developer bearing member adapted to bear and carry the developer; a developer supplying roller having an elastic roller section that is accommodated inside the developer containing body, and a shaft element that is rotatably supported by the developer containing body and that has, in a portion that is projected outside the developer containing body, a pin hole into which a pin is inserted, the developer supplying roller being adapted to supply the developer to the developer bearing member; and a gear that rotates along with the developer supplying roller and that has a pin-accommodating section opened to the outside, the pin-accommodating section allowing the shaft element and the pin inserted into the shaft element to move relative to one another in an axial direction of the shaft element, but restricting the shaft element and the pin from moving relative to one another in the rotating direction of the shaft element; wherein, in a state where the developer supplying roller is supported by the developer containing body without the developer containing body interfering with the roller section, the pin hole is covered by the gear, and when the developer supplying roller is moved in the axial direction and the roller section is elastically deformed due to the developer containing body interfering with the roller section, the pin hole is exposed outside the gear so that the pin can be inserted therein and pulled out therefrom.

(3) Another advantage of some aspects of the present invention is that it is possible to achieve a developing device, an image forming apparatus, and an image forming system capable of preventing the developer from spilling, even when the distance between the developer bearing roller and the section to which the seal member is fixed changes.

Another aspect of the invention is a developing device including: a housing that has an opening and in which a developer is contained; a developer bearing roller that bears the developer and that is supported, at both ends thereof by the housing, facing the opening; a seal member that abuts against the developer bearing roller along an axial direction of the roller to prevent the developer from spilling from between the developer bearing roller and the housing; and an urging member that is arranged along the axial direction of the developer bearing roller, wherein one side of the urging member is fixed on the side of the housing and an other side of the urging member abuts against the seal member to urge the seal member toward the developer bearing roller, an urging force with which the urging member urges the seal member is made different between a central section in the axial direction and other sections so as to adapt to a change in a distance between the developer bearing roller and a section to which the urging member is fixed.

Other features of the invention will be made clear through the following description with reference to the accompanying drawings.

DESCRIPTION OF EXEMPLARY EMBODIMENTS

Figure 1:
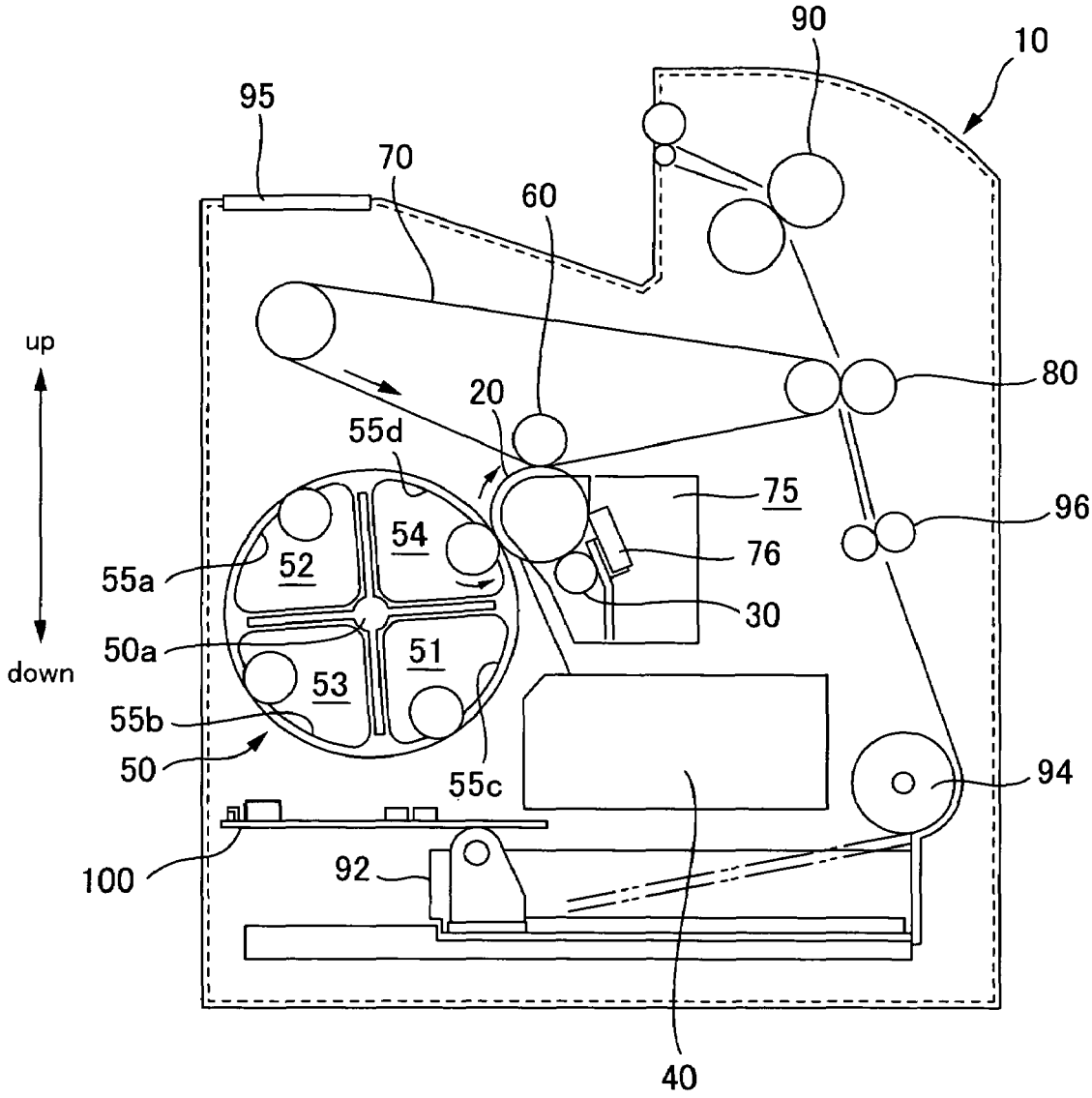
FIG. 1 is a diagram showing main structural components constructing a printer 10.

At least the following matters will become clear by the explanation in the present specification and the description of the accompanying drawings.

(1) An aspect of the present invention is a developing device including: a housing having an opening and adapted to contain a developer; a developer bearing roller arranged facing the opening and adapted to bear the developer; a first seal member abutting against the developer bearing roller along an axial direction of the developer bearing roller to prevent the developer from spilling; a second seal member abutting against an end, in the axial direction, of the developer bearing roller along a circumferential direction of the developer bearing roller to prevent the developer from spilling; a second seal supporting member that supports an end, in a longitudinal direction, of the second seal member, and that is attached to the housing such that a boundary section between the second seal member and the second seal supporting member faces the housing; and an urging member that is arranged along the axial direction of the developer bearing roller and that is adapted to urge the first seal member toward the developer bearing roller by abutting against the first seal member, the urging member having, at an end in its longitudinal direction, an extending section that extends up to a position between the boundary section and the housing.

With this developing device, because the urging member has an extending section, the developer can appropriately be prevented from spilling from between the housing and the boundary section of the second seal member and the second seal supporting member. Further, the urging member not only has the function of urging the first seal member toward the developer bearing roller, but also the function of preventing the developer from spilling from between the boundary section and the housing. Since the urging member has both the above two functions, it is possible to prevent an increase in the number of components of the developing device. Accordingly, by providing the extending section(s) to the urging member, it is possible to achieve a developing device that can appropriately prevent the developer from spilling from between the boundary section and the housing, without increasing the number of components of the developing device.

In this developing device, the second seal member may have an abutting surface that abuts against the end, in the axial direction, of the developer bearing roller along the circumferential direction of the developer bearing roller; the second seal supporting member may have a second seal supporting section that supports a surface of the second seal member on an opposite side from the abutting surface; and the boundary section may be a boundary section between the second seal supporting section and the surface on the opposite side from the abutting surface.

In this way, it becomes possible to achieve a developing device that can appropriately prevent the developer from spilling from between the housing and the boundary section of the second seal supporting section and the surface on the opposite side from the abutting surface, without increasing the number of components of the developing device.

In this developing device, the extending section may be supported by the second seal supporting section via a double-faced tape.

In this way, it becomes easier to arrange the extending section in a desired position because it is less likely that the extending section will be shifted in position with respect to the second seal supporting section, and thus, it becomes possible to prevent the developer from spilling from between the boundary section and the housing more effectively.

In this developing device, the extending section may have a fold-back section that is folded around and supported by the second seal supporting section; and a portion of the fold-back section may be positioned between the boundary section and the housing.

In this way, it is less likely that a gap will be formed between the boundary section and the housing because it is easy to appropriately arrange the extending section between the boundary section and the housing.

In this developing device, the second seal supporting section of the second seal supporting member may have a cut-out section in a position located in opposition to the second seal member; and the fold-back section may be folded around and supported by the second seal supporting section in such a manner that the fold-back section surrounds a side edge of the cut-out section.

Further, in this developing device, the second seal supporting member may be attached to the housing via a third seal member adapted to prevent the developer from spilling from between the second seal supporting member and the housing; and the extending section may extend up to a position between the boundary section and the third seal member and may abut against both the boundary section and the third seal member.

In this way, it is even less likely that a gap will be formed between the boundary section and the housing because the extending section abuts against both the boundary section and the third seal member, and thus, it becomes possible to appropriately prevent the developer from spilling from between the boundary section and the housing more effectively.

In this developing device, the second seal supporting member may be made of metal; the second seal member may be made of nonwoven fabric; and the urging member may be made of sponge.

In cases where the second seal supporting member is made of metal, the second seal supporting member lacks flexibility, and as a result, it becomes more likely that a gap is formed at the boundary section between the second seal supporting member and the second seal member. On the contrary, making the urging member out of sponge, which is highly flexible, allows the extending section of the urging member to deform easily in accordance with the shape of the second seal supporting member etc., and as a result, a gap is further prevented from being formed between the boundary section and the housing.

In this developing device, the second seal supporting member may support an end, in a lateral direction, of the first seal member, and support the urging member along the longitudinal direction thereof.

In this way, it is easy to stabilize the urging force of the urging member against the first seal member. Thus, the first seal member abuts appropriately against the developer bearing roller, thereby allowing the developer to be prevented from spilling more effectively.

Further, a developing device includes: a housing having an opening and adapted to contain a developer; a developer bearing roller arranged facing the opening and adapted to bear the developer; a first seal member abutting against the developer bearing roller along an axial direction of the developer bearing roller to prevent the developer from spilling; a second seal member abutting against an end, in the axial direction, of the developer bearing roller along a circumferential direction of the developer bearing roller to prevent the developer from spilling; a second seal supporting member that supports an end, in a longitudinal direction, of the second seal member, and that is attached to the housing such that a boundary section between the second seal member and the second seal supporting member faces the housing; and an urging member that is arranged along the axial direction of the developer bearing roller and that is adapted to urge the first seal member toward the developer bearing roller by abutting against the first seal member, the urging member having, at an end in its longitudinal direction, an extending section that extends up to a position between the boundary section and the housing;

wherein the second seal member has an abutting surface that abuts against the end, in the axial direction, of the developer bearing roller along the circumferential direction of the developer bearing roller; wherein the second seal supporting member has a second seal supporting section that supports a surface of the second seal member on an opposite side from the abutting surface; wherein the boundary section is a boundary section between the second seal supporting section and the surface on the opposite side from the abutting surface; wherein the extending section is supported by the second seal supporting section via a double-faced tape; wherein the extending section has a fold-back section that is folded around and supported by the second seal supporting section; wherein a portion of the fold-back section is positioned between the boundary section and the housing; wherein the second seal supporting section of the second seal supporting member has a cut-out section in a position located in opposition to the second seal member; wherein the fold-back section is folded around and supported by the second seal supporting section in such a manner that the fold-back section surrounds a side edge of the cut-out section; wherein the second seal supporting member is attached to the housing via a third seal member adapted to prevent the developer from spilling from between the second seal supporting member and the housing; wherein the extending section extends up to a position between the boundary section and the third seal member and abuts against both the boundary section and the third seal member; wherein the second seal supporting member is made of metal; wherein the second seal member is made of nonwoven fabric; wherein the urging member is made of sponge; and wherein the second seal supporting member supports an end, in a lateral direction, of the first seal member, and supports the urging member along the longitudinal direction thereof.

With this developing device, the effect of being able to achieve a developing device that can appropriately prevent the developer from spilling from between the boundary section and the housing, without increasing the number of components of the developing device, is attained most effectively.

Further, an image forming apparatus is provided with: an image bearing member adapted to bear a latent image; and a developing device adapted to develop the latent image borne by the image bearing member, the developing device including: a housing having an opening and adapted to contain a developer; a developer bearing roller arranged facing the opening and adapted to bear the developer; a first seal member abutting against the developer bearing roller along an axial direction of the developer bearing roller to prevent the developer from spilling; a second seal member abutting against an end, in the axial direction, of the developer bearing roller along a circumferential direction of the developer bearing roller to prevent the developer from spilling; a second seal supporting member that supports an end, in a longitudinal direction, of the second seal member, and that is attached to the housing such that a boundary section between the second seal member and the second seal supporting member faces the housing; and an urging member that is arranged along the axial direction of the developer bearing roller and that is adapted to urge the first seal member toward the developer bearing roller by abutting against the first seal member, the urging member having, at an end in its longitudinal direction, an extending section that extends up to a position between the boundary section and the housing.

Since this image forming apparatus is provided with a developing device that can appropriately prevent the developer from spilling from between the boundary section and the housing, without increasing the number of components of the developing device, it is possible to achieve an image forming apparatus that is superior to conventional apparatuses.

Further, an image forming system is provided with: a computer; and an image forming apparatus connectable to the computer, the image forming apparatus having: an image bearing member adapted to bear a latent image; and a developing device adapted to develop the latent image borne by the image bearing member, the developing device including: a housing having an opening and adapted to contain a developer; a developer bearing roller arranged facing the opening and adapted to bear the developer; a first seal member abutting against the developer bearing roller along an axial direction of the developer bearing roller to prevent the developer from spilling; a second seal member abutting against an end, in the axial direction, of the developer bearing roller along a circumferential direction of the developer bearing roller to prevent the developer from spilling; a second seal supporting member that supports an end, in a longitudinal direction, of the second seal member, and that is attached to the housing such that a boundary section between the second seal member and the second seal supporting member faces the housing; and an urging member that is arranged along the axial direction of the developer bearing roller and that is adapted to urge the first seal member toward the developer bearing roller by abutting against the first seal member, the urging member having, at an end in its longitudinal direction, an extending section that extends up to a position between the boundary section and the housing.

Since this image forming system is provided with a developing device that can appropriately prevent the developer from spilling from between the boundary section and the housing, without increasing the number of components of the developing device, it is possible to achieve an image forming system that is superior to conventional systems.

(2) Another aspect of the invention is a developing device including: a developer containing body adapted to contain a developer; a developer bearing member adapted to bear and carry the developer; a developer supplying roller having an elastic roller section that is accommodated inside the developer containing body, and a shaft element that is rotatably supported by the developer containing body and that has, in a portion that is projected outside the developer containing body, a pin hole into which a pin is inserted, the developer supplying roller being adapted to supply the developer to the developer bearing member; and a gear that rotates along with the developer supplying roller and that has a pin-accommodating section opened to the outside, the pin-accommodating section allowing the shaft element and the pin inserted into the shaft element to move relative to one another in an axial direction of the shaft element, but restricting the shaft element and the pin from moving relative to one another in the rotating direction of the shaft element; wherein, in a state where the developer supplying roller is supported by the developer containing body without the developer containing body interfering with the roller section, the pin hole is covered by the gear, and when the developer supplying roller is moved in the axial direction and the roller section is elastically deformed due to the developer containing body interfering with the roller section, the pin hole is exposed outside the gear so that the pin can be inserted therein and pulled out therefrom.

In such a developing device, by moving the developer supplying roller in the axial direction and elastically deforming the roller section by making the developer containing body interfere with the roller section, the pin hole is exposed outside the gear so that the pin can be inserted therein and pulled out therefrom. Therefore, it is possible to insert the pin into the exposed pin hole by making the developer containing body interfere with the roller section of the developer supplying roller to elastically deform the roller section. On the other hand, in a state where the developer supplying roller, with the pin inserted therein, is supported by the developer containing body without the developer containing body interfering with the roller section, that is, in a state where the developer supplying roller is rotatably supported, the pin hole is covered by the gear. Thus, the pin inserted through the pin hole is accommodated inside the pin-accommodating section. Therefore, when the developer supplying roller is in a rotatable state, relative movement between the gear and the shaft element in the rotating direction is restricted, and the developer supplying roller can be made to rotate by the motive power transmitted from the gear. Here, when attaching the gear to the developer supplying roller, the pin hole, which is covered by the gear in a state where the developer supplying roller is rotatable, is exposed outside the gear by moving the developer supplying roller in the axial direction to elastically deform the roller section. Therefore, the shaft element only needs to be provided with enough length for attaching the gear, and no extra length is necessary. In other words, since the gear does not have to be moved in order to expose the pin hole, which is formed in the shaft element, outside the gear, there is no need to provide the space for moving the gear, which is necessary only during assembly in conventional devices. As a result, the length of the shaft element can be kept short, and thus, it is possible to achieve downsizing of the developing device.

In this developing device, it is preferable that the developer supplying roller is supported by the developer containing body via a bearing; and in the state where the developer supplying roller is supported by the developer containing body without the developer containing body interfering with the roller section, the gear is restricted from moving in the axial direction by the bearing.

In such a developing device, movement of the gear can be restricted by the bearing, without separately providing a component for restricting axial-direction movement of the gear. Therefore, there is no need to provide space for arranging the component for restriction, and thus, it is possible to achieve further downsizing of the developing device. Further, since it is not necessary to separately provide a component merely for restricting axial-direction movement of the gear, the number of components and also the number of steps for assembly can be reduced, and therefore, the cost can be kept low.

In this developing device, it is preferable that the developing device further includes a movement-restricting member that restricts the developer supplying roller from moving in the axial direction in the state where the developer supplying roller is supported by the developer containing body without the developer containing body interfering with the roller section.

In such a developing device, providing a movement-restricting member allows to maintain a state in which the developer supplying roller is supported by the developer containing body without the developer containing body interfering with the roller section of the developer supplying roller. In other words, even when the developer supplying roller is driven and a force applied in a direction that attempts to move the developer supplying roller in the axial direction is generated due to an external force, the developer supplying roller is restricted from moving by the movement-restricting member. Therefore, it is possible to maintain a state in which the developer supplying roller is supported by the developer containing body without the developer containing body interfering with the roller section.

In this developing device, it is preferable that a distance in the axial direction between the developer supplying roller and the developer containing body in the state where the developer supplying roller is supported by the developer containing body, is shorter than a length of the pin-accommodating section in the axial direction.

In such a developing device, in a state where the developer supplying roller is being supported by the developer containing body, the distance in the axial direction between the roller section and the developer containing body is shorter than the length of the pin-accommodating section in the axial direction. Therefore, in a state where the developer supplying roller is being supported by the developer containing body, the pin will not come outside of the pin-accommodating section even when the developer supplying roller moves in the axial direction. Accordingly, in a state where the developer supplying roller is being supported by the developer containing body, there is no chance that the pin will come off from the shaft element, and thus, the developer supplying roller can be made to rotate reliably by the motive power transmitted from the gear.

In this developing device, it is preferable that a distance for which the developer supplying roller can be moved due to the developer supplying roller being moved in the axial direction and the roller section being elastically deformed by the developer containing body interfering with the roller section, is longer than a length of the pin-accommodating section in the axial direction.

In such a developing device, the distance for which the developer supplying roller can be moved due to the roller section being elastically deformed by the developer containing body interfering with the roller section, is longer than the length of the pin-accommodating section in the axial direction. Therefore, the pin hole positioned inside the pin-accommodating section can be moved to a position outside the pin-accommodating section by elastically deforming the roller section and moving the developer supplying roller in the axial direction. Accordingly, the pin can easily be inserted into the pin hole and the gear can be attached to the shaft element easily so that the shaft element is restricted from relatively moving in the rotating direction with respect to the gear.

In this developing device, it is preferable that the roller section is formed using urethane foam.

In such a developing device, the roller section can be elastically deformed significantly with ease when the developer supplying roller is moved in the axial direction, because urethane foam has a large shrinkage rate. Therefore, the gear can be attached to the shaft element more easily.

In this developing device, it is preferable that the developer containing body has an interfering section that interferes with the roller section, and a gap that is provided between the interfering section and the bearing and into which the roller section fits, when the developer supplying roller is moved in the axial direction.

In such a developing device, the interfering section can interfere with the roller section and the roller section can be elastically deformed easily when the developer supplying roller is moved in the axial direction, and also, the developer supplying roller can be moved in the axial direction easily by letting the elastically-deformed portion of the roller section fit into the gap provided between the bearing and the interfering section.

In this developing device, it is preferable that the interfering section is chamfered.

In such a developing device, since the interfering section, which interferes with the roller section when the developer supplying roller is moved in the axial direction, is chamfered, the roller section will not come into contact with, for example, a sharp edge, and therefore, it is possible to prevent the roller section from being damaged when elastically deforming the roller section.

Further, a developing device includes: a developer containing body adapted to contain a developer; a developer bearing member adapted to bear and carry the developer; a developer supplying roller having an elastic roller section that is accommodated inside the developer containing body, and a shaft element that is rotatably supported by the developer containing body and that has, in a portion that is projected outside the developer containing body, a pin hole into which a pin is inserted, the developer supplying roller being adapted to supply the developer to the developer bearing member; and a gear that rotates along with the developer supplying roller and that has a pin-accommodating section opened to the outside, the pin-accommodating section allowing the shaft element and the pin inserted into the shaft element to move relative to one another in an axial direction of the shaft element, but restricting the shaft element and the pin from moving relative to one another in the rotating direction of the shaft element; wherein, in a state where the developer supplying roller is supported by the developer containing body without the developer containing body interfering with the roller section, the pin hole is covered by the gear, and when the developer supplying roller is moved in the axial direction and the roller section is elastically deformed due to the developer containing body interfering with the roller section, the pin hole is exposed outside the gear so that the pin can be inserted therein and pulled out therefrom; wherein the developer supplying roller is supported by the developer containing body via a bearing; wherein, in the state where the developer supplying roller is supported by the developer containing body without the developer containing body interfering with the roller section, the gear is restricted from moving in the axial direction by the bearing; wherein the developing device further comprises a movement-restricting member that restricts the developer supplying roller from moving in the axial direction in the state where the developer supplying roller is supported by the developer containing body without the developer containing body interfering with the roller section; wherein a distance in the axial direction between the developer supplying roller and the developer containing body in the state where the developer supplying roller is supported by the developer containing body, is shorter than a length of the pin-accommodating section in the axial direction; wherein a distance for which the developer supplying roller can be moved due to the developer supplying roller being moved in the axial direction and the roller section being elastically deformed by the developer containing body interfering with the roller section, is longer than the length of the pin-accommodating section in the axial direction; wherein the roller section is formed using urethane foam; wherein the developer containing body has an interfering section that interferes with the roller section, and a gap that is provided between the interfering section and the bearing and into which the roller section fits, when the developer supplying roller is moved in the axial direction; and wherein the interfering section is chamfered.

With such a developing device, the advantages of the invention can be achieved most effectively because all of the effects described above can be attained.

Further, an image forming apparatus is provided with: (a) an image bearing member that bears a latent image; and (b) a developing device including: a developer containing body adapted to contain a developer; a developer bearing member adapted to bear and carry the developer; a developer supplying roller having an elastic roller section that is accommodated inside the developer containing body, and a shaft element that is rotatably supported by the developer containing body and that has, in a portion that is projected outside the developer containing body, a pin hole into which a pin is inserted, the developer supplying roller being adapted to supply the developer to the developer bearing member; and a gear that rotates along with the developer supplying roller and that has a pin-accommodating section opened to the outside, the pin-accommodating section allowing the shaft element and the pin inserted into the shaft element to move relative to one another in an axial direction of the shaft element, but restricting the shaft element and the pin from moving relative to one another in the rotating direction of the shaft element; wherein, in a state where the developer supplying roller is supported by the developer containing body without the developer containing body interfering with the roller section, the pin hole is covered by the gear, and when the developer supplying roller is moved in the axial direction and the roller section is elastically deformed due to the developer containing body interfering with the roller section, the pin hole is exposed outside the gear so that the pin can be inserted therein and pulled out therefrom.

With such an image forming apparatus, downsizing can be achieved by using a developing device reduced in size.

It is also possible to achieve an image forming system that is provided with: (A) a computer; and (B) an image forming apparatus connected to the computer and having: (a) an image bearing member that bears a latent image; and (b) a developing device including: a developer containing body adapted to contain a developer; a developer bearing member adapted to bear and carry the developer; a developer supplying roller having an elastic roller section that is accommodated inside the developer containing body, and a shaft element that is rotatably supported by the developer containing body and that has, in a portion that is projected outside the developer containing body, a pin hole into which a pin is inserted, the developer supplying roller being adapted to supply the developer to the developer bearing member; and a gear that rotates along with the developer supplying roller and that has a pin-accommodating section opened to the outside, the pin-accommodating section allowing the shaft element and the pin inserted into the shaft element to move relative to one another in an axial direction of the shaft element, but restricting the shaft element and the pin from moving relative to one another in the rotating direction of the shaft element; wherein, in a state where the developer supplying roller is supported by the developer containing body without the developer containing body interfering with the roller section, the pin hole is covered by the gear, and when the developer supplying roller is moved in the axial direction and the roller section is elastically deformed due to the developer containing body interfering with the roller section, the pin hole is exposed outside the gear so that the pin can be inserted therein and pulled out therefrom.

Further, a method of assembling a developer supplying roller, includes: inserting, inside a developer containing body that contains a developer, a developer supplying roller that has an elastic roller section on a shaft element, whose shaft element is supported by the developer containing body, and that is adapted to supply the developer to a developer bearing member adapted to bear and carry the developer, and elastically deforming the roller section by making the developer containing body interfere with the roller section, to cause the shaft element to project outside the developer containing body; attaching, from outside the developer containing body, a gear that rotates along with the developer supplying roller to the projected shaft element, and causing a pin hole provided in the shaft element to be exposed outside the gear in order to insert, into the pin hole, a pin adapted to fix the gear and the shaft element; inserting the pin into the pin hole that has been exposed; and fixing the gear to the developer supplying roller by moving the developer supplying roller in an axial direction thereof, so that the developer containing body rotatably supports the developer supplying roller without the developer containing body interfering with the roller section and the pin is accommodated inside a pin-accommodating section that is provided in the gear and that is opened to the outside.

With this method of assembling a developer supplying roller, the length of the shaft element can be made short because it is not necessary to move the gear just to expose the pin hole when attaching the gear to the developer supplying roller. Further, the pin hole can be exposed outside the gear easily by moving the developer supplying roller, whose shaft element is short in length, in the axial direction. Furthermore, the developer supplying roller can easily be assembled to the developer containing body by moving the developer supplying roller to a position where the developer containing body does not interfere with the roller section after inserting the pin into the pin hole. Thus, a developing device reduced in size can be assembled easily.

(3) Another aspect of the invention is a developing device including: a housing that has an opening and in which a developer is contained; a developer bearing roller that bears the developer and that is supported, at both ends thereof by the housing, facing the opening; a seal member that abuts against the developer bearing roller along an axial direction of the roller to prevent the developer from spilling from between the developer bearing roller and the housing; and an urging member that is arranged along the axial direction of the developer bearing roller, wherein one side of the urging member is fixed on the side of the housing and an other side of the urging member abuts against the seal member to urge the seal member toward the developer bearing roller, an urging force with which the urging member urges the seal member is made different between a central section in the axial direction and other sections so as to adapt to a change in a distance between the developer bearing roller and a section to which the urging member is fixed.

In such a developing device, the seal member that prevents the developer from spilling from between the developer bearing roller and the housing is made to abut against the developer bearing roller by the urging member provided on the housing side. Further, both ends of the developer bearing roller is supported by the housing at both its ends. Therefore, the change in the distance between the developer bearing roller and the section to which the urging member is fixed becomes largest at the central section in the axial direction of the developer bearing roller. In view of this, by making the urging force for urging the seal member different between the central section in the axial direction and the other sections, it becomes possible to appropriately adapt to the change in the distance between the developer bearing roller and the section to which the urging member is fixed, and thereby prevent the developer from spilling.

In this developing device, the developing device further includes a developer supplying roller adapted to supply the developer contained in the housing to the developer bearing roller; the developer supplying roller and the developer bearing roller are supported such that they are pressed against one another at both ends thereof; and the change in the distance between the developer bearing roller and the section to which the urging member is fixed is caused by warping of the developer bearing roller due to a pressing force by which the developer bearing roller and the developer supplying roller press against one another.

In such a developing device, the developer supplying roller and the developer bearing roller are supported such that they are pressed against one another at both its ends, and therefore, the developer bearing roller bends most significantly at its center. Therefore, the change in the distance between the developer bearing roller and the section to which the urging member is fixed becomes largest at the central section in the axial direction. In view of this, by making the urging force for urging the seal member different between the central section in the axial direction and the other sections, it becomes possible to appropriately adapt to the change in the distance between the developer bearing roller and the section to which the urging member is fixed, and thereby prevent spilling of the developer due to warping of the developer bearing roller.

In this developing device, the developing device further includes a support member that is supported by the housing at both ends in the axial direction of the developer bearing roller and to which the urging member is fixed; and the change in the distance between the developer bearing roller and the section to which the urging member is fixed is caused by warping of the support member due to a shock when dropped.

In such a developing device, the urging member for urging the seal member is fixed to the support member, and the support member is supported by the housing at both ends in the axial direction of the developer bearing roller. Therefore, a change in the distance between the developer bearing roller and the section to which the urging member is fixed occurs due to warping of the support member which is caused by the shock when the device is dropped. The warping of the support member due to the shock of dropping becomes largest at the central section in the axial direction. That is, the change in the distance between the developer bearing roller and the section to which the urging member is fixed becomes largest at the central section in the axial direction. In view of this, by making the urging force for urging the seal member different between the central section in the axial direction and the other sections, it becomes possible to appropriately adapt to the change in the distance between the developer bearing roller and the section to which the urging member is fixed, and thereby prevent spilling of the developer due to warping of the support member.

In this developing device, it is preferable that the urging force is set so that the urging force in the central section in the axial direction becomes larger than the urging force of the other sections when the distance between the developer bearing roller and the section to which the urging member is fixed changes in a direction that widens the distance.

In such a developing device, the urging force is set so that the urging force in the central section in the axial direction becomes larger than the urging force of the other sections. Therefore, even when the distance between the developer bearing roller and the section to which the urging member is fixed changes in a direction that widens the distance, that is, even when the urging force changes in the weakening direction, the possibility that the urging force at the central section in the axial direction significantly decreases compared to the other sections, is small. Therefore, even when the distance between the developer bearing roller and the section to which the urging member is fixed changes in the widening direction, the seal member can be made to abut against the roller at the central section in the axial direction with the urging force of the urging member, and therefore, the developer can be prevented from spilling.

In this developing device, it is preferable that the urging force is set so that the urging force in the central section in the axial direction becomes smaller than the urging force of the other sections when the distance between the developer bearing roller and the section to which the urging member is fixed changes in a direction that narrows the distance.

In such a developing device, the urging force is set so that the urging force in the central section in the axial direction becomes smaller than the urging force of the other sections. Therefore, even when the distance between the developer bearing roller and the section to which the urging member is fixed changes in a direction that narrows the distance, that is, even when the urging force changes in the strengthening direction, the possibility that only the urging force at the central section in the axial direction significantly increases compared to the other sections, is small. Therefore, even when the distance between the developer bearing roller and the section to which the urging member is fixed changes in the narrowing direction, the seal member can be made to abut against the roller at the central section in the axial direction, as well as the other sections, with the urging force of the urging member, and therefore, the developer can be prevented from spilling.

In this developing device, it is preferable that the urging force in the central section in the axial direction and the urging force of the other sections are made different by making a length of the urging member in a circumferential direction of the developer bearing roller different between the central section in the axial direction and the other sections.

With such a developing device, it is possible to make the urging force of the urging member different between the central section in the axial direction and the other sections easily, simply by making the length of the urging member in the circumferential direction of the developer bearing roller different between the central section in the axial direction and the other sections.

In this developing device, the urging force in the central section in the axial direction and the urging force of the other sections may be made different by making a thickness of the urging member different between the central section in the axial direction and the other sections.

With such a developing device, it is possible to make the urging force of the urging member different between the central section in the axial direction and the other sections easily, simply by making the thickness of the urging member different between the central section in the axial direction and the other sections.

In this developing device, the urging force in the central section in the axial direction and the urging force of the other sections may be made different by curving the support member.

With such a developing device, it is possible to make the urging force of the urging member different between the central section in the axial direction and the other sections easily, simply by curving the support member.

Further, a developing device includes: a housing that has an opening and in which a developer is contained; a developer bearing roller that bears the developer and that is supported, at both ends thereof by the housing, facing the opening; a seal member that abuts against the developer bearing roller along an axial direction of the roller to prevent the developer from spilling from between the developer bearing roller and the housing; and an urging member that is arranged along the axial direction of the developer bearing roller, wherein one side of the urging member is fixed on the side of the housing and an other side of the urging member abuts against the seal member to urge the seal member toward the developer bearing roller, an urging force with which the urging member urges the seal member is made different between a central section in the axial direction and other sections so as to adapt to a change in a distance between the developer bearing roller and a section to which the urging member is fixed; wherein the developing device further comprises a support member that is supported by the housing at both ends in the axial direction of the developer bearing roller and to which the urging member is fixed; wherein the change in the distance between the developer bearing roller and the section to which the urging member is fixed is caused by warping of the support member due to a shock when dropped; wherein the urging force is set so that the urging force in the central section in the axial direction becomes larger than the urging force of the other sections when the distance between the developer bearing roller and the section to which the urging member is fixed changes in a direction that widens the distance; wherein the urging force is set so that the urging force in the central section in the axial direction becomes smaller than the urging force of the other sections when the distance between the developer bearing roller and the section to which the urging member is fixed changes in a direction that narrows the distance; and wherein the urging force in the central section in the axial direction and the urging force of the other sections are made different by making a length of the urging member in a circumferential direction of the developer bearing roller different between the central section in the axial direction and the other sections.

With such a developing device, the urging force at the central section in the axial direction, where the change in position due to warping becomes largest, is made different from that of the other sections so as to adapt to the change in the distance between the developer bearing roller and the section to which the urging member is fixed. Therefore, even when the support member to which the urging member is fixed warps due to the shock when the device is dropped, it is possible to prevent spilling of the developer appropriately and efficiently, even if the distance between the developer bearing roller and the section to which the urging member is fixed changes in either direction.

It is also possible to achieve an image forming apparatus provided with: (a) an image bearing member that bears a latent image; and (b) a developing device including: a housing that has an opening and in which a developer is contained; a developer bearing roller that bears the developer and that is supported, at both ends thereof by the housing, facing the opening; a seal member that abuts against the developer bearing roller along an axial direction of the roller to prevent the developer from spilling from between the developer bearing roller and the housing; and an urging member that is arranged along the axial direction of the developer bearing roller, wherein one side of the urging member is fixed on the side of the housing and an other side of the urging member abuts against the seal member to urge the seal member toward the developer bearing roller, an urging force with which the urging member urges the seal member is made different between a central section in the axial direction and other sections so as to adapt to a change in a distance between the developer bearing roller and a section to which the urging member is fixed.

It is also possible to achieve an image forming system provided with: (A) a computer; and (B) an image forming apparatus connected to the computer and having: (a) an image bearing member that bears a latent image; and (b) a developing device including: a housing that has an opening and in which a developer is contained; a developer bearing roller that bears the developer and that is supported, at both ends thereof by the housing, facing the opening; a seal member that abuts against the developer bearing roller along an axial direction of the roller to prevent the developer from spilling from between the developer bearing roller and the housing; and an urging member that is arranged along the axial direction of the developer bearing roller, wherein one side of the urging member is fixed on the side of the housing and an other side of the urging member abuts against the seal member to urge the seal member toward the developer bearing roller, an urging force with which the urging member urges the seal member is made different between a central section in the axial direction and other sections so as to adapt to a change in a distance between the developer bearing roller and a section to which the urging member is fixed.

First Embodiment

===(1) Overview of Image Forming Apparatus===

Next, with reference to FIG. 1, an outline of an image forming apparatus will be described, taking a laser-beam printer 10 (hereinafter referred to also as "printer") as an example. FIG. 1 is a diagram showing main structural components constructing the printer 10. It should be noted that in FIG. 1, the vertical direction is shown by the arrow, and, for example, a paper supply tray 92 is arranged at a lower section of the printer 10, and a fixing unit 90 is arranged at an upper section of the printer 10.

As shown in FIG. 1, the printer 10 according to the present embodiment is provided with a charging unit 30, an exposing unit 40, a YMCK developing unit 50, a first transferring unit 60, an intermediate transferring body 70, and a cleaning unit 75. These components are arranged in the direction of rotation of a photoconductor 20, which is an example of an "image bearing member". The printer 10 is further provided with a second transferring unit 80, a fixing unit 90, a displaying unit 95 constructed of a liquid-crystal panel and serving as means for making notifications to a user, and a control unit 100 for controlling these units etc. and managing the operations as a printer.

The photoconductor 20 has a cylindrical electrically-conductive base and a photoconductive layer formed on the outer peripheral surface of the electrically-conductive base, and it is rotatable about its central axis. In the present embodiment, the photoconductor 20 rotates clockwise, as shown by the arrow in FIG. 1. The charging unit 30 is a device for electrically charging the photoconductor 20. The exposing unit 40 is a device for forming a latent image on the charged photoconductor 20 by radiating a laser beam thereon. The exposing unit 40 has, for example, a semiconductor laser, a polygon mirror, and an F-θ lens, and radiates a modulated laser beam onto the charged photoconductor 20 in accordance with image signals having been input from a not-shown host computer such as a personal computer or a word processor.

The YMCK developing unit 50 is a device for developing the latent image formed on the photoconductor 20 using toner T, that is, black (K) toner contained in a black developing device 51, magenta (M) toner contained in a magenta developing device 52, cyan (C) toner contained in a cyan developing device 53, and yellow (Y) toner contained in a yellow developing device 54. The toner T is an example of a "developer" contained in each of the developing devices.

The YMCK developing unit 50 can move the positions of the four developing devices 51, 52, 53, and 54 by rotating while the developing devices 51, 52, 53, and 54 are in an attached state. More specifically, the YMCK developing unit 50 holds the four developing devices 51, 52, 53, and 54 with four holding sections 55*a*, 55*b*, 55*c*, and 55*d*. The four developing devices 51, 52, 53, and 54 can be rotated about a rotation shaft 50*a* while maintaining their relative positions. Every time an image forming process for one page is finished, each of the developing devices selectively opposes the photoconductor 20 to successively develop the latent image formed on the photoconductor 20 using the toner T contained in each of the developing devices 51, 52, 53, and 54. It should be noted that each of the four developing devices 51, 52, 53, and 54 described above is attachable to and detachable from the respective holding sections of the YMCK developing unit 50. Details on the developing devices will be described further below.

The first transferring unit 60 is a device for transferring, onto the intermediate transferring body 70, a single-color toner image formed on the photoconductor 20. When the toners of all four colors are successively transferred in a superimposing manner, a full-color toner image will be formed on the intermediate transferring body 70. The intermediate transferring body 70 is a laminated endless belt that is made by providing an aluminum layer on the surface of a PET film by vapor deposition, and then further applying semiconducting coating on the outer layer thereof. The intermediate transferring body 70 is driven to rotate at substantially the same circumferential speed as the photoconductor 20. The second transferring unit 80 is a device for transferring the single-color toner image or the full-color toner image formed on the intermediate transferring body 70 onto a medium such as paper, film, and cloth.

The fixing unit 90 is a device for fusing the single-color toner image or the full-color toner image, which has been transferred onto the medium, to the medium to make it into a permanent image. The cleaning unit 75 is a device that is provided between the first transferring unit 60 and the charging unit 30, that has a rubber cleaning blade 76 made to abut against the surface of the photoconductor 20, and that is for removing the toner T remaining on the photoconductor 20 by scraping it off with the cleaning blade 76 after the toner image has been transferred onto the intermediate transferring body 70 by the first transferring unit 60.

Figure 2:
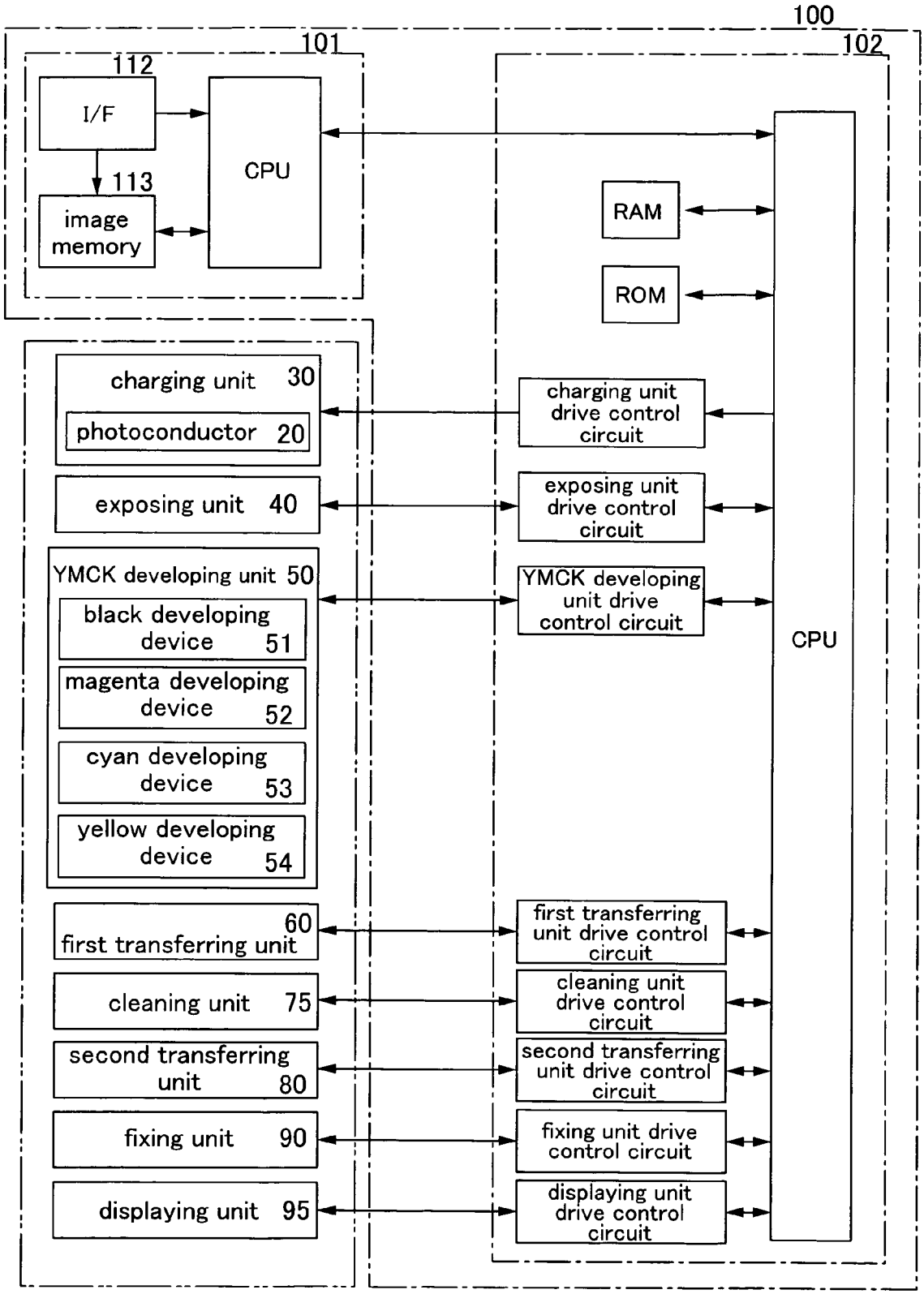
FIG. 2 is a block diagram showing a control unit of the printer 10 shown in FIG. 1.

The control unit 100 is provided with a main controller 101 and a unit controller 102 as shown in FIG. 2. Image signals and control signals are input to the main controller 101, and according to instructions based on the image signals and control signals, the unit controller 102 controls each of the above-mentioned units etc. to form an image.

Next, operations of the printer 10 structured as above will be described. First, when image signals and control signals are input from the not-shown host computer to the main controller 101 of the printer 10 through an interface (I/F) 112, the photoconductor 20, a developing roller which is an example of a "developer bearing roller", and the intermediate transferring body 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. The YMCK developing unit 50 positions the yellow developing device 54, which contains yellow (Y) toner, at the developing position, which is in opposition to the photoconductor 20. With the rotation of the photoconductor 20, the latent image formed on the photoconductor 20 reaches the developing position, and is developed with the yellow toner by the yellow developing device 54.

Thus, a yellow toner image is formed on the photoconductor 20. With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity from the polarity to which the toner T has been charged, is applied to the first transferring unit 60. It should be noted that, during this process, the photoconductor 20 and the intermediate transferring body 70 are placed in contact with each other, but the second transferring unit 80 is kept separated from the intermediate transferring body 70.

By subsequently performing the above-mentioned processes for the second, the third, and the fourth colors using each of the developing devices, toner images in four colors corresponding to the respective image signals are transferred onto the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a medium by the second transferring unit 80. It should be noted that the medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the medium is heated and pressurized by the fixing unit 90 and fused to the medium. On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for electrical charging for forming the next latent image. The scraped-off toner T is collected in a remaining-toner collector of the cleaning unit 75.

===(1) Overview of Control Unit===

Next, a configuration of the control unit 100 is described with reference to FIG. 2. The main controller 101 of the control unit 100 is connected to a host computer via the interface 112, and is provided with an image memory 113 for storing the image signals that have been input from the host computer.

The unit controller 102 is electrically connected to the units in the body of the apparatus (i.e., the charging unit 30, the exposing unit 40, the YMCK developing unit 50, the first transferring unit 60, the cleaning unit 75, the second transferring unit 80, the fixing unit 90, and the displaying unit 95), and it detects the state of the units by receiving signals from sensors provided in those units, and controls them based on the signals that are input from the main controller 101.

===(1) Overview of Developing Device===

Figure 3:
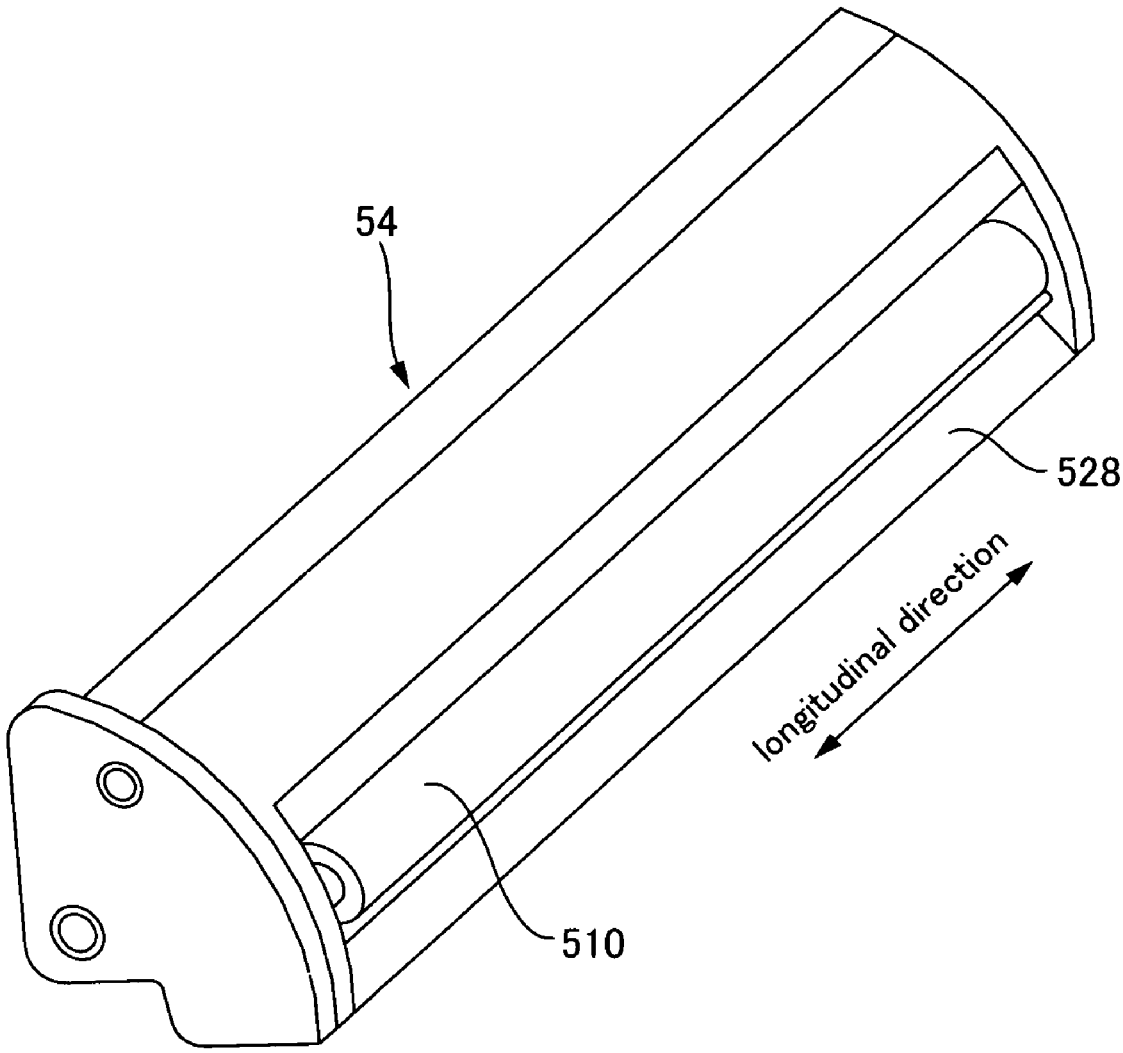
FIG. 3 is a conceptual diagram of a developing device.
Figure 4:
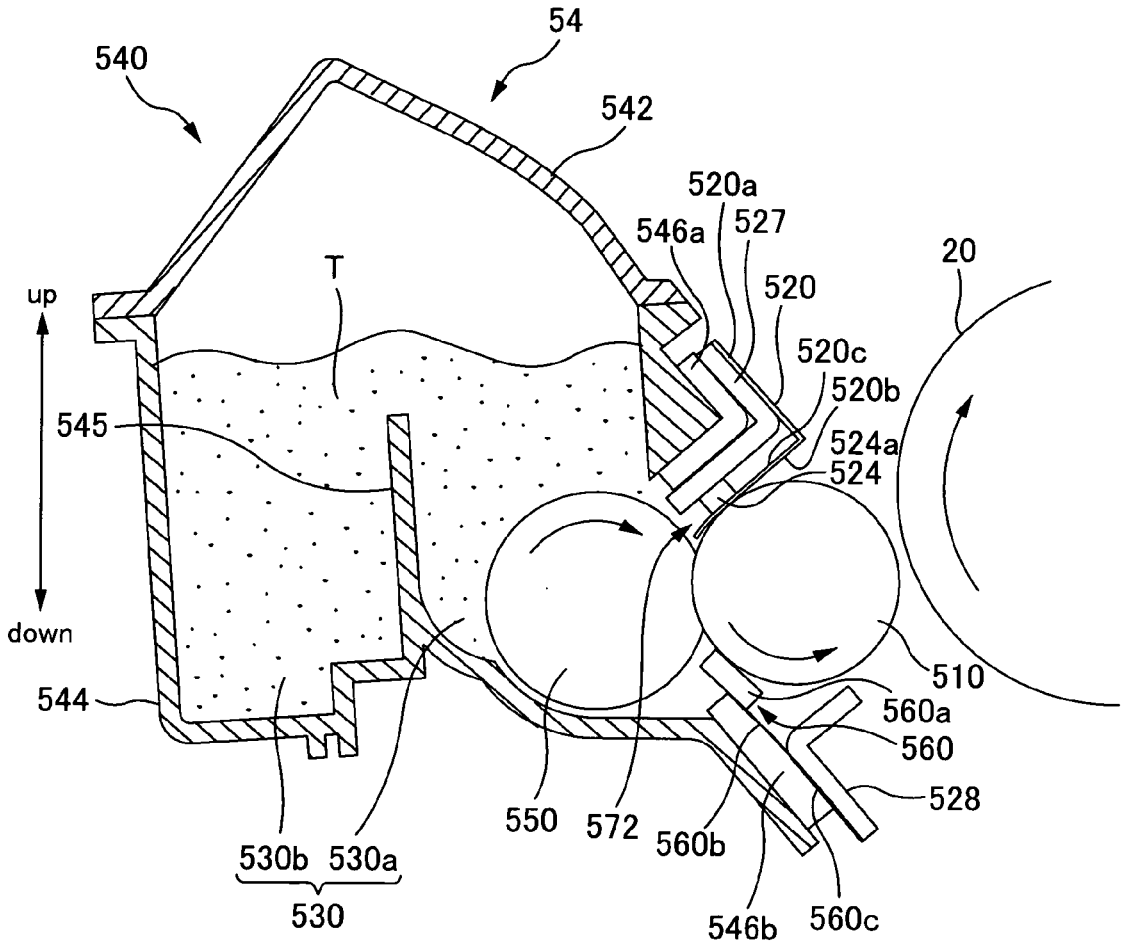
FIG. 4 is a section view showing main structural components of the developing device.

Next, with reference to FIG. 3 and FIG. 4, a configuration example and an operation example of the developing device will be described. FIG. 3 is a conceptual diagram of a developing device. FIG. 4 is a section view showing main structural components of the developing device. It should be noted that the section view shown in FIG. 4 is a section of the developing device bisected by a plane orthogonal to the longitudinal direction shown in FIG. 3. Further, in FIG. 4, the arrow indicates the vertical direction as in FIG. 1, and, for example, the central axis of the developing roller 510 is located below the central axis of the photoconductor 20. Further, in FIG. 4, the yellow developing device 54 is shown positioned at the developing position, which is in opposition to the photoconductor 20.

The YMCK developing unit 50 is provided with: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, description will be made only about the yellow developing device 54 below.

<Configuration of Yellow Developing Device 54>

The yellow developing device 54 has, for example: a developing roller 510; an upper seal 520 which is an example of a "first seal member"; an upper-seal urging member 524 which is an example of an "urging member"; a toner containing body 530; a housing 540; a toner supplying roller 550; a restriction blade 560; and end seals 574 which are an example of a "second seal member".

The developing roller 510 bears toner T and delivers it to the developing position opposing the photoconductor 20. The developing roller 510 is made of, for example, aluminum alloy such as aluminum alloy 5056 or aluminum alloy 6063, or iron alloy such as STKM, and where necessary, the roller 510 is plated with, for example, nickel plating or chromium plating. Further, the developing roller 510 has a shaft section 510*a* and a large-diameter section 510*b*. The developing roller 510 is rotatably supported by its shaft section 510*a* being supported by developing-roller supporting plates 529 of a holder 526 (described later) via bearings 576 (see FIG. 7). As shown in FIG. 4, the developing roller 510 rotates in the opposite direction (counterclockwise in FIG. 4) to the rotating direction of the photoconductor 20 (clockwise in FIG. 4). The central axis of the roller 510 is located below the central axis of the photoconductor 20.

Further, in a state where the yellow developing device 54 is in opposition to the photoconductor 20, there is a gap between the developing roller 510 and the photoconductor 20. That is, the yellow developing device 54 develops the latent image formed on the photoconductor 20 in a non-contacting state. It should be noted that an alternating field is generated between the developing roller 510 and the photoconductor 20 upon development of the latent image formed on the photoconductor 20.

The housing 540 is manufactured by welding together a plurality of integrally-molded housing sections made of resin, that is, an upper housing section 542 and a lower housing section 544. In the housing 540 is formed a toner containing body 530 for containing the toner T. The toner containing body 530 is divided into two toner containing sections, namely, the first toner containing section 530*a* and the second toner containing section 530*b*, by a partitioning wall 545 that is for partitioning the toner T and that protrudes inwards (in the up/down direction of FIG. 4) from the inner wall. The first toner containing section 530*a* and the second toner containing section 530*b* are connected at their upper sections, and in the state shown in FIG. 4, movement of the toner T is restricted by the partitioning wall 545.

However, when the YMCK developing unit 50 is rotated, the toner contained in the first toner containing section 530*a* and the second toner containing section 530*b* is once gathered on the side of the section where the containing sections are connected, which is on the upper side when in the developing position, and when the YMCK developing unit 50 returns to the state shown in FIG. 4, the toner gets mixed and is returned to the first toner containing section 530*a* and the second toner containing section 530*b*. In other words, the toner T is appropriately stirred within the developing device by the rotation of the YMCK developing unit 50. Therefore, in the present embodiment, no stirring member is provided in the toner containing body 530. However, it is possible to provide a stirring member for stirring the toner T contained in the toner containing body 530. Further, as shown in FIG. 4, the housing 540 (more specifically, the first toner containing section 530*a*) has an opening 572 in its lower section, and the developing roller 510 described below is provided facing the opening 572.

The toner supplying roller 550 is provided in the first toner containing section 530*a* described above and supplies the toner T contained in the first toner containing section 530*a* to the developing roller 510. It also strips off, from the developing roller 510, the toner T remaining on the developing roller 510 after development. The toner supplying roller 550 is made of, for example, polyurethane foam, and is made to abut against the developing roller 510 in an elastically deformed state. The toner supplying roller 550 is arranged at a lower section of the first toner containing section 530*a*. The toner T contained in the first toner containing section 530*a* is supplied to the developing roller 510 by the toner supplying roller 550 at the lower section of the first toner containing section 530*a*. The toner supplying roller 550 is rotatable about its central axis, and the central axis of the toner supplying roller 550 is located lower than the central axis of rotation of the developing roller 510. Further, the toner supplying roller 550 rotates in the opposite direction (clockwise in FIG. 4) to the rotating direction of the developing roller 510 (counterclockwise in FIG. 4).

The upper seal 520 abuts against the developing roller 510 along the axial direction thereof to allow the toner T remaining on the developing roller 510 after passing the developing position to move into the housing 540 and also to prevent the toner T in the housing 540 from spilling out therefrom. The upper seal 520 is a seal made, for example, of polyethylene film. The upper seal 520 is supported by an upper-seal supporting plate 527, which is an example of a "second seal supporting member", of the holder 526 described below, and it is arranged such that its longitudinal direction is in the axial direction of the developing roller 510 (see FIG. 7). The abutting position where the upper seal 520 abuts against the developing roller 510 is above the central axis of the developing roller 510.

It should be noted that in between the upper-seal supporting plate 527 and a surface of the upper seal 520 (which is also referred to as the upper-seal opposite surface 520*c*) on the opposite side from the upper-seal abutting surface 520*b* of the upper seal 520 with which it abuts against the developing roller 510, there is provided an upper-seal urging member 524 made of an elastic body, such as Moltoprene, in a compressed state. It should be noted that the detailed configuration etc. of the upper-seal urging member 524 will be described further below.

The restriction blade 560 abuts against the developing roller 510 along the axial direction thereof, and restricts the thickness of the layer of the toner T borne by the developing roller 510 as well as gives an electric charge to the toner T borne by the developing roller 510. The restriction blade 560 includes a rubber section 560*a* and a rubber-supporting section 560*b*. The rubber section 560*a* is made of, for example, silicone rubber or urethane rubber. The rubber-supporting section 560*b* is a thin plate that is made of, for example, phosphor bronze or stainless steel, and that has a spring-like characteristic. The rubber section 560*a* is supported by the rubber-supporting section 560*b*. The rubber-supporting section 560*b* presses, with its urging force, the rubber section 560*a* against the developing roller 510. The rubber-supporting section 560*b* is attached to a restriction-blade supporting plate 528 of the holder 526, which is described later, in a state where one end of the rubber-supporting section 560*b* is supported by the restriction-blade supporting plate 528.

The end of the restricting blade 560 opposite from the end that is being supported by the restriction-blade supporting plate 528, i.e., the tip end of the restriction blade 560, is not placed in contact with the developing roller 510; rather, a section at a predetermined distance away from the tip end contacts, with some breadth, the developing roller 510. That is, the restriction blade 560 does not abut against the developing roller 510 at its edge, but abuts against the roller 510 near its central portion. Further, the restriction blade 560 is arranged so that its tip end faces toward the upstream side of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner supplying roller 550. It should be noted that the restriction blade 560 also achieves the function of preventing the toner T from spilling from the toner containing body 530 by abutting against the developing roller 510 along its axial direction.

Figure 6:
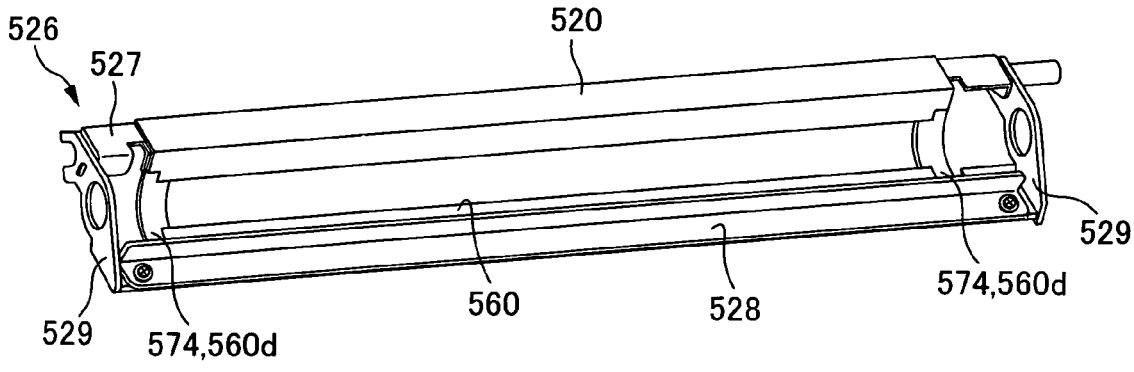
FIG. 6 is a perspective view showing a state in which an upper seal 520, a restriction blade 560, end seals 574, and an upper-seal urging member 524 are assembled onto the holder 526.

Further, end seals 574 are provided on the outer sides, in the longitudinal direction, of the rubber section 560*a* of the restriction blade 560 (see FIG. 6). The material from which the end seals 574 are made is nonwoven fabric, and the end seals 574 achieve the function of preventing the toner T from spilling by abutting against the large-diameter-section ends 510*c*, which are an example of an "end in the axial direction of the developing roller 510", along the circumferential direction of the developing roller 510. More specifically, each end seal 574 has an end-seal abutting surface 574*c* that abuts against the large-diameter-section end 510*c* of the developing roller 510 along the circumferential direction thereof, and due to the abutment of the end-seal abutting surface 574*c* along the circumferential direction of the developing roller 510, the toner T is prevented from spilling from between the circumferential surface of the developing roller 510 and the housing 540.

The end seal 574 is arranged so that its longitudinal direction is orthogonal to the axial direction of the developing roller 510, and is supported by the longitudinal-direction end 560*d* of the restriction blade 560 (FIG. 6) and the upper-seal supporting plate 527 of the holder 526 described later on. The end seal 574 has a recessed section 574*e* cut out like a recess (see FIG. 15).

<Operation of Yellow Developing Device 54>

In the yellow developing device 54 structured as above, the toner supplying roller 550 supplies the toner T contained in the toner containing body 530 to the developing roller 510. With the rotation of the developing roller 510, the toner T, which has been supplied to the developing roller 510, reaches the abutting position of the restriction blade 560; then, as the toner T passes the abutting position, the toner is electrically charged and its layer thickness is restricted. With further rotation of the developing roller 510, the toner T on the developing roller 510, which has been electrically charged and whose layer thickness has been restricted, reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the upper seal 520 and is collected into the developing device by the upper seal 520 without being scraped off. Further, the toner T that still remains on the developing roller 510 can be stripped off by the toner supplying roller 550.

===(1) Configuration of Holder etc.===

Figure 5:
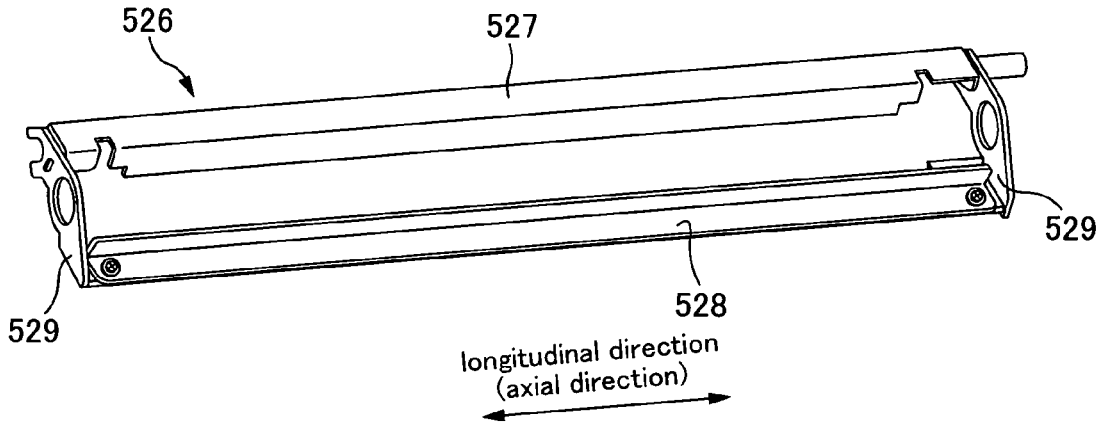
FIG. 5 is a perspective view of a holder 526.
Figure 7:
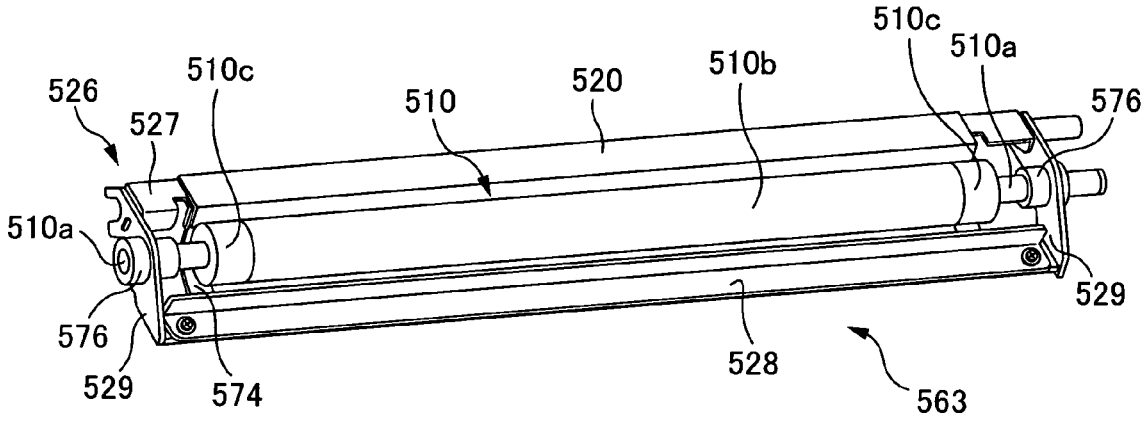
FIG. 7 is a perspective view of a unit 563.
Figure 8:
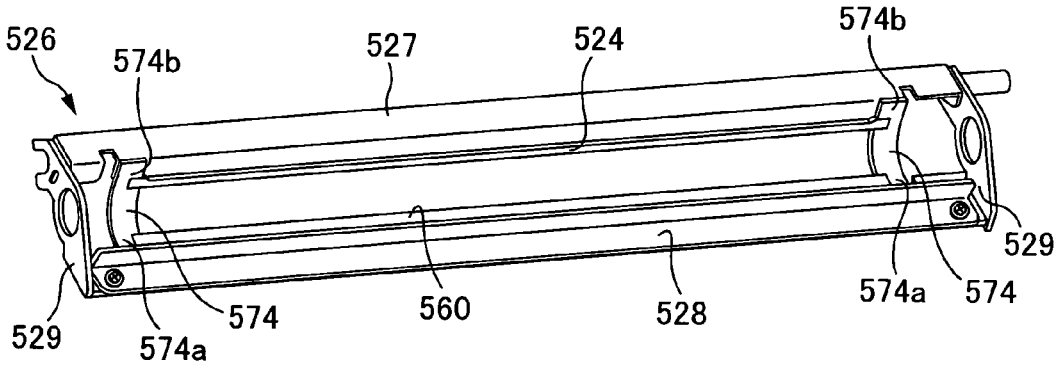
FIG. 8 is a perspective view showing the upper-seal urging member 524 supported by the holder 526.
Figure 9:
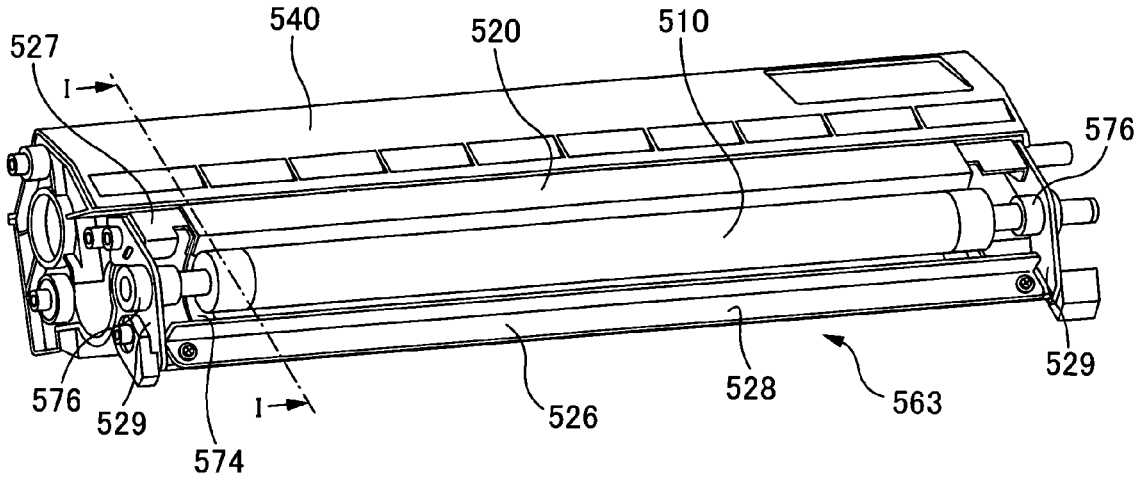
FIG. 9 is a perspective view showing how the unit 563 is attached to a housing 540 via a housing seal 546.
Figure 10:
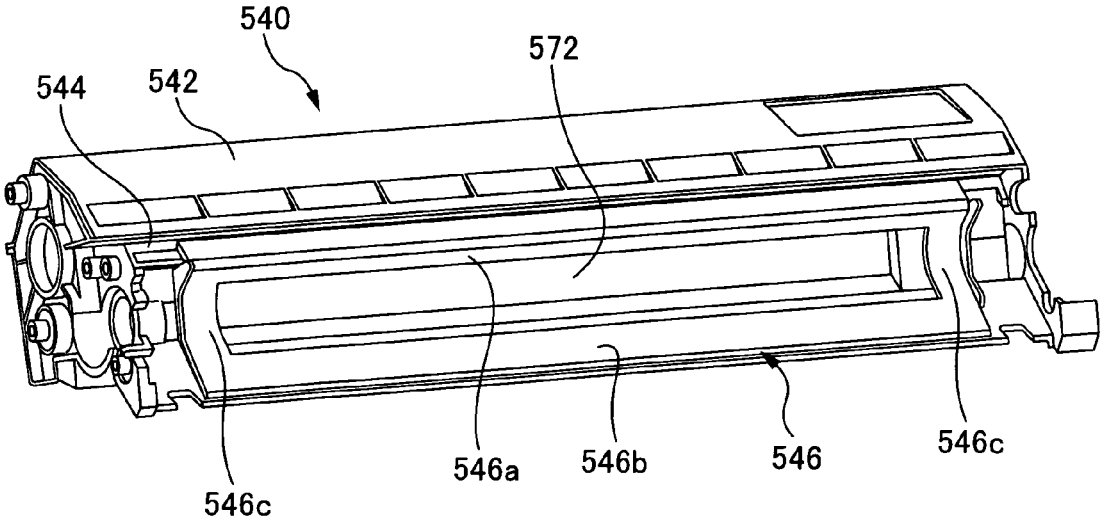
FIG. 10 is a perspective view showing how the housing seal 546 is fixed to the housing 540.

Next, the configuration of the holder 526 and its peripheral area will be described with reference to FIG. 4 through FIG. 10. FIG. 5 is a perspective view of the holder 526. FIG. 6 is a perspective view showing a state in which the upper seal 520, the restriction blade 560, the end seals 574, and the upper-seal urging member 524 are assembled onto the holder 526. FIG. 7 is a perspective view of a unit 563. FIG. 8 is a diagram in which the upper seal 520 is removed from the perspective view of FIG. 6, and is a perspective view showing the upper-seal urging member 524 supported by the holder 526. FIG. 9 is a perspective view showing how the unit 563 is attached to the housing 540 via a housing seal 546. FIG. 10 is a diagram in which the unit 563 is removed from the perspective view of FIG. 9, and is a perspective view showing how the housing seal 546 is fixed to the housing 540.

The holder 526 is an assembly member made of metal for assembling the developing roller 510, the restriction blade 560, the upper seal 520, the end seals 574, and the upper-seal urging member 524. As shown in FIG. 5, the holder 526 has an upper-seal supporting plate 527 along its longitudinal direction (i.e., the axial direction of the developing roller 510), a restriction-blade supporting plate 528 also along its longitudinal direction (i.e., the axial direction of the developing roller 510), and developing-roller supporting plates 529 that are arranged on the outer sides, in the longitudinal direction (axial direction), of the upper-seal supporting plate 527 and the restriction-blade supporting plate 528 and that intersect the longitudinal direction (the axial direction).

As shown in FIG. 6 and FIG. 7, the upper seal 520 is supported by the upper-seal supporting plate 527 at its lateral-direction end 520*a* (see FIG. 4), the developing roller 510 is supported by the developing-roller supporting plates 529 at its shaft section 510*a* (see FIG. 7), and the restriction blade 560 is supported by the restriction-blade supporting plate 528 at its lateral-direction end 560*c* (see FIG. 4). As shown in FIG. 8, the upper-seal urging member 524 is arranged such that its longitudinal direction is parallel to the axial direction of the developing roller 510, and is supported by the upper-seal supporting plate 527. Further, as shown in FIG. 8, the longitudinal-direction end 574*b* of each end seal 574 is supported by the upper-seal supporting plate 527, and the longitudinal-direction end 574*a* of each end seal 574 is supported by the longitudinal-direction end 560*d* of the restriction blade 560.

The developing roller 510, the restriction blade 560, the end seals 574, the upper seal 520, and the upper-seal urging member 524 are assembled onto the holder 526 in this way, thereby forming a single unit 563.

As shown in FIG. 9 and FIG. 10, the unit 563, which is provided with the developing roller 510, the restriction blade 560, the end seals 574, the upper seal 520, the upper-seal urging member 524, and the holder 526 onto which these components have been assembled, is attached to the housing 540 via the housing seal 546, which is an example of a "third seal member".

One housing seal 546 is provided for each developing device, and achieves the function of preventing the toner T from spilling from between the unit 563 and the housing 540. As shown in FIG. 10, the housing seal 546 is made by cutting out the central section (a rectangular section) of a rectangular elastic member made, for example, of Moltoprene, and includes a first seal section 546*a*, a second seal section 546*b*, and third seal sections 546*c*.

The first seal section 546*a* abuts against the upper-seal supporting plate 527 of the holder 526 and the housing 540 to achieve the function of preventing the toner T from spilling from between the upper-seal supporting plate 527 and the housing 540. The second seal section 546*b* abuts against the rubber-supporting section 560*b* of the restriction blade 560 and the housing 540 to achieve the function of preventing the toner T from spilling from between the rubber-supporting section 560*b* and the housing 540. The third seal sections 546*c* abut against the end seals 574, the housing 540, and the upper-seal supporting plate 527 to achieve the function of preventing the toner T from spilling from between the end seals 574, the housing 540, and the upper-seal supporting plate 527.

It should be noted that, among the unit 563 and the housing 540, the housing seal 546 is fixed only to the housing 540. Further, the second seal section 546*b* not only has the function of preventing the toner T from spilling, but also has the function of stabilizing the elastic force resulting from bending of the rubber-supporting section 560*b* and making the rubber section 560*a* abut against the developing roller 510 more evenly.

===(1) Configuration of Upper-seal Supporting Plate 527 and Upper-seal Urging Member 524 etc.===

Figure 11:
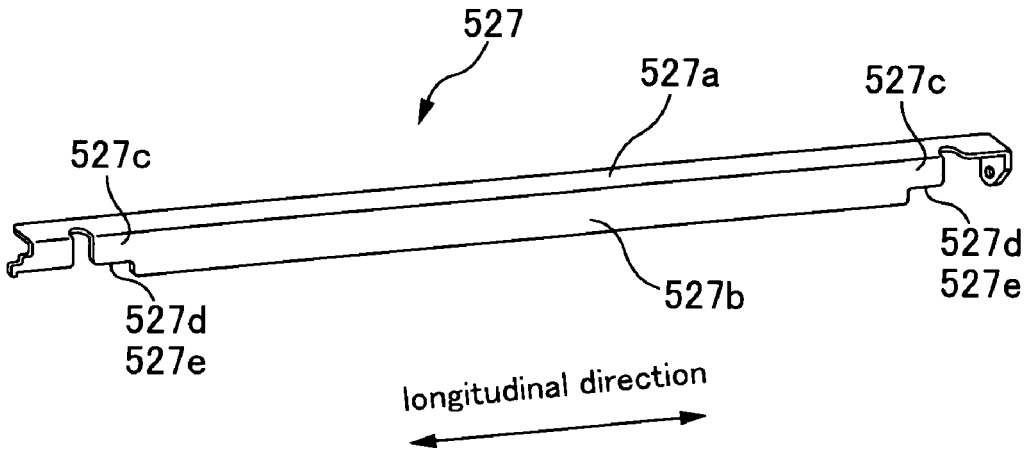
FIG. 11 is a perspective view of an upper-seal supporting plate 527.
Figure 12:
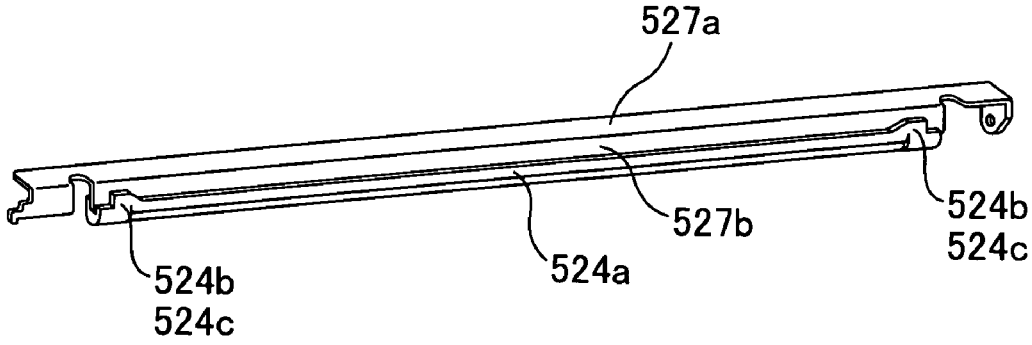
FIG. 12 is a perspective view showing the upper-seal supporting plate 527 supporting the upper-seal urging member 524.
Figure 13:
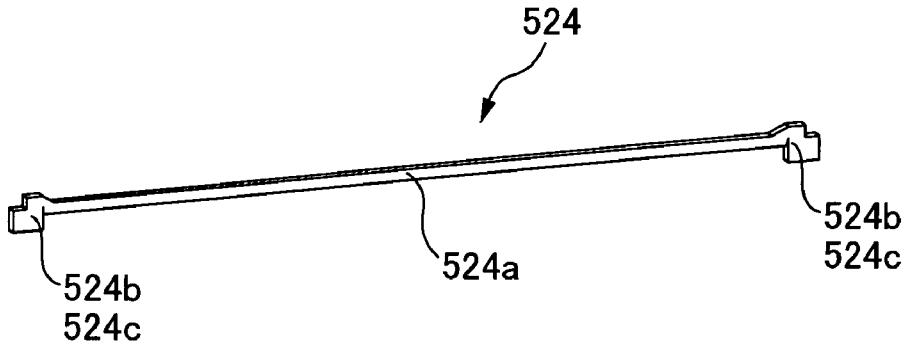
FIG. 13 is a perspective view showing the upper-seal urging member 524 before it is supported by the upper-seal supporting plate 527.
Figure 14:
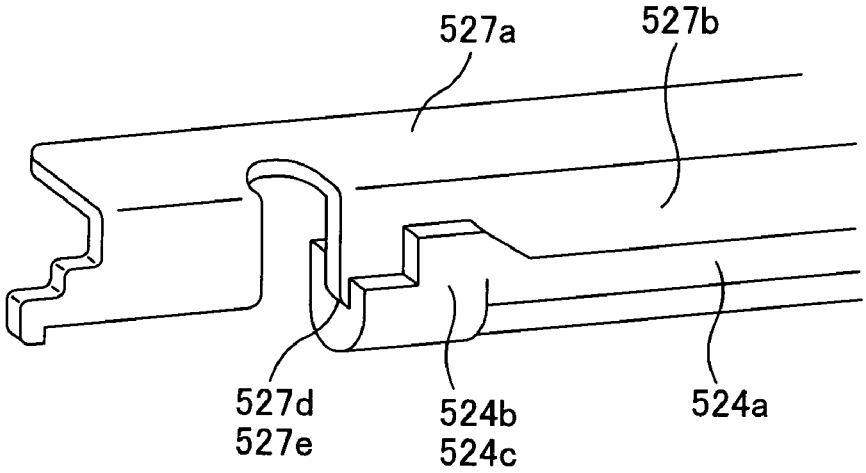
FIG. 14 is a diagram showing a longitudinal-direction end of the upper-seal supporting plate 527 supporting the upper-seal urging member 524.
Figure 15:
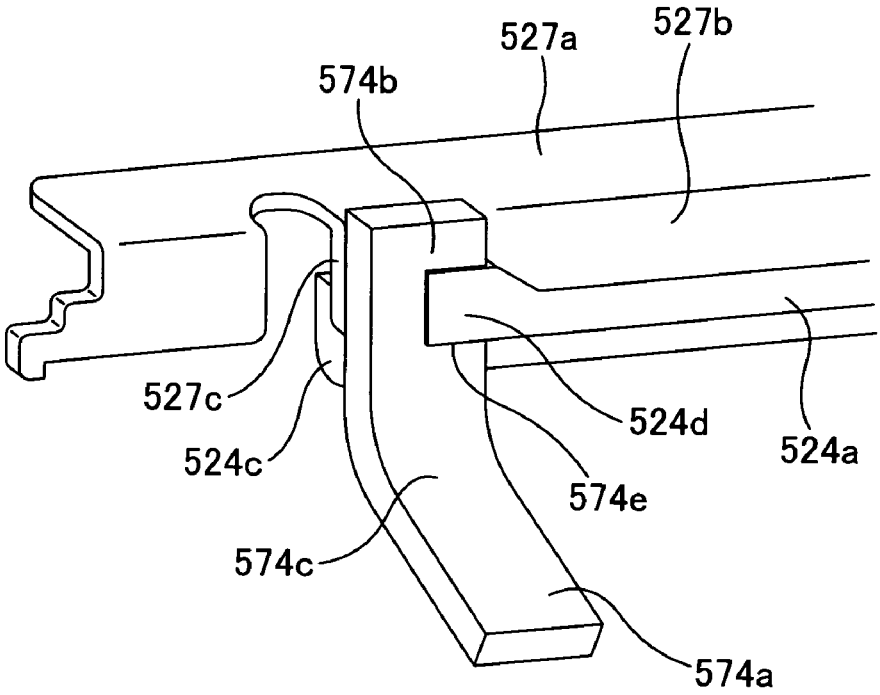
FIG. 15 is a diagram showing a longitudinal-direction end of the upper-seal supporting plate 527 supporting the upper-seal urging member 524 and the end seal 574.
Figure 16:
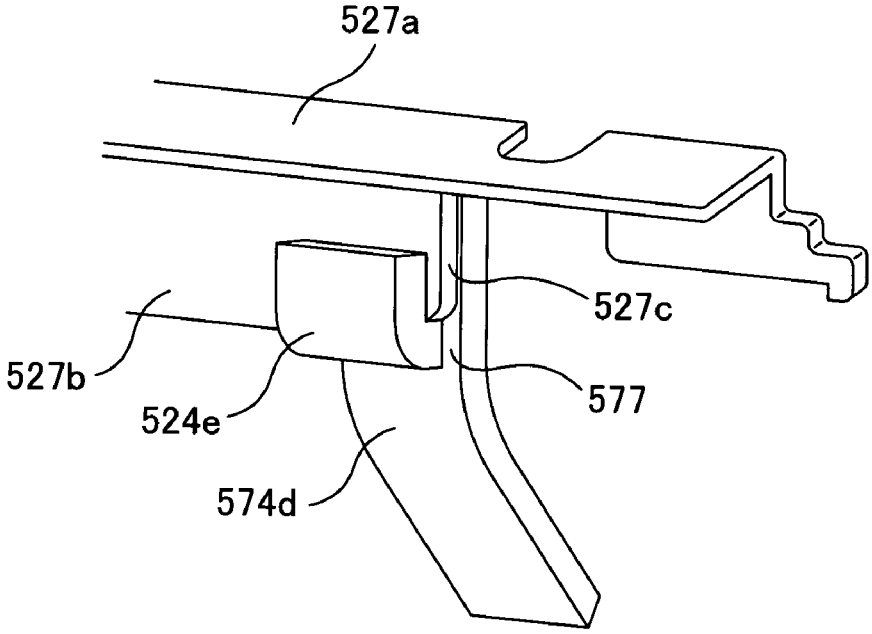
FIG. 16 is a diagram viewed from the rear side of the upper-seal supporting plate 527 etc. shown in FIG. 15.
Figure 17:
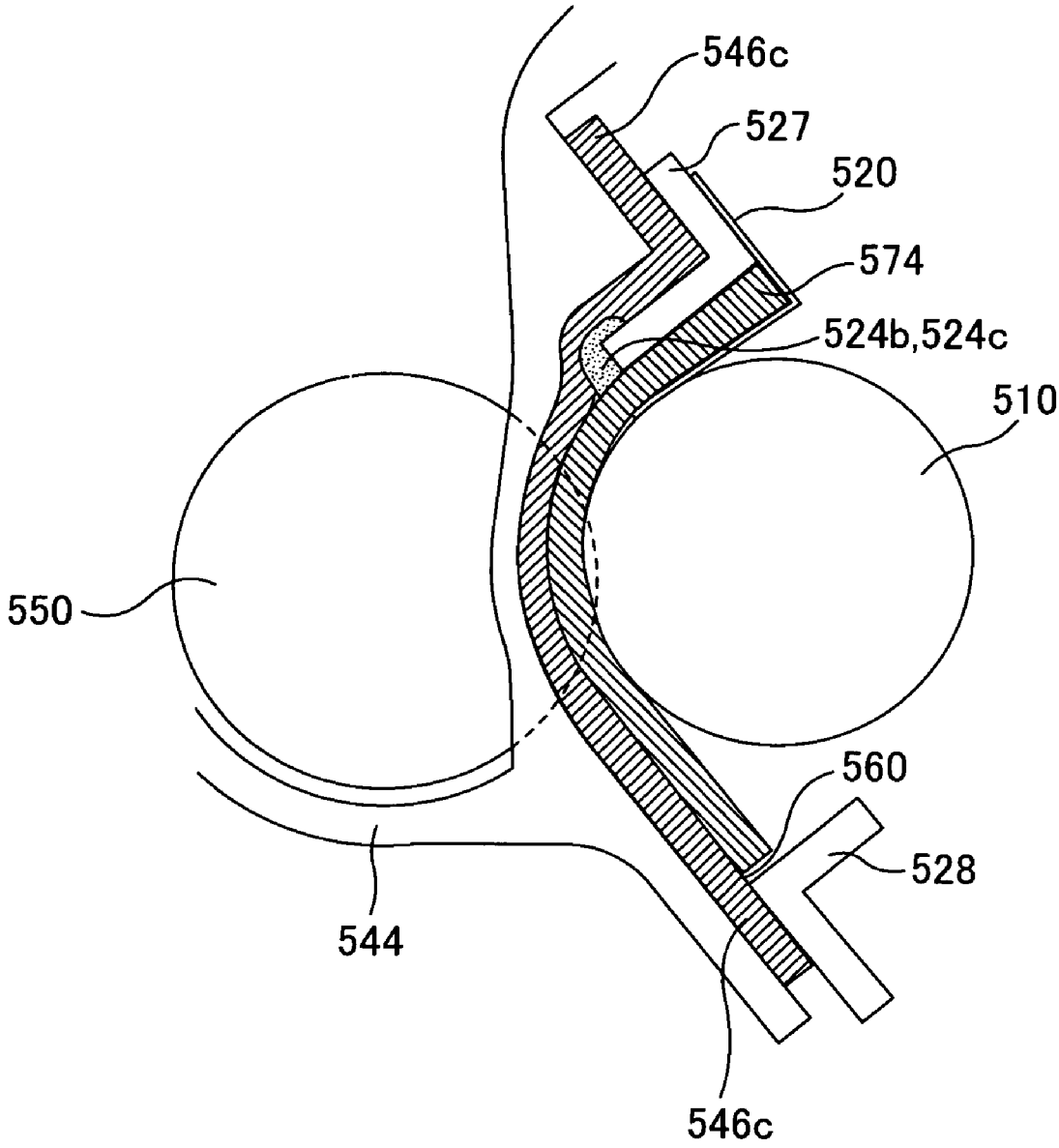
FIG. 17 is a portion of the section taken along line I-I of FIG. 9, and is a diagram showing the periphery of the end seal 574.

Next, the configuration of the upper-seal supporting plate 527 and the upper-seal urging member 524, how the upper-seal urging member 524 is supported by the upper-seal supporting plate 527, and so forth, will be described with reference to FIG. 11 through FIG. 17. FIG. 11 is a perspective view of the upper-seal supporting plate 527. FIG. 12 is a perspective view showing the upper-seal supporting plate 527 supporting the upper-seal urging member 524. FIG. 13 is a perspective view showing the upper-seal urging member 524 before it is supported by the upper-seal supporting plate 527. FIG. 14 is a diagram showing a longitudinal-direction end of the upper-seal supporting plate 527 supporting the upper-seal urging member 524. FIG. 15 is a diagram showing a longitudinal-direction end of the upper-seal supporting plate 527 supporting the upper-seal urging member 524 and the end seal 574. FIG. 16 is a diagram viewed from the rear side of the upper-seal supporting plate 527 etc. shown in FIG. 15. FIG. 17 is a portion of the section taken along line I-I of FIG. 9, and is a diagram showing the periphery of the end seal 574.

As described above, the upper-seal supporting plate 527 supports the upper seal 520, the upper-seal urging member 524, and the end seals 574. The upper-seal supporting plate 527 is a portion of the holder 526, which is attached to the housing 540 via the housing seal 546, and is attached to the housing 540 via the first seal section 546*a* and the third seal sections 546*c* of the housing seal 546.

The cross-sectional shape, taken along the direction orthogonal to the longitudinal direction, of the upper-seal supporting plate 527 shown in FIG. 11 is like the letter "L" (see FIG. 4), and the upper-seal supporting plate 527 includes a first supporting section 527*a* and a second supporting section 527*b* which is orthogonal to the first supporting section 527*a*. The first supporting section 527*a* supports the lateral-direction end 520*a* of the upper seal 520 (FIG. 4). The second supporting section 527*b* supports the upper-seal urging member 524 along its longitudinal direction. Further, the second supporting section 527*b* has, at both its longitudinal-direction ends, end-seal supporting sections 527*c*, which are an example of a "second seal supporting section", that support the longitudinal-direction ends 574*b* (see FIG. 15) of the end seals 574.

The end-seal supporting section 527*c* supports, at the longitudinal-direction end 574*b* of the end seal 574 via a double-faced tape, a surface of the end seal 574 (which is also referred to as the end-seal opposite surface 574*d*) on the opposite side from the end-seal abutting surface 574*c* of the end seal 574. The end-seal supporting section 527*c* has a cut-out section 527*d* in a position located in opposition to the end seal 574. The cut-out section 527*d* is cut out in the shape of a rectangle, and has a side edge 527*e* that is parallel to the axial direction of the developing roller 510.

It should be noted that the upper-seal supporting plate 527 is attached to the housing 540 such that the boundary section 577 between the end seal 574 and the upper-seal supporting plate 527 faces the housing 540. More specifically, the upper-seal supporting plate 527 is attached to the housing 540 such that the boundary section 577 between the end-seal opposite surface 574*d* and the end-seal supporting section 527*c* (see FIG. 16) faces the housing 540.

Further, the upper-seal urging member 524, which is supported by the second supporting section 527*b* of the upper-seal supporting plate 527 via a double-faced tape, is arranged along the axial direction of the developing roller 510, and urges the upper seal 520 toward the developing roller 510 by abutting against the upper seal 520. The upper-seal urging member 524 is made of sponge.

As shown in FIG. 12, the upper-seal urging member 524 has an urging section 524*a* in the longitudinal-direction central section and extending sections 524*b* at its longitudinal-direction ends. The urging section 524*a* presses the upper seal 520 against the developing roller 510 by urging the upper seal 520 toward the developing roller 510 with its urging force. Each extending section 524*b* extends up to a position between the boundary section 577 and the housing 540, more specifically, up to a position between the boundary section 577 and the third seal section 546*c* of the housing seal 546. Each extending section 524*b* is supported by the corresponding end-seal supporting section 527*c* via a double-faced tape.

As shown in FIG. 14, the extending section 524*b* has a fold-back section 524*c* that is folded around and supported by the end-seal supporting section 527*c*. The fold-back section 524*c* is folded around and supported by the end-seal supporting section 527*c* in such a manner that it surrounds the side edge 527*e* of the cut-out section 527*d* of the end-seal supporting section 527*c*. Thus, as shown in FIG. 15 and FIG. 16, one section 524*d* of the fold-back section 524*c* and the other section 524*e* of the fold-back section 524*c* are supported by different sides of the end-seal supporting section 527*c*.

Further, as shown in FIG. 17, a portion of the fold-back section 524*c* abuts against both the boundary section 577 and the housing seal 546. More specifically, the one section 524*d* of the fold-back section 524*c* abuts against the boundary section 577 in a compressed state, and the other section 524*e* of the fold-back section 524*c* abuts against the third seal section 546*c* of the housing seal 546 in a compressed state. Further, the one section 524*d* of the fold-back section 524*c* is arranged such that a portion thereof fits into the recessed section 574*e* of the end seal 574, as shown in FIG. 15. It should be noted that the shape of the fold-back section 524*c* before it is folded around and supported by the end-seal supporting section 527*c* is like the letter "L", as shown in FIG. 13.

===(1) Effectiveness of Developing Device According to Present Embodiment===

The developing device 51, 52, 53, or 54 according to the present embodiment is provided with: a housing 540 having an opening 572 and adapted to contain a developer (toner T); a developer bearing roller (developing roller 510) arranged facing the opening 572 and adapted to bear the toner T; a first seal member (upper seal 520) abutting against the developing roller 510 along an axial direction of the developing roller 510 to prevent the toner T from spilling; a second seal member (end seal 574) abutting against an end, in the axial direction, of the developing roller 510 (large-diameter-section end 510*c*) along a circumferential direction of the developing roller 510 to prevent the toner T from spilling; a second seal supporting member (upper-seal supporting plate 527) that supports an end 574*b*, in a longitudinal direction, of the end seal 574, and that is attached to the housing 540 such that a boundary section 577 between the end seal 574 and the upper-seal supporting plate 527 faces the housing 540; and an urging member (upper-seal urging member 524) that is arranged along the axial direction of the developing roller 510 and that is adapted to urge the upper seal 520 toward the developing roller 510 by abutting against the upper seal 520, the upper-seal urging member 524 having, at an end in its longitudinal direction, an extending section 524*b* that extends up to a position between the boundary section 577 and the housing 540. In this way, it is possible to achieve a developing device that can appropriately prevent the toner T from spilling from between the boundary section 577 of the end seal 574 and the upper-seal supporting plate 527 and the housing 540, without increasing the number of components of the developing device. This is described in detail below.

As described above, the upper-seal supporting plate 527 supporting the end seal 574 is attached to the housing 540. However, depending on, for example, the state in which the upper-seal supporting plate 527 is attached to the housing 540, there are instances in which a gap is formed between the housing 540 and the boundary section 577 of the end seal 574 and the upper-seal supporting plate 527. In cases where such a gap exists between the boundary section 577 and the housing 540, the toner T may spill through the gap, since the toner T is a fine particle. In view of this, it is necessary to provide, for example, a seal member for preventing the toner T from spilling through this gap. This, however, may lead to an increase in the number of components of the developing device.

Figure 18:
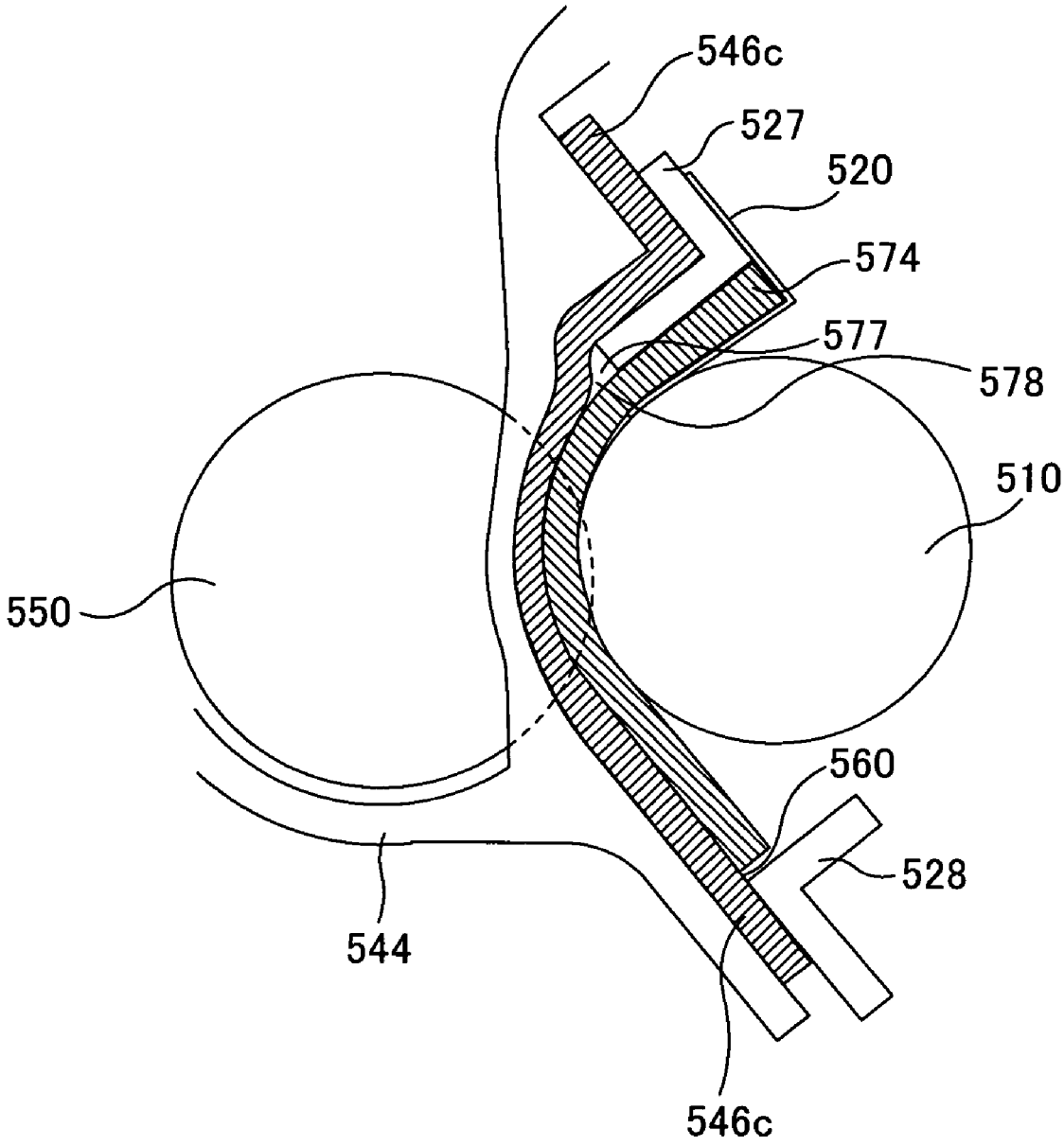
FIG. 18 is a diagram showing a comparative example in which the upper-seal urging member 524 does not have the extending sections 524*b;*

This is described more specifically with reference to a comparative example shown in FIG. 18. FIG. 18 is a diagram showing a comparative example in which the upper-seal urging member 524 does not have the extending sections 524*b*. In the developing device shown in FIG. 18, the upper-seal urging member 524, which is supported by the upper-seal supporting plate 527, does not have the extending sections 524*b*. It should be noted that the upper-seal supporting plate 527 of the comparative example is attached to the housing 540 via the housing seal 546. In such a case, as shown in FIG. 18, a gap 578 is formed between the housing seal 546 and the boundary section 577 of the end seal 574 and the upper-seal supporting plate 527. Here, the gap 578 is formed along the axial direction of the developing roller 510 toward the outer sides in the axial direction. In such a case, the toner T in the housing 540 will spill out from the housing 540 through this gap 578. Since it becomes necessary to provide a component for filling up this gap 578, the number of components of the developing device may have to be increased.

On the other hand, according to the present embodiment, the upper-seal urging member 524, which urges the upper seal 520 toward the developing roller 510, has, at an end in its longitudinal direction, an extending section 524*b* that extends up to a position between the boundary section 577 and the housing 540, as shown in FIG. 17. In this way, it is less likely that a gap (such as the gap 578 shown in FIG. 18) is formed between the housing 540 and the boundary section 577 of the end seal 574 and the upper-seal supporting plate 527. Therefore, the toner T can be prevented from spilling. Further, the upper-seal urging member 524 not only has the function of urging the upper seal 520 toward the developing roller 510, but also the function of preventing the toner T from spilling from between the boundary section 577 and the housing 540. Therefore, since the upper-seal urging member 524 has both the above two functions, it is possible to prevent an increase in the number of components of the developing device.

As described above, by providing the extending section(s) 524*b* to the upper-seal urging member 524, it is possible to achieve a developing device 51, 52, 53, 54 that can appropriately prevent the toner T from spilling from between the boundary section 577 and the housing 540, without increasing the number of components of the developing device.

===(1) Other Considerations===

In the foregoing embodiment, the end seal 574 has an end-seal abutting surface 574*c* (FIG. 15) that abuts against the large-diameter-section end 510*c* of the developing roller 510 along the circumferential direction of the developing roller 510; and the upper-seal supporting plate 527 has a end-seal supporting section 527*c* (FIG. 16) that supports a surface (end-seal opposite surface 574*d*) of the end seal 574 on an opposite side from the end-seal abutting surface 574*c*. Further, as shown in FIG. 16, the boundary section 577 is a boundary section between the end-seal supporting section 527*c* and the end-seal opposite surface 574*d*. These, however, are not limitations. For example, the upper-seal supporting plate 527 may support the end-seal abutting surface 574*c*, and the boundary section may be a boundary section between the end-seal abutting surface 574*c* and the end-seal supporting section 527*c*.

Further, in the foregoing embodiment, the extending section 524*b* is supported by the end-seal supporting section 527*c* via a double-faced tape, as shown in FIG. 14. This, however, is not a limitation. For example, the extending section 524*b* does not have to be supported by the end-seal supporting section 527*c*.

However, in cases where the extending section 524*b* is supported by the end-seal supporting section 527*c* via a double-faced tape, it becomes easier to arrange the extending section 524*b* in a desired position because it is less likely that the extending section 524*b* will be shifted in position with respect to the end-seal supporting section 527*c*. Thus, it becomes possible to prevent the toner T from spilling from between the housing 540 and the boundary section 577, which is between the end-seal opposite surface 574*d* and the end-seal supporting section 527*c*, more effectively. The foregoing embodiment is therefore more preferable.

It should be noted that the extending section 524*b* may be supported by the end-seal supporting section 527*c* via an adhesive.

Further, in the foregoing embodiment, the extending section 524*b* has a fold-back section 524*c* (FIG. 14) that is folded around and supported by the end-seal supporting section 527*c*; and a portion of the fold-back section 524*c* is positioned between the boundary section 577 and the housing 540, as shown in FIG. 17. This, however, is not a limitation. For example, the extending section 524*b* does not have to be folded around and supported by the end-seal supporting section 527*c*.

However, in cases where the extending section 524*b* has a fold-back section 524*c* that is folded around and supported by the end-seal supporting section 527*c*, it is less likely that a gap will be formed between the boundary section 577 and the housing 540 because it is easy to appropriately arrange the extending section 524*b* between the boundary section 577 and the housing 540. The foregoing embodiment is therefore more preferable.

Further, in the foregoing embodiment, the end-seal supporting section 527*c* of the upper-seal supporting plate 527 has a cut-out section 527*d* (FIG. 11) in a position located in opposition to the end seal 574; and the fold-back section 524*c* is folded around and supported by the end-seal supporting section 527*c* in such a manner that the fold-back section 524*c* surrounds a side edge 527*e* of the cut-out section 527*d*, as shown in FIG. 14. This, however, is not a limitation. For example, the end-seal supporting section 527*c* does not have to be provided with the cut-out section 527*d*.

Further, in this developing device, the upper-seal supporting plate 527 is attached to the housing 540 via a third seal member (the housing seal 546 shown in FIG. 10) adapted to prevent the toner T from spilling from between the upper-seal supporting plate 527 and the housing 540; and the extending section 524*b* extends up to a position between the boundary section 577 and the housing seal 546 and abuts against both the boundary section 577 and the housing seal 546, as shown in FIG. 17. This, however, is not a limitation. For example, the upper-seal supporting plate 527 may be attached to the housing 540 without the housing seal 546 being interposed therebetween, and the extending section 524*b* may abut against the boundary section 577 and the housing 540.

However, in cases where the upper-seal supporting plate 527 is attached to the housing 540 via the housing seal 546 and the extending section 524*b* abuts against both the boundary section 577 and the housing seal 546, it is even less likely that a gap will be formed between the boundary section 577 and the housing 540. Thus, it becomes possible to prevent the toner T from spilling from between the boundary section 577 and the housing 540 more effectively. The foregoing embodiment is therefore more preferable.

Further, in the foregoing embodiment, the upper-seal supporting plate 527 is made of metal; the end seal 574 is made of nonwoven fabric; and the upper-seal urging member 524 is made of sponge. This, however, is not a limitation. For example, the upper-seal supporting plate 527 may be made of a material that is more flexible than metal.

In cases where the upper-seal supporting plate 527 is made of metal, the upper-seal supporting plate 527 lacks flexibility, and as a result, it becomes more likely that a gap is formed at the boundary section 577 between the upper-seal supporting plate 527 and the end seal 574. On the contrary, making the upper-seal urging member 524 out of sponge, which is highly flexible, allows the extending section 524*b* to deform easily in accordance with the shape of the upper-seal supporting plate 527 etc., and as a result, a gap is further prevented from being formed between the boundary section 577 and the housing 540. The foregoing embodiment is therefore more preferable.

Further, in the foregoing embodiment, the second seal supporting member (the upper-seal supporting plate 527) supports the lateral-direction end 520*a* (FIG. 4) of the upper seal 520, and supports the upper-seal urging member 524 along the longitudinal direction thereof (FIG. 8). This, however, is not a limitation. For example, the second seal supporting member does not have to support the upper seal 520.

However, in cases where the upper seal 520 and the upper-seal urging member 524 are both supported by the same component member, i.e., the second seal supporting member, it is easy to stabilize the urging force of the upper-seal urging member 524 against the upper seal 520. Thus, the upper seal 520 abuts appropriately against the developing roller 510, thereby allowing the toner T to be prevented from spilling more effectively. The foregoing embodiment is therefore more preferable.

Second Embodiment

===(2) Overview of Image Forming Apparatus===

Figure 19:
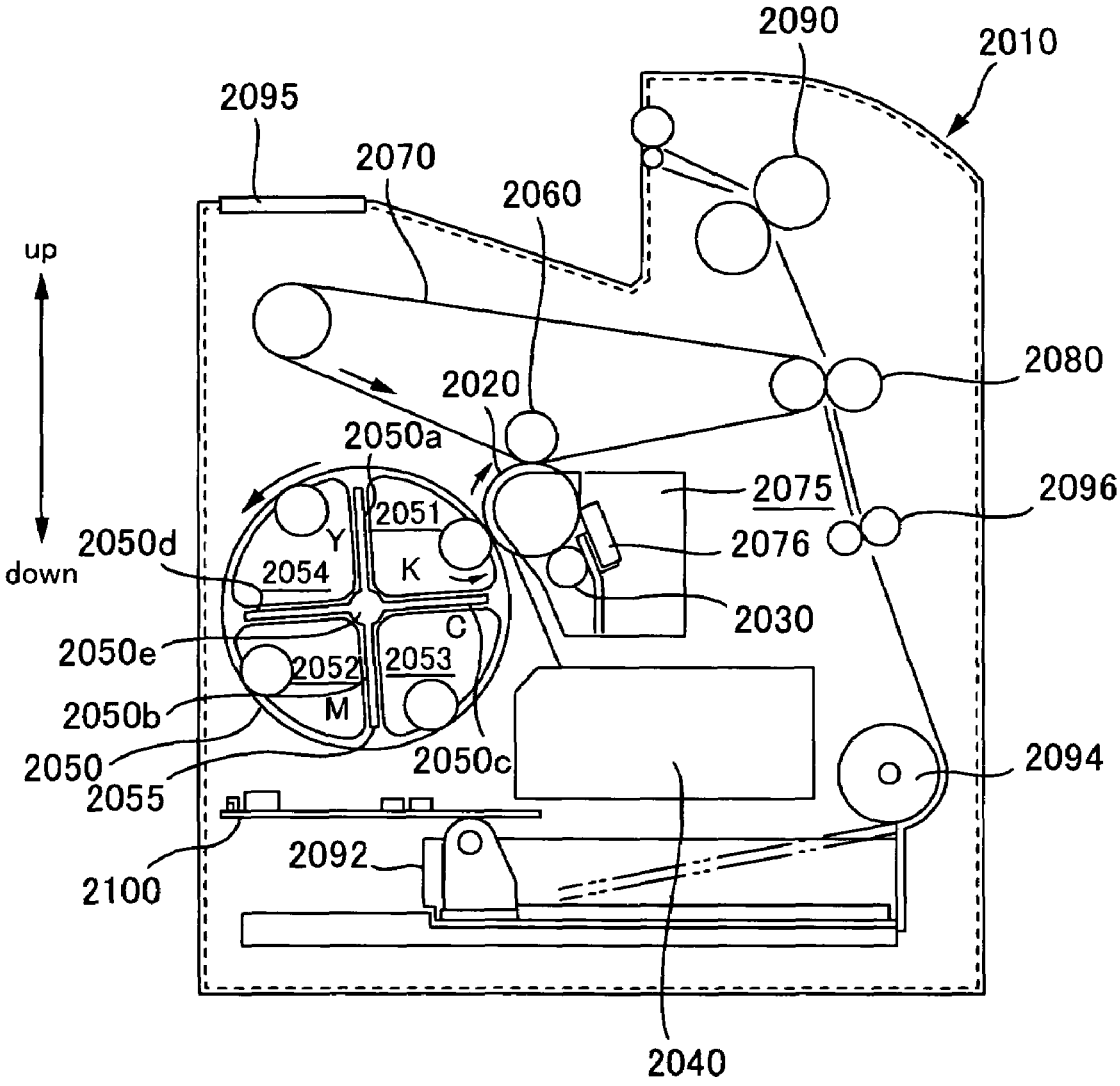
FIG. 19 is a diagram showing main structural components constructing a printer 2010.
Figure 20:
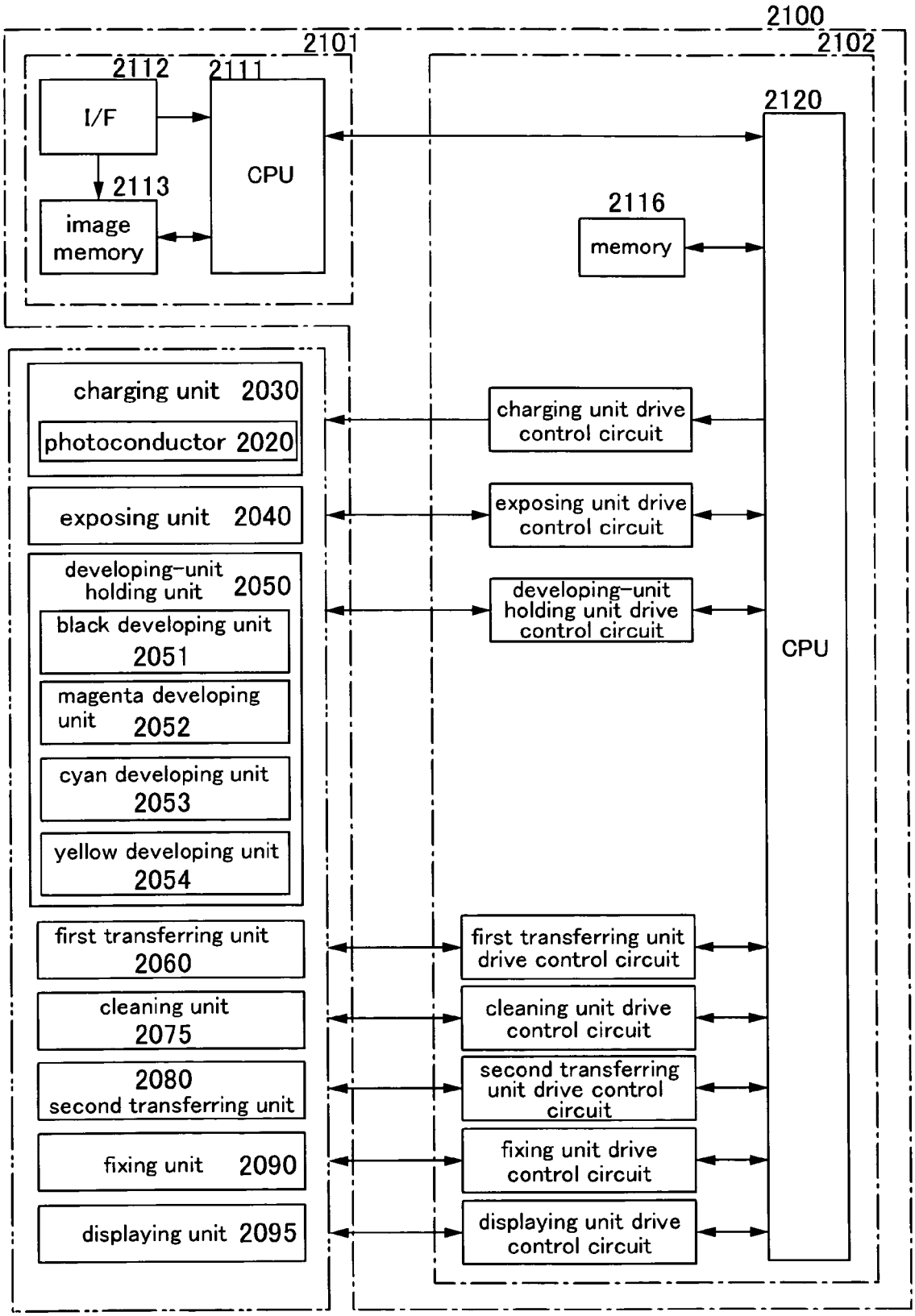
FIG. 20 is a diagram for describing a configuration of a control unit provided in the printer 2010.

With reference to FIG. 19 and FIG. 20, a configuration example and an operation example of an image forming apparatus, which forms images using a developing unit serving as a "developing device", will be described, taking a laser-beam printer 2010 (hereinafter referred to also as "printer") as an example. FIG. 19 is a diagram showing main structural components constructing the printer 2010. FIG. 20 is a diagram for describing a configuration of a control unit provided in the printer 2010. It should be noted that in FIG. 19, the vertical direction is shown by the arrow, and, for example, a paper supply tray 2092 is arranged at a lower section of the printer 2010, and a fixing unit 2090 is arranged at an upper section of the printer 2010.

<Configuration of Printer 2010>

As shown in FIG. 19, the printer 2010 according to the present embodiment is provided with a charging unit 2030, an exposing unit 2040, a developing-unit holding unit 2050, a first transferring unit 2060, an intermediate transferring body 2070, and a cleaning unit 2075. These components are arranged in the direction of rotation of a photoconductor 2020, which is an example of an "image bearing member" that bears latent images. The printer 2010 is further provided with a second transferring unit 2080, a fixing unit 2090, a displaying unit 2095 constructed of a liquid-crystal panel and serving as means for making notifications to a user, and a control unit 2100 for controlling these units etc. and managing the operations as a printer.

The photoconductor 2020 has a cylindrical electrically-conductive base and a photoconductive layer formed on the outer peripheral surface of the electrically-conductive base, and it is rotatable about its central axis. In the present embodiment, the photoconductor 2020 rotates clockwise, as shown by the arrow in FIG. 19.

The charging unit 2030 is a device for electrically charging the photoconductor 2020. The exposing unit 2040 is a device for forming a latent image on the charged photoconductor 2020 by radiating a laser beam thereon. The exposing unit 2040 has, for example, a semiconductor laser, a polygon mirror, and an F-θ lens, and radiates a modulated laser beam onto the charged photoconductor 2020 in accordance with image signals having been input from a not-shown host computer such as a personal computer or a word processor.

The developing-unit holding unit 2050 is a device for developing the latent image formed on the photoconductor 2020 using toner T, that is, black (K) toner contained in a black developing unit 2051, magenta (M) toner contained in a magenta developing unit 2052, cyan (C) toner contained in a cyan developing unit 2053, and yellow (Y) toner contained in a yellow developing unit 2054. The toner T is an example of a "developer" contained in each of the developing units 2051, 2052, 2053, and 2054, which are an example of a "developing device".

In the present embodiment, the developing-unit holding unit 2050 can move the positions of the four developing units 2051, 2052, 2053, and 2054 by rotating. More specifically, the developing-unit holding unit 2050 holds the four developing units 2051, 2052, 2053, and 2054 with four attach/detach sections 2050*a*, 2050*b*, 2050*c*, and 2050*d*. The four developing units 2051, 2052, 2053, and 2054 can be rotated about a central shaft 2050*e* while maintaining their relative positions. Each time the photoconductor 2020 makes one revolution, one of the four developing units 2051, 2052, 2053, and 2054 is made to selectively oppose the photoconductor 2020 to develop the latent image formed on the photoconductor 2020 using the toner contained in the developing unit 2051, 2052, 2053, or 2054 that is in opposition to the photoconductor. It should be noted that details on the developing units will be described further below.

The first transferring unit 2060 is a device for transferring, onto the intermediate transferring body 2070, a single-color toner image formed on the photoconductor 2020. When the toners of all four colors are successively transferred in a super imposing manner, a full-color toner image will be formed on the intermediate transferring body 2070. The intermediate transferring body 2070 is an endless belt, and is driven to rotate at substantially the same circumferential speed as the photoconductor 2020. The second transferring unit 2080 is a device for transferring the single-color toner image or the full-color toner image formed on the intermediate transferring body 2070 onto a recording medium such as paper, film, and cloth.

The fixing unit 2090 is a device for fusing the single-color toner image or the full-color toner image, which has been transferred onto the recording medium, to the recording medium such as paper to make it into a permanent image. The cleaning unit 2075 is a device that is provided between the first transferring unit 2060 and the charging unit 2030, that has a rubber cleaning blade 2076 made to abut against the surface of the photoconductor 2020, and that is for removing the toner T remaining on the photoconductor 2020 by scraping it off with the cleaning blade 2076 after the toner image has been transferred onto the intermediate transferring body 2070 by the first transferring unit 2060.

The control unit 2100 is provided with a main controller 2101 and a unit controller 2102 as shown in FIG. 20. Image signals are input to the main controller 2101, and according to instructions based on the image signals, the unit controller 2102 controls each of the above-mentioned units etc. to form an image.

The main controller 2101 is connected to a host computer via the interface 2112, and is provided with an image memory 2113 for storing the image signals that have been input from the host computer, a CPU 2111 that controls the entire printer 2010, and so forth.

The unit controller 2102 has a CPU 2120, a memory 2116 such as a RAM and a ROM, drive control circuits for driving and controlling the units in the body of the apparatus (i.e., the charging unit 2030, the exposing unit 2040, the first transferring unit 2060, the cleaning unit 2075, the second transferring unit 2080, the fixing unit 2090, and the displaying unit 2095) and the developing-unit holding unit 2050, and so forth, and it controls the units based on the signals that are input from the main controller 2101.

<Operation of Printer 2010>

Next, operations of the printer 2010 will be described with reference also to other structural elements.

First, when image signals are input from the not-shown host computer to the main controller 2101 of the printer 2010 through an interface (I/F) 2112, the photoconductor 2020, the developing roller 2510 provided in each developing unit 2051, 2052, 2053, 2054, and the intermediate transferring body 2070 rotate under the control of the unit controller 2102 based on the instructions from the main controller 2101. While being rotated, the photoconductor 2020 is charged by the charging unit 2030 at a charging position.

With the rotation of the photoconductor 2020, the charged area of the photoconductor 2020 reaches an exposing position. A latent image that corresponds to the image information about the first color, for example, yellow Y, is formed in that charged area by the exposing unit 2040. The developing-unit holding unit 2050 positions the yellow developing unit 2054, which contains yellow (Y) toner, at the developing position, which is in opposition to the photoconductor 2020.

With the rotation of the photoconductor 2020, the latent image formed on the photoconductor 2020 reaches the developing position, and is developed with the yellow toner by the yellow developing unit 2054. Thus, a yellow toner image is formed on the photoconductor 2020.

With the rotation of the photoconductor 2020, the yellow toner image formed on the photoconductor 2020 reaches a first transferring position, and is transferred onto the intermediate transferring body 2070 by the first transferring unit 2060. At this time, a first transferring voltage, which is in an opposite polarity from the polarity to which the toner has been charged, is applied to the first transferring unit 2060. It should be noted that, during this process, the second transferring unit 2080 is kept separated from the intermediate transferring body 2070.

By repeating the above-mentioned processes for the second, the third, and the fourth colors, toner images in four colors corresponding to the respective image signals are transferred onto the intermediate transferring body 2070 in a superimposed manner. As a result, a full-color toner image is formed on the intermediate transferring body 2070.

With the rotation of the intermediate transferring body 2070, the full-color toner image formed on the intermediate transferring body 2070 reaches a second transferring position, and is transferred onto a recording medium by the second transferring unit 2080. It should be noted that the recording medium is carried from the paper supply tray 2092 to the second transferring unit 2080 via the paper-feed roller 2094 and resisting rollers 2096. During transferring operations, a second transferring voltage is applied to the second transferring unit 2080 and also the unit 2080 is pressed against the intermediate transferring body 2070.

The full-color toner image transferred onto the recording medium is heated and pressurized by the fixing unit 2090 and fused to the recording medium. On the other hand, after the photoconductor 2020 passes the first transferring position, the toner remaining on the surface of the photoconductor 2020 is scraped off by the cleaning blade 2076, and the photoconductor 2020 is prepared for electrical charging for forming the next latent image. The scraped-off toner is collected in a waste-toner container.

===(2) Overview of Developing Unit===

Figure 21:
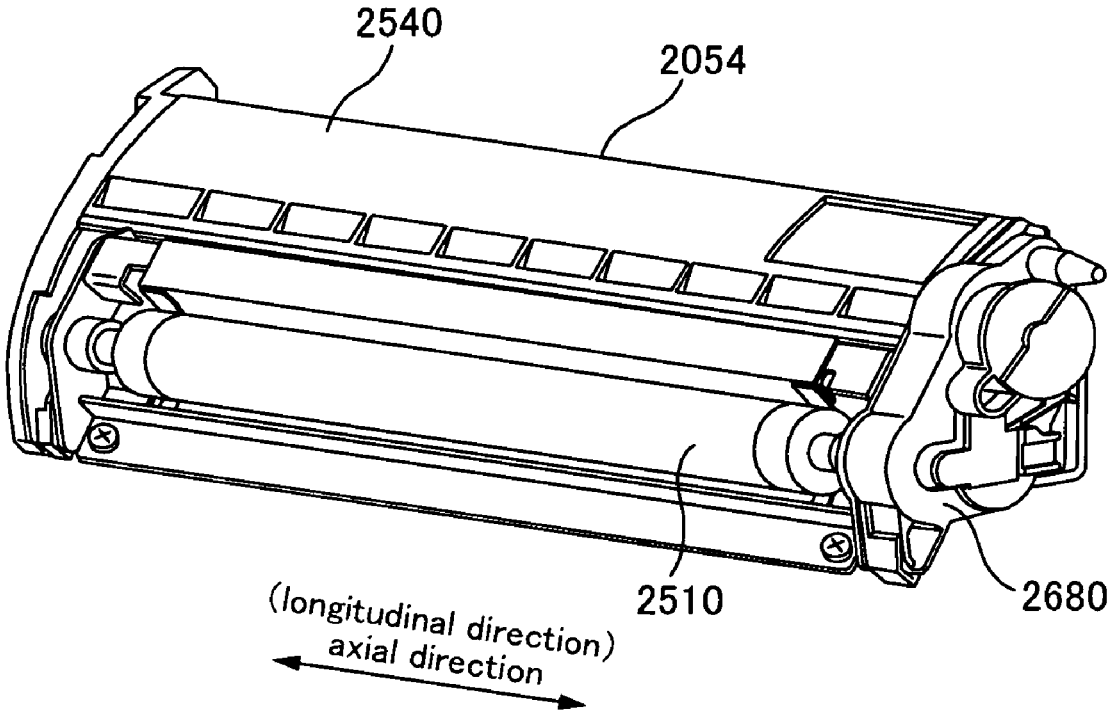
FIG. 21 is a perspective view of a developing unit.
Figure 22:
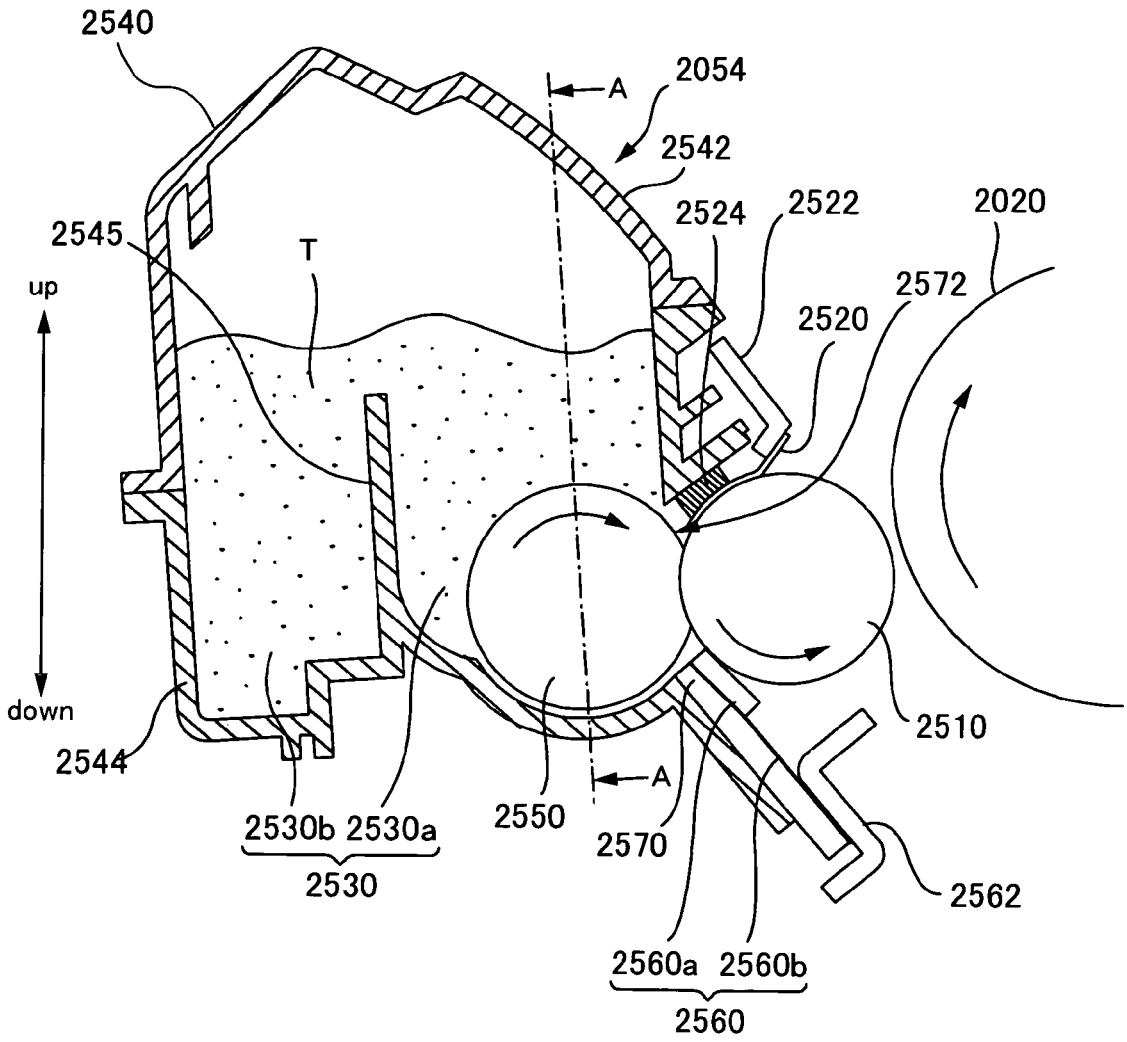
FIG. 22 is a section view showing main structural components of the developing unit.
Figure 23:
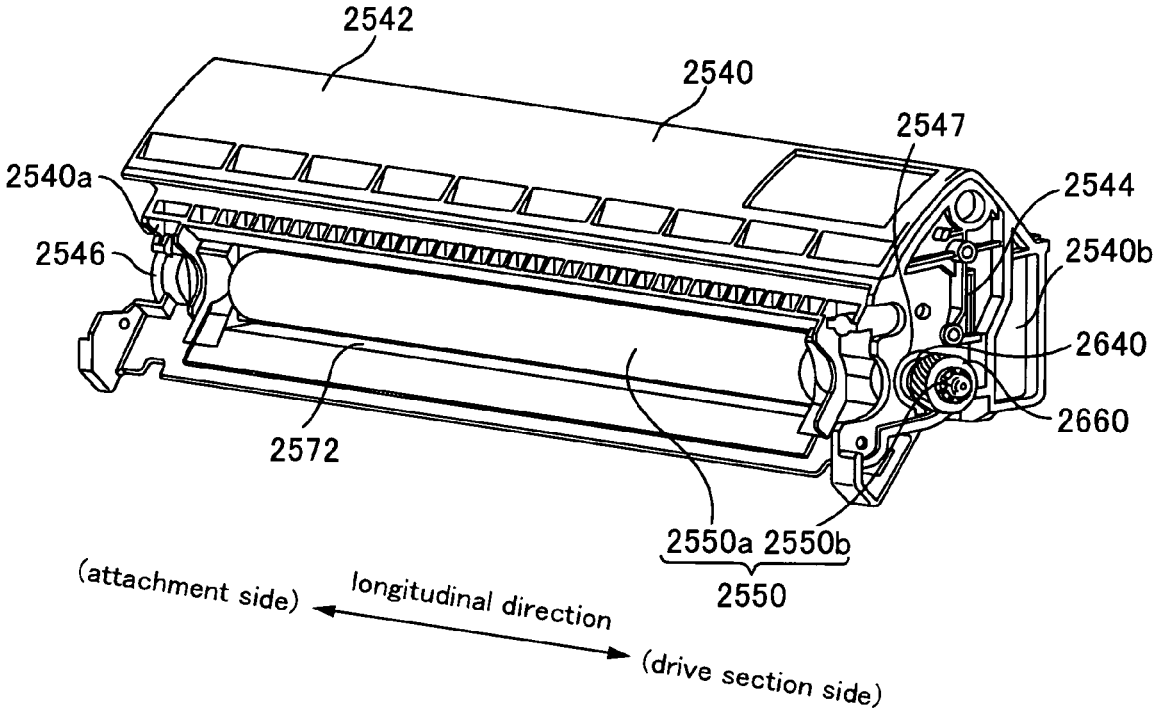
FIG. 23 is a perspective view showing how a toner supplying roller is attached to a housing.

Next, with reference to FIG. 21 through FIG. 23, a configuration example of the developing unit will be described. FIG. 21 is a perspective view of a developing unit. FIG. 22 is a section view showing main structural components of the developing unit. FIG. 23 is a perspective view showing how the toner supplying roller 2550 is attached to the housing 2540. It should be noted that the section view shown in FIG. 22 is a section of the developing unit bisected by a plane orthogonal to the longitudinal direction shown in FIG. 21. Further, in FIG. 22, the arrow indicates the vertical direction as in FIG. 19, and, for example, the central axis of the developing roller 2510 is located below the central axis of the photoconductor 2020. Further, in FIG. 22, the yellow developing unit 2054 is shown positioned at the developing position, which is in opposition to the photoconductor 2020.

The developing-unit holding unit 2050 is provided with: the black developing unit 2051 containing black (K) toner; the magenta developing unit 2052 containing magenta (M) toner; the cyan developing unit 2053 containing cyan (C) toner; and the yellow developing unit 2054 containing yellow (Y) toner. Since the configuration of each of the developing units is the same, description will be made only about the yellow developing unit 2054 below.

<Configuration of Yellow Developing Unit 2054>

The yellow developing unit 2054 has, for example: a housing 2540 which is an example of a "developer containing body" that contains the toner T; a toner supplying roller 2550 which is an example of a "developer supplying roller"; a developing roller 2510 which is an example of a "developer bearing member"; an upper seal 2520; and a restriction blade 2560.

The housing 2540 is manufactured by welding together an upper housing section 2542 and a lower housing section 2544 which are each integrally molded and made of resin. In the housing 2540 is formed a toner containing section 2530 for containing the toner T. The toner containing section 2530 is divided into two toner containing sections, namely, the first toner containing section 2530*a* and the second toner containing section 2530*b*, by a partitioning wall 2545 that is for partitioning the toner T and that protrudes inwards (in the up/down direction of FIG. 22) from the inner wall.

The first toner containing section 2530*a* and the second toner containing section 2530*b* are connected at their upper sections, and in the state shown in FIG. 22, movement of the toner T is restricted by the partitioning wall 2545. However, when the developing-unit holding unit 2050 is rotated, the toner contained in the first toner containing section 2530*a* and the second toner containing section 2530*b* is once gathered on the side of the section where the containing sections are connected, which is on the upper side when in the developing position, and when the developing-unit holding unit 2050 returns to the state shown in FIG. 22, the toner gets mixed and is returned to the first toner containing section 2530*a* and the second toner containing section 2530*b*. In other words, the toner T is stirred within the developing unit by the rotation of the developing-unit holding unit 2050. Therefore, in the present embodiment, no stirring member is provided in the toner containing section 2530. However, it is possible to provide a stirring member for stirring the toner T contained in the toner containing section 2530. As shown in FIG. 22, the housing 2540 has an opening 2572 in its lower section, and the developing roller 2510 described below is provided facing the opening 2572.

It should be noted that the housing 2540 has fitting holes 2546 and 2547 respectively provided in side walls 2540*a* and 2540*b* located on both ends in the longitudinal direction of the housing 2540. When the developing unit 2054 is attached to the printer 2010, a first bearing 2640 is fitted into the fitting hole 2547 of the side wall 2540*b* located on the inner side (farther side) of the printer 2010, and a second bearing 2620 is fitted into the fitting hole 2546 of the side wall 2540*a* located on the frontward side of the printer 2010. With these first bearing 2640 and second bearing 2620, the toner supplying roller 2550 is supported in a rotatable manner. The fitting hole 2546 of the side wall 2540*a* located on the frontward side of the printer 2010 is formed to have substantially the same size as the diameter of a roller section 2550*a* of the toner supplying roller 2550, because the fitting hole 2546 serves as an insertion port when the toner supplying roller 2550 is placed into the housing 2540. Therefore, the fitting hole 2546 on the frontward side is formed larger than the fitting hole 2547 on the farther side. On the drive-section side, a seal member 2650 is interposed between the housing 2540 and a shaft element 2550*b* of the toner supplying roller 2550 on the inner side of the first bearing 2640. On the attachment side, a seal member 2650 is interposed between the second bearing 2620 and the shaft element 2550*b*, and a seal member 2630 is interposed between the second bearing 2620 and the housing 2540.

The toner supplying roller 2550 has a roller section 2550*a* formed, for example, using urethane foam having elasticity, and a shaft element 2550*b* that is arranged in the center of rotation of the roller section 2550*a*, that passes through the roller section 2550*a*, and that protrudes from both ends of the roller section 2550*a* in both directions. The toner supplying roller 2550 is rotatably supported about its shaft element 2550*b* by being supported on the housing 2540 via the first bearing 2640 and the second bearing 2620 at both end sides of the shaft element 2550*b*. The shaft element 2550*b* of the toner supplying roller 2550 extends beyond the first bearing 2640 toward the farther side in the attaching direction when the developing unit 2054 is being attached to the printer 2010, and a gear 2660 that transmits a motive power for driving the toner supplying roller 2550 is provide on the extended portion. The gear 2660 is fixed to the shaft element 2550*b* by a pin 2670 that is inserted through a pin hole 2550*c* provided in the shaft element 2550*b*. The way and structure according to which the shaft element 2550*b* and the gear 2660 are fixed will be described further below.

The roller section 2550*a* is accommodated in the above-described first toner containing section 2530*a* of the housing 2540 (inside the housing 2540) and supplies the toner T contained in the first toner containing section 2530*a* to the developing roller 2510. The toner supplying roller 2550 is arranged at a lower section, in the vertical direction, of the first toner containing section 2530*a*. The toner T contained in the first toner containing section 2530*a* is supplied to the developing roller 2510 by the toner supplying roller 2550 at the lower section of the first toner containing section 2530*a*. The toner supplying roller 2550 also strips off, from the developing roller 2510, extra toner T remaining on the developing roller 2510 after development.

The toner supplying roller 2550 and the developing roller 2510 are assembled to the housing 2540 in a state where both rollers are pressed against each other. Therefore, the roller section 2550*a* of the toner supplying roller 2550 abuts against the developing roller 2510 in an elastically-deformed state. Further, the toner supplying roller 2550 rotates in the opposite direction (clockwise in FIG. 22) to the rotating direction of the developing roller 2510 (counterclockwise in FIG. 22). The shaft element 2550*b* is located at a position lower than the central axis of rotation of the developing roller 2510.

The developing roller 2510 bears toner T and delivers it to the developing position opposing the photoconductor 2020. The developing roller 2510 is made of metal and manufactured from, for example, aluminum alloy such as aluminum alloy 5056 or aluminum alloy 6063, or iron alloy such as STKM, and where necessary, the roller 2510 is plated with, for example, nickel plating or chromium plating.

Further, as shown in FIG. 21, the developing roller 2510 is supported at both ends in its longitudinal direction, and is rotatable about its central axis. As shown in FIG. 22, the developing roller 2510 rotates in the opposite direction (counterclockwise in FIG. 22) to the rotating direction of the photoconductor 2020 (clockwise in FIG. 22). The central axis of the roller 2510 is located below the central axis of the photoconductor 2020.

Further, as shown in FIG. 22, in a state where the yellow developing unit 2054 is in opposition to the photoconductor 2020, there is a gap between the developing roller 2510 and the photoconductor 2020. That is, the yellow developing unit 2054 develops the latent image formed on the photoconductor 2020 in a non-contacting state. It should be noted that an alternating field is generated between the developing roller 2510 and the photoconductor 2020 upon development of the latent image formed on the photoconductor 2020.

The upper seal 2520 prevents the toner T in the yellow developing unit 2054 from spilling out therefrom, and also collects the toner T on the developing roller 2510 that has passed the developing position into the developing unit without scraping the toner off. The upper seal 2520 is a seal made, for example, of polyethylene film. The upper seal 2520 is supported by a seal-supporting metal plate 2522 and is attached to the housing 2540 via the seal-supporting metal plate 2522. Further, a seal urging member 2524 made, for example, of Moltoprene, is provided on one side of the upper seal 2520 opposite from the side of the developing roller 2510, and the upper seal 2520 is pressed against the developing roller 2510 by the elastic force of the seal urging member 2524. It should be noted that the abutting position where the upper seal 2520 abuts against the developing roller 2510 is above the central axis of the developing roller 2510.

The restriction blade 2560 gives an electric charge to the toner T borne by the developing roller 2510, and also restricts the thickness of the layer of the toner T borne by the developing roller 2510. The restriction blade 2560 includes a rubber section 2560*a* and a rubber-supporting section 2560*b*. The rubber section 2560*a* is made of, for example, silicone rubber or urethane rubber. The rubber-supporting section 2560*b* is a thin plate that is made of, for example, phosphor bronze or stainless steel, and that has a spring-like characteristic. The rubber section 2560*a* is supported by the rubber-supporting section 2560*b*. The rubber-supporting section 2560*b* is attached to the housing 2540 via blade-supporting metal plates 2562 in a state where one end of the rubber-supporting section 2560*b* is pinched between the pair of blade-supporting metal plates 2562. Further, a blade-backing member 2570 made, for example, of Moltoprene, is provided on one side of the restriction blade 2560 opposite from the side of the developing roller 2510.

The rubber section 2560*a* is pressed against the developing roller 2510 by the elastic force resulting from bending of the rubber-supporting section 2560*b*. The blade-backing member 2570 prevents the toner T from entering between the rubber-supporting section 2560*b* and the housing 2540 and stabilizes the elastic force resulting from the bending of the rubber-supporting section 2560*b*. The blade-backing member 2570 also presses the rubber section 2560*a* against the developing roller 2510 by urging the rubber section 2560*a* from the back side thereof toward the developing roller 2510. In this way, the blade-backing member 2570 makes the rubber section 2560*a* abut against the developing roller 2510 more evenly.

The end of the restricting blade 2560 opposite from the end that is being supported by the blade-supporting metal plates 2562, i.e., the tip end of the restriction blade 2560, is not placed in contact with the developing roller 2510; rather, a section at a predetermined distance away from the tip end contacts, with some breadth, the developing roller 2510. That is, the restriction blade 2560 does not abut against the developing roller 2510 at its edge, but abuts against the roller 2510 near its central portion. Further, the restriction blade 2560 is arranged so that its tip end faces toward the upstream side of the rotating direction of the developing roller 2510, and thus, makes a so-called counter-abutment with respect to the roller 2510. It should be noted that the abutting position at which the restriction blade 2560 abuts against the developing roller 2510 is below the central axis of the developing roller 2510 and is also below the central axis of the toner supplying roller 2550.

<Operation of Yellow Developing Unit 2054>

In the yellow developing unit 2054 structured as above, the toner supplying roller 2550 supplies the toner T contained in the toner containing section 2530 to the developing roller 2510. With the rotation of the developing roller 2510, the toner T, which has been supplied to the developing roller 2510, reaches the abutting position of the restriction blade 2560; then, as the toner T passes the abutting position, the toner is electrically charged and its layer thickness is restricted.

With further rotation of the developing roller 2510, the toner T on the developing roller 2510, which has been electrically charged, reaches the developing position opposing the photoconductor 2020; then, under the alternating field, the toner T is used at the developing position for developing the latent image formed on the photoconductor 2020. With further rotation of the developing roller 2510, the toner T on the developing roller 2510, which has passed the developing position, passes the upper seal 2520 and is collected into the developing unit by the upper seal 2520 without being scraped off. Further, the toner T that still remains on the developing roller 2510 can be stripped off by the toner supplying roller 2550.

===(2) Structure for Fixing Toner Supplying Roller and Gear===

Figure 24:
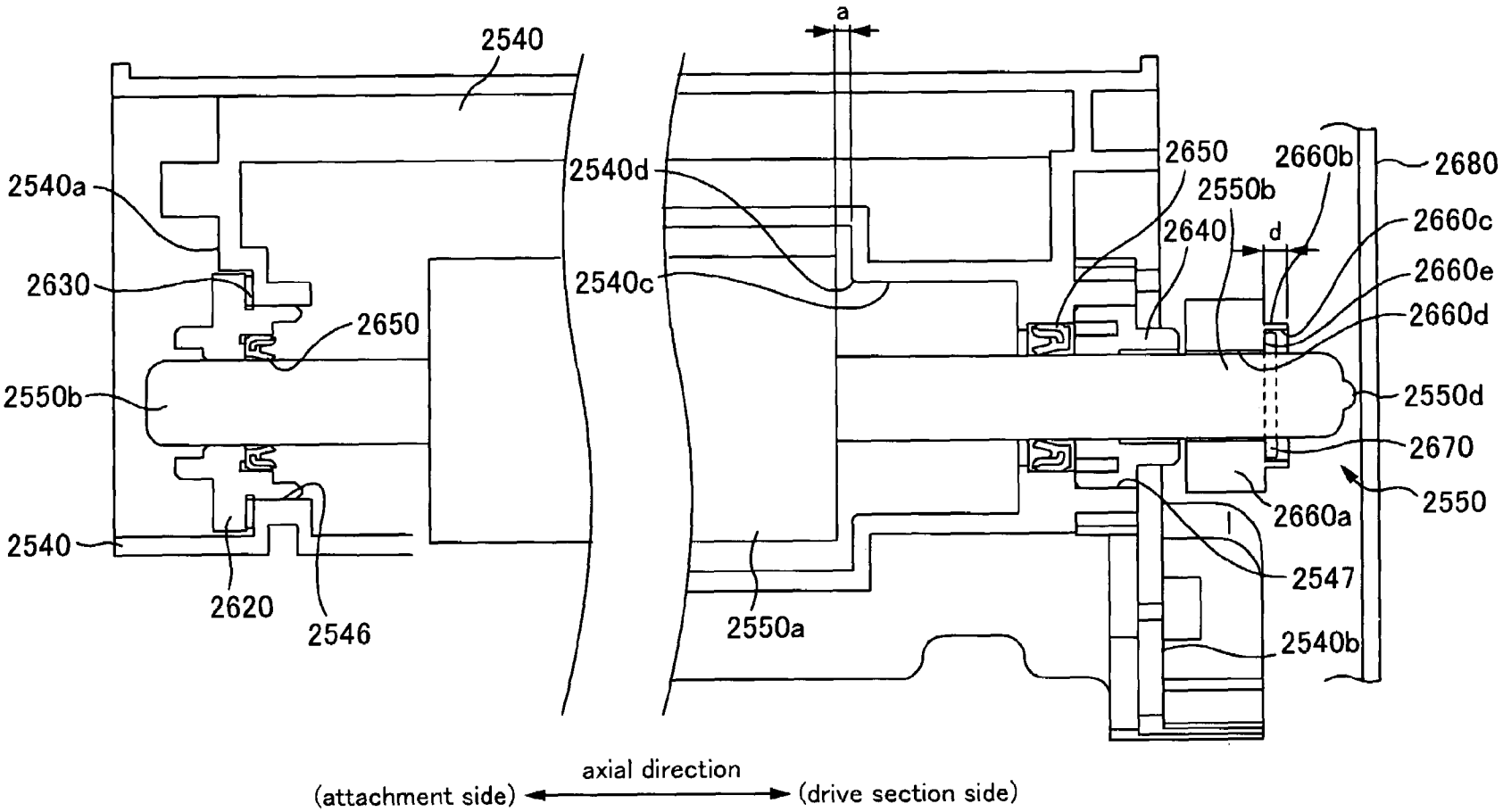
FIG. 24 is a sectional view taken along line A-A of FIG. 22.
Figure 25:
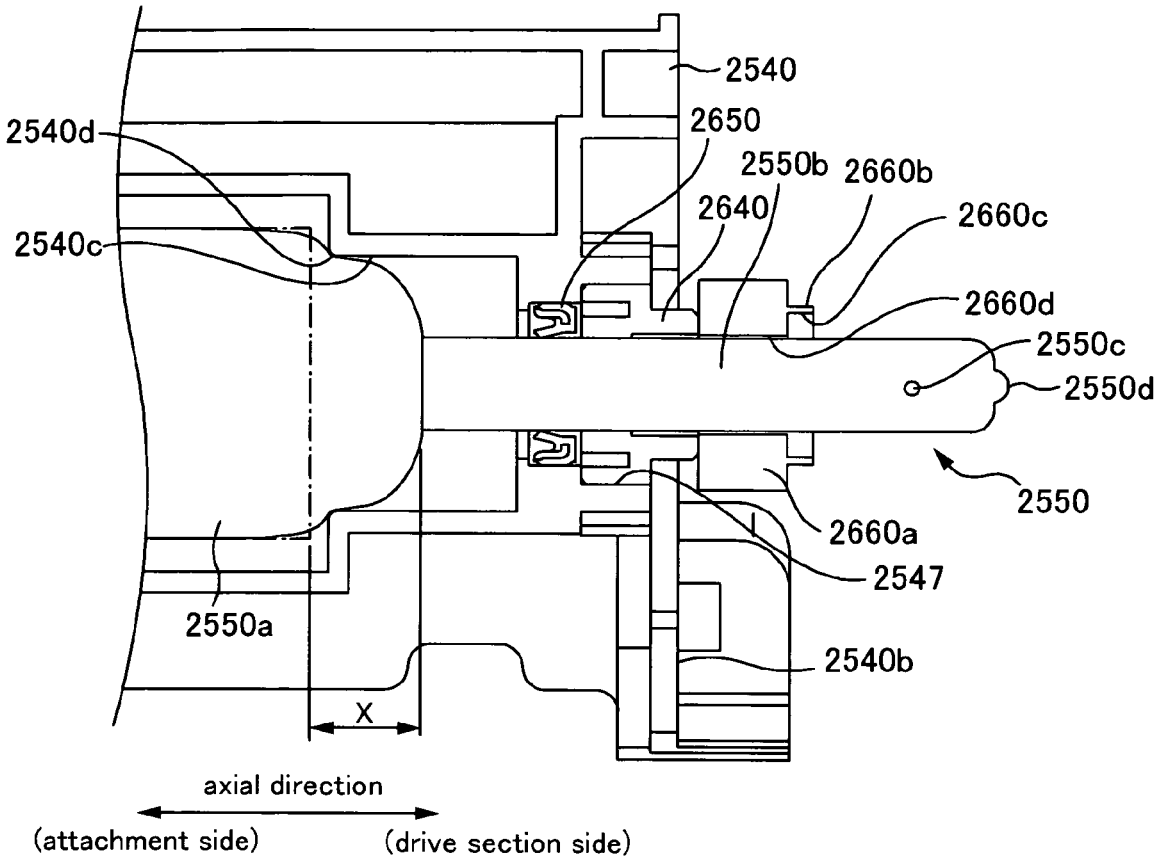
FIG. 25 is a diagram showing a state in which the toner supplying roller is moved in the axial direction by elastically deforming the roller section.

FIG. 24 is a sectional view taken along line A-A of FIG. 22. FIG. 25 is a diagram showing a state in which the toner supplying roller is moved in the axial direction by elastically deforming the roller section. FIG. 24 shows a state in which the toner supplying roller 2550 has been assembled to the housing 2540, and FIG. 24 will be used to describe the structure of how the toner supplying roller 2550 is assembled to the housing 2540. The side on the left in FIG. 24 is the frontward side in the attachment direction when the developing unit 2054 is being attached to the printer 2010, and the side on the right is the inner side (farther side). When the developing unit 2054 is attached to the printer 2010, a gear of the drive section of the printer 2010 provided on the farther side, and the gear 2660 fixed to the toner supplying roller 2550 mesh with one another. Below, the frontward side, when the developing unit is attached, is referred to as the "attachment side", and the farther side is referred to as the "drive-section side".

As shown in FIG. 24, in a state where the roller section 2550*a* is accommodated inside the toner containing section 2530 of the housing 2540, the shaft element 2550*b* of the toner supplying roller 2550, which protrudes from both ends of the roller section 2550*a* in the axial direction, is supported by the side walls 2540*a* and 2540*b* of the housing 2540, which constitutes the toner containing section 2530, via the bearings 2620 and 2640. More specifically, the shaft element 2550*b* of the toner supplying roller 2550 projects out from the toner containing section 2530 through the side walls 2540*a* and 2540*b* of the housing 2540 and projects outside the toner containing section 2530. The portion of the shaft element 2550*b* projecting on the attachment side is set to have a length such that the shaft element 2550*b* does not project beyond the outer shape of the housing 2540. The portion of the shaft element 2550*b* on the drive-section side has a length that allows for the gear 2660 to be fixed on the outer side of the side wall 2540*b* of the housing 2540, and has a pin hole 2550*c* through which the pin 2670 for fixing the gear 2660 and the shaft element 2550*b* is inserted.

The gear 2660 provided on the toner supplying roller 2550 transmits a motive power to the toner supplying roller 2550, and is configured to mesh with a gear (not shown) of the developing roller 2510 against which the roller 2550 is pressed, so as to make the developing roller 2510 rotate in the opposite direction from the toner supplying roller 2550. As shown in FIG. 22, the developing roller 2510 and the toner supplying roller 2550 are pressed against one another to an extent that the toner supplying roller 2550 is elastically deformed. Therefore, the rollers 2510 and 2550 incur a large load when they are rotated, and thus a large drive force becomes necessary. Therefore, helical gears are used as the gears provided on the developing roller 2510 and the toner supplying roller 2550. A helical gear receives a force that causes the roller 2510, 2550 to move in either directions of the axial direction depending on the direction in which the gear rotates and the direction of skew of the gear teeth. The teeth of the helical gears provided on the developing roller 2510 and the toner supplying roller 2550 are therefore formed such that a force exerted in a direction that attempts to cause the rollers 2510 and 2550 to move toward the farther side (drive-section side) of the printer 2010, is applied to the rollers 2510 and 2550. In order to prevent the developing roller 2510 and the toner supplying roller 2550 from moving in the axial direction as a result of the rotation of the helical gears, a cover 2680, which is an example of a "movement-restricting member" for restricting the movement of the rollers 2510 and 2550 in the axial direction, is fixed to the side wall 2540*b* of the housing 2540 on the drive-section side. The cover 2680 covers the helical gears, and the ends of the developing roller 2510 and the shaft element 2550*b* of the toner supplying roller 2550 abut against this cover 2680. The ends of the developing roller 2510 and the toner supplying roller 2550 that abut against this cover 2680 each has, on its tip, a hemispherical projecting section 2550*d*, to make the area of contact between the cover 2680 and the ends small.

The gear 2660 fixed to the toner supplying roller 2550 has a gear section 2660*a* in which the helical gear teeth are formed, and a fixing section 2660*b* whose outer diameter is smaller than that of the tip of the teeth and that is formed in a step-like shape. The fixing section 2660*b* has a pin-accommodating section 2660*c* in which the pin 2670, which is inserted through the pin hole 2550*c* of the toner supplying roller 2550, is accommodated in a state where the pin has been inserted. More specifically, the gear 2660 is provided with a through hole 2660*d* through which the shaft element 2550*b* of the toner supplying roller 2550 is passed, and the pin-accommodating section 2660*c* that is opened to the outside of the gear 2660 for accommodating the pin 2670, which has been inserted into the pin hole 2550*c* of the toner supplying roller 2550, into the gear 2660 when the toner supplying roller 2550 and the gear 2660 are relatively moved in the axial direction. The pin-accommodating section 2660*c* is a groove-like recess that passes the center of the gear 2660 and that is formed along a predetermined direction orthogonal to the shaft element 2550*b*. The width of the pin-accommodating section 2660*c* is slightly wider than the diameter of the pin 2670. Therefore, when the toner supplying roller 2550 is rotated in a state where the pin 2670 is accommodated in the pin-accommodating section 2660*c*, which is achieved by relatively moving, in the axial direction, the gear 2660 and the shaft element 2550*b* having the pin 2670 inserted through its pin hole 2550*c*, the pin 2670 abuts against the inner walls of the pin-accommodating section 2660*c* and thereby restricts relative movement of the gear 2660 and the shaft element 2550*b* in the rotating direction. As a result, the shaft element 2550*b*, and thus the toner supplying roller 2550, rotates in conjunction with the gear 2660. The pin-accommodating section 2660*c* of the fixing section 2660*b* is formed opened toward the outside on the side opposite from the side of the gear section 2660*a*. Therefore, the gear 2660 allows the pin 2670 to relatively move in the axial direction in a direction moving away from the gear section 2660*a*, but restricts the pin 2670 from relatively moving in a direction toward the gear section 2660*a* due to the pin 2670 abutting against the bottom 2660*e* of the pin-accommodating section 2660*c*.

In other words, the toner supplying roller 2550 is restricted from moving in the axial direction in the direction toward the drive-section side by the cover 2680, and the gear 2660 is restricted from moving in the direction toward the attachment side by the first bearing 2640 which is positioned by being fitted into the housing 2540. Therefore, the toner supplying roller 2550, in which relative movement of the gear 2660 and the shaft element 2550*b* toward the attachment side in the axial direction is restricted from by the pin 2670, is positioned at a position where the gear 2660 and the first bearing 2640 abut against one another. In this "positioned state", or in a state in which the toner supplying roller 2550 is supported by the housing 2540 in order to supply toner, a slight gap is provided in the axial direction between the housing 2540 and the roller section 2550*a* of the toner supplying roller 2550 such that the roller section 2550*a* does not come into contact with the inside of the housing 2540. Further, in a state where the toner supplying roller 2550 is supported by the housing 2540, the pin hole 2550*c* formed in the shaft element 2550*b* of the toner supplying roller 2550 is covered by the gear 2660, and the pin 2670 inserted through this pin hole 2550*c* is positioned inside the gear 2660.

The developing unit 2054 of the present embodiment is configured such that the distance "a" of the gap in the axial direction between the housing 2540 and the roller section 2550*a* in a state where the toner supplying roller 2550 is supported by the housing 2540 is shorter than the length "d" of the pin-accommodating section 2660*c* in the axial direction, and the distance "x" for which the toner supplying roller 2550 can be moved due to the toner supplying roller 2550 being moved in the axial direction and the roller section 2550*a* being elastically deformed by the housing 2540 interfering therewith is longer than the length "d" of the pin-accommodating section 2660*c* in the axial direction. In this way, the pin 2670 will not come out from nor fall out of the pin-accommodating section 2660*c* in cases where the toner supplying roller 2550 is moved in the axial direction inside the housing 2540 when the roller section 2550*a* is not elastically deformed, but in cases where the toner supplying roller 2550 is moved in the axial direction up to an extent that the roller section 2550*a* is elastically deformed, the pin hole 2550*c* can easily be exposed outside the gear 2660. Therefore, it is possible to easily assemble the gear 2660 to the shaft element 2550*b*.

The pin-accommodating section 2660*c* is formed in the fixing section 2660*b*, which is provided separately from the gear section 2660*a*, for the following reason. Since there is a possibility that, by providing the pin-accommodating section 2660*c*, the precision will drop when forming the gear 2660, a fixing section is provided separately from the gear section 2660*a* in order to secure gear precision.

Incidentally, as shown in FIG. 22, the toner supplying roller 2550 and the developing roller 2510 are pressed against one another via the opening 2572 provided in the housing 2540, and are each supported by the housing 2540. Further, the length, in the axial direction, of the roller section 2550*a* of the toner supplying roller 2550 is formed shorter than that of the roller section of the developing roller 2510. Further, the seal-supporting metal plate 2522, which is for fixing, to the housing as a single unit, the restriction blade 2560 and the upper seal 2520 provided to prevent the toner from spilling from the opening 2572, fits into the inner sides of the side walls 2540*a* and 2540*b* of the housing 2540. Therefore, a space is formed between the roller section 2550*a* of the toner supplying roller 2550 and the first bearing 2640 that is fitted into the side wall 2540*b* of the housing 2540. In the developing unit 2054 of the present embodiment, the housing 2540 is configured such that a gap 2540*c* which is smaller than the diameter of the roller section 2550*a* is formed in the space between the roller section 2550*a* and the first bearing 2640 on the drive-section side in the axial direction. Therefore, the housing 2540 will interfere with the roller section 2550*a* when the roller section 2550*a* is moved more toward the drive-section side in the axial direction than the intended assembly position of the toner supplying roller 2550, that is, the position at which the toner supplying roller 2550 is supported by the housing 2540 and positioned in order to supply the toner. Then, when the toner supplying roller 2550 is moved further toward the drive-section side, the portion of the roller section 2550*a* with which the housing 2540 interferes is elastically deformed, and in this way, a portion of the roller section 2550*a* is squeezed into the gap 2540*c* so that the shaft element 2550*b* can protrude to a further extent toward the outside of the housing 2540. Hereinafter, the portion of the housing 2540 that interferes with the roller section 2550*a* when the toner supplying roller 2550 is moved toward the drive-section side in the axial direction is referred to as the "interfering section 2540*d*". By chamfering the interfering section 2540*d* using "R-chamfering" (making the corner round) or "C-chamfering" (cutting off the corner along a plane at a predetermined angle), it becomes possible to prevent the roller section 2550*a* from getting damaged when making the roller section 2550*a* abut against the interfering section 2540*d*.

===(2) How to Assemble Toner Supplying Roller to Housing===

Figure 26A:
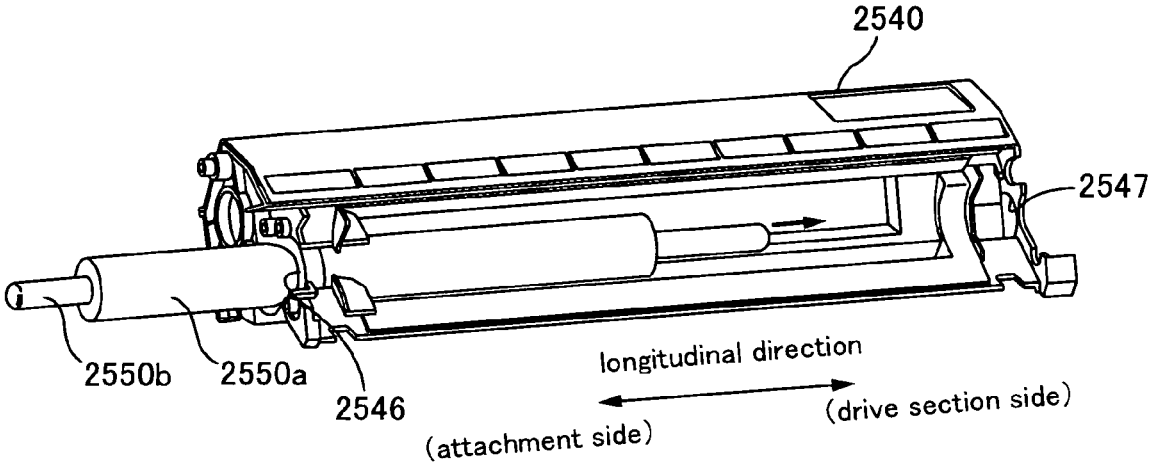
FIG. 26A is a diagram showing a state in which the toner supplying roller is being inserted into the housing.
Figure 26B:
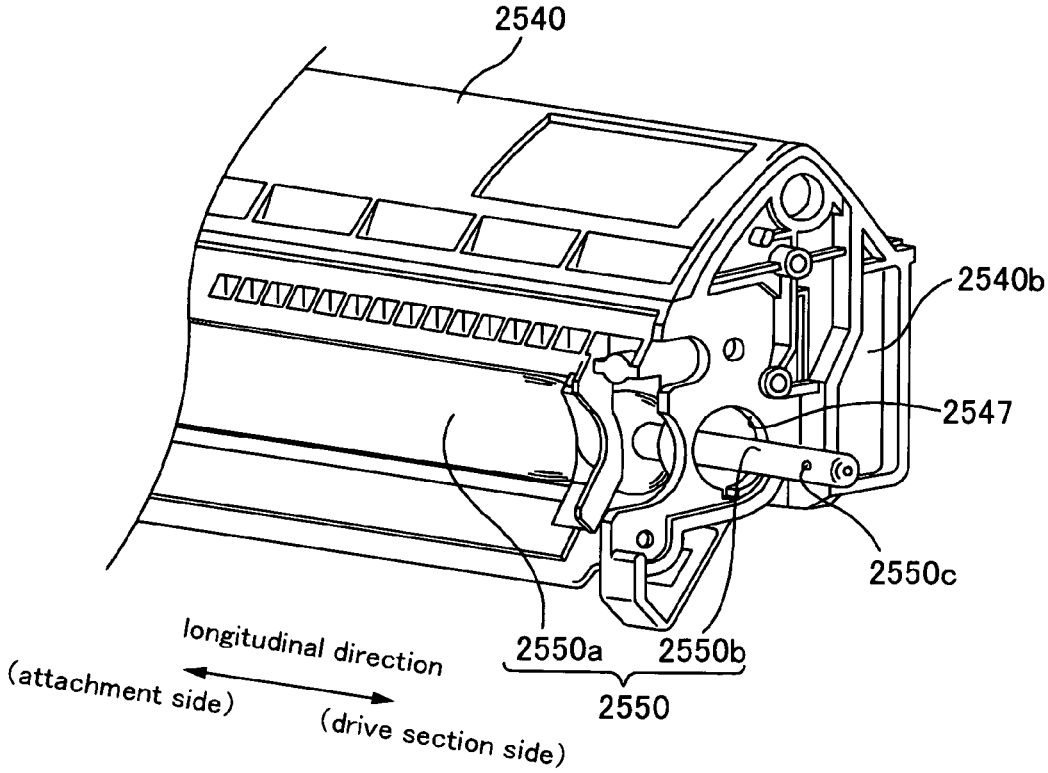
FIG. 26B is a diagram showing a state in which the shaft element is projected to a further extent by making the roller section deform elastically.
Figure 26C:
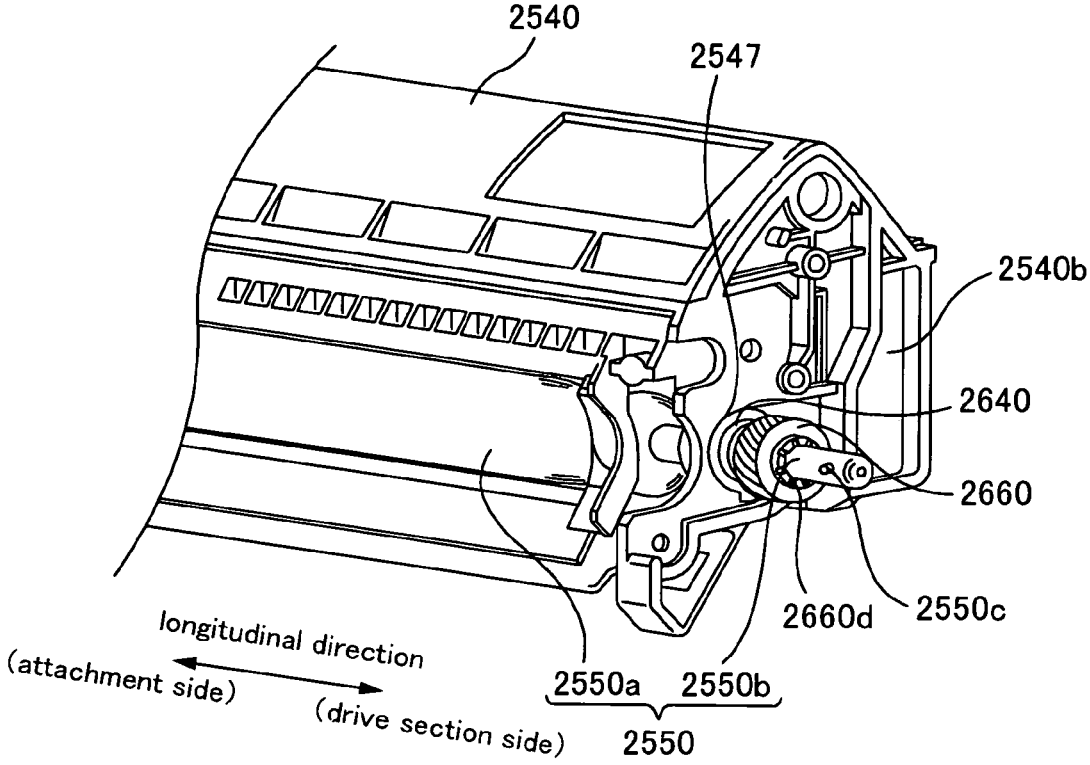
FIG. 26C is a diagram showing a state in which the bearing and the gear have been mounted on the shaft element.
Figure 26D:
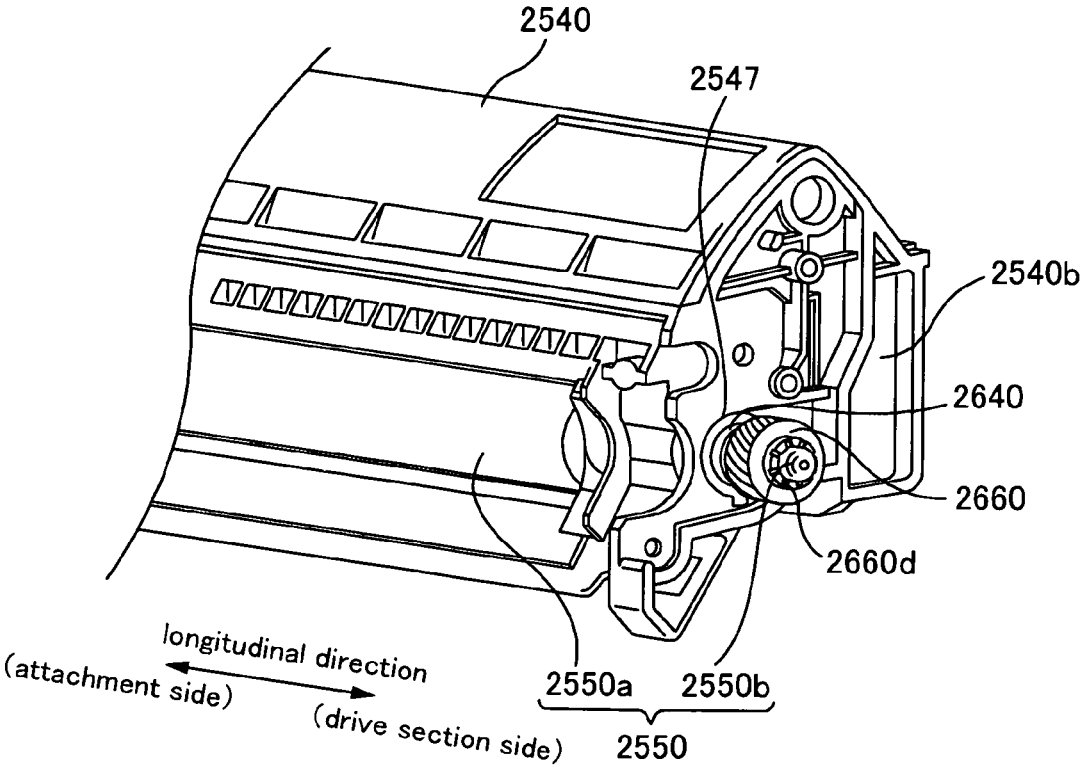
FIG. 26D is diagram showing a state in which the toner supplying roller is supported by the housing.

FIG. 26A is a diagram showing a state in which the toner supplying roller is being inserted into the housing, FIG. 26B is a diagram showing a state in which the shaft element is projected to a further extent by making the roller section deform elastically, FIG. 26C is a diagram showing a state in which the bearing and the gear have been mounted on the shaft element, and FIG. 26D is diagram showing a state in which the toner supplying roller is supported by the housing.

Assembly of the toner supplying roller 2550 to the housing 2540 is achieved by first inserting the toner supplying roller 2550 into the housing 2540 through the fitting hole 2546 of the housing 2540 to which the seal-supporting metal plate 2522, which supports the upper seal 2520, the restriction blade 2560, etc., has been assembled. Here, the fitting hole 2546 is formed in the side wall 2540*a* positioned on the attachment side of the printer 2010 (see FIG. 26A).

Then, the shaft element 2550*b* is made to sufficiently project to the outside of the housing 2540 by making a portion of the shaft element 2550*b* on the drive-section side project from the fitting hole 2547 of the side wall 2540*b* of the housing 2540, which is positioned on the drive-section side, moving the inserted toner supplying roller 2550 toward the drive-section side to make the roller section 2550*a* abut against the interfering section 2540*d* of the housing 2540, and moving the roller section 2550*a* toward the drive-section side while elastically deforming the roller section 2550*a* (see FIG. 26B).

Next, the shaft element 2550*b*, which has been projected toward the drive-section side of the developing unit 2054, is inserted through the first bearing 2640, and the first bearing 2640 is fitted into the fitting hole 2547 on the drive-section side. Then, the gear 2660 is mounted, from the side of the gear section 2660*a*, onto the shaft element 2550*b* which has been projected toward the drive-section side, and the gear 2660 is moved toward the bearing such that the pin hole 2550*c* provided in the shaft element 2550*b* is exposed outside the gear 2660 (see FIG. 26C).

Next, the pin 2670 is inserted through the pin hole 2550*c*, which is exposed outside the gear 2660. Then, after the pin 2670 inserted in the pin hole 2550*c* is accommodated in the pin-accommodating section 2660*c* of the gear 2660, the toner supplying roller 2550 is moved toward the attachment side until the roller section 2550*a* separates from the interfering section 2540*d*. Then, the second bearing 2620 is fitted into the fitting hole 2546 on the attachment side, so that the toner supplying roller 2550 is rotatably supported by the housing 2540 via the first bearing 2640 and the second bearing 2620 (see FIG. 26D). At this stage, the movement of the toner supplying roller in the direction toward the attachment side is restricted.

Finally, the cover 2680 is attached to the side wall 2540*b* of the housing 2540 on the drive-section side, and thus, movement of the toner supplying roller 2550 in the direction toward the drive-section side is restricted.

According to the developing unit 2054 of the present embodiment, in a state here the toner supplying roller 2550 has been assembled to the housing 2540, the shaft element 2550*b* of the toner supplying roller 2550 does not protrude largely toward the outside of the housing 2540, and therefore, the size of the developing unit 2054 can be made more compact. For example, in a device in which, when fixing the gear to the shaft etc. with a pin, (1) the gear mounted on the shaft is first moved to a retracted position to expose the pin hole for insertion of the pin into the pin hole, (2) the gear is again moved, this time from the retracted position in a direction toward the pin, so that the pin is accommodated inside the pin-accommodating section provided in the gear, and (3) a restriction member, such as an E-shaped retaining ring, is fitted onto the shaft on one side of the gear opposite from the side of the pin-accommodating section of the gear, it is necessary to move the gear between the retracted position and the fixing position in a state where the shaft is inserted through the gear. Therefore, it is necessary to provide a retracted position just to assemble the gear to the shaft, even though it is only necessary to provide a space for the fixing position if it were only for the purpose of fixing the gear. As a result, the shaft has to be made longer in order to provide the retracted position, and the size of the developing unit becomes inevitably large. Further, if an E-shaped retaining ring, for example, is to be used for restricting the movement of the gear in the axial direction, then it would be necessary to form, in the shaft, a groove for fitting the E-shaped retaining ring into the shaft. This would increase the number of steps for machining the shaft as well as increase the number of steps for assembling the E-shaped retaining ring, which leads to increase in costs. On the other hand, the structure of the developing unit and the method of assembling the toner supplying roller as describe in the foregoing embodiment are outstanding, in which the gear 2660 is assembled to the toner supplying roller 2550 by elastically deforming the roller section 2550*a* so that the toner supplying roller 2550 is moved in the axial direction to an extent that the pin hole 2550*c* is exposed outside the gear 2660, without the need to retract the gear 2660. Further, assembly of the E-shaped retaining ring to the shaft is a complicating task because a special tool needs to be used to assemble the E-shaped retaining ring onto a rotating shaft. On the other hand, the structure of the developing unit and the method of assembling the toner supplying roller according to the foregoing embodiment, in which it is possible to restrict movement of the gear using a bearing and not an E-shaped retaining ring, are outstanding in terms that assemblability can be improved.

===(2) Other Considerations ===

In the foregoing embodiment, a printer having a plurality of attach/detach sections was described as an example. However, the printer may have a lid unit that becomes closable when a developing unit to be attached is inserted into a single attach/detach section.

Further, in the foregoing embodiment, as shown in FIG. 23, the developer containing body is a developing unit 2051, 2052, 2053, 2054 (developing device) having a developing roller 2510 (developer bearing member) adapted to bear toner used for developing a latent image borne by the photoconductor 2020. This, however, is not a limitation. For example, the developer containing body may be a cartridge that is not provided with a developing roller 2510 and that merely contains toner to be supplied to the developing unit 2051, 2052, 2053, 2054.

Third Embodiment

===(3) Overview of Image Forming Apparatus===

Figure 27:
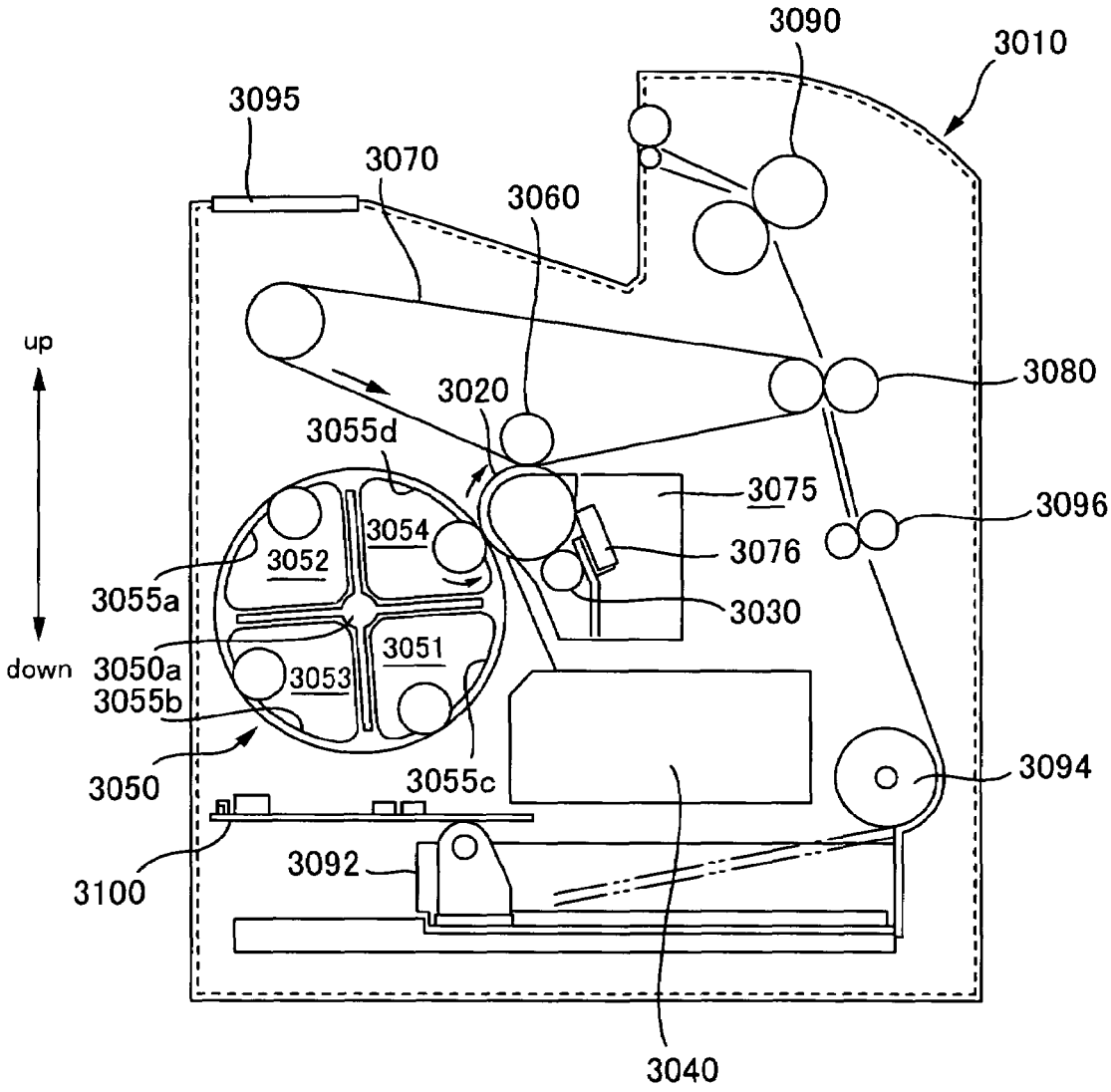
FIG. 27 is a diagram showing main structural components constructing a printer.
Figure 28:
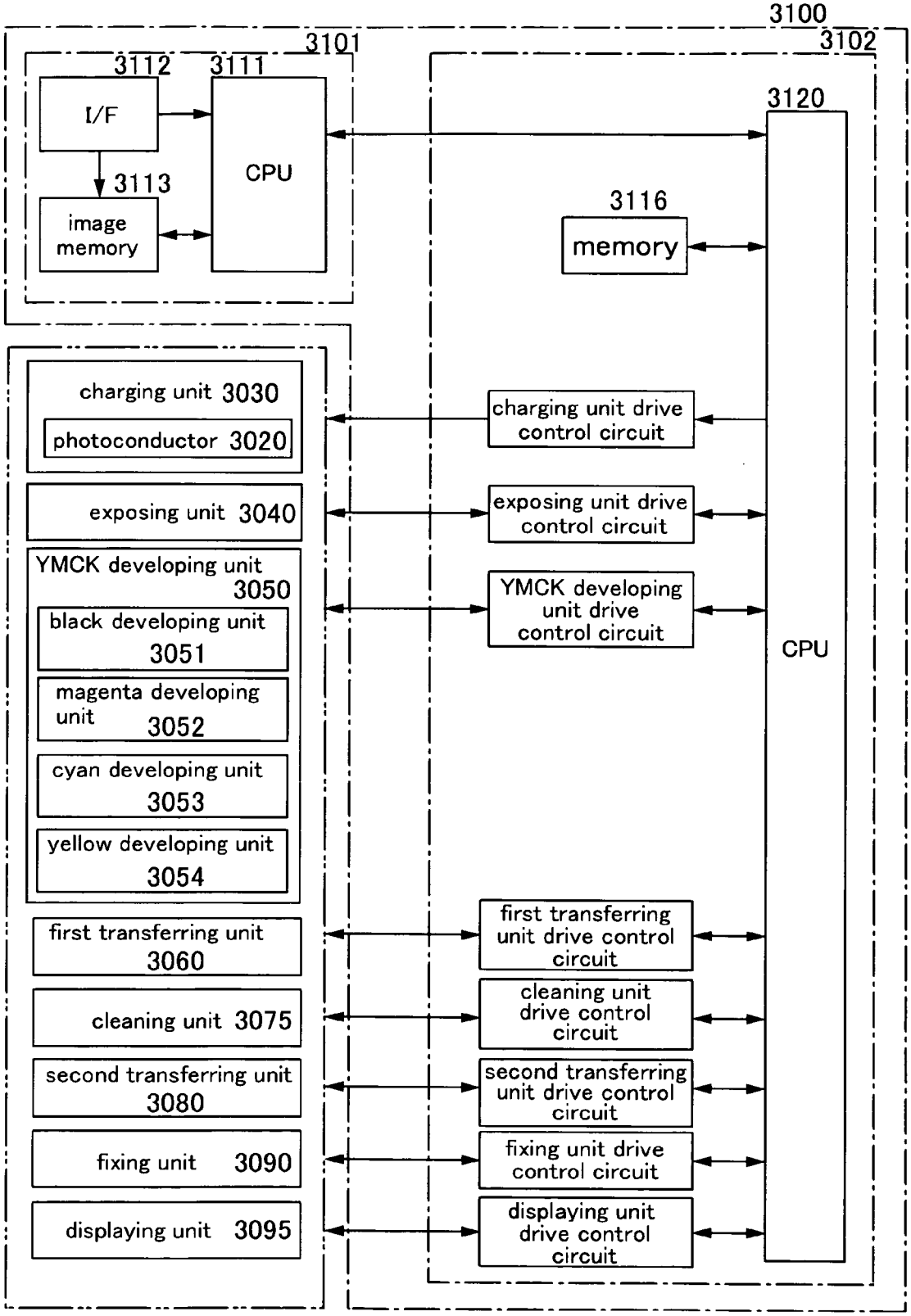
FIG. 28 is a block diagram showing a control unit provided in the printer of FIG. 27.

With reference to FIG. 27 and FIG. 28, a configuration example and an operation example of an image forming apparatus, which forms images using a developing unit serving as a "developing device", will be described, taking a laser-beam printer 3010 (hereinafter referred to also as "printer") as an example. FIG. 27 is a diagram showing main structural components constructing the printer 3010. FIG. 28 is a diagram for describing a configuration of a control unit provided in the printer 3010. It should be noted that in FIG. 27, the vertical direction is shown by the arrow, and, for example, a paper supply tray 3092 is arranged at a lower section of the printer 3010, and a fixing unit 3090 is arranged at an upper section of the printer 3010.

<Configuration of Printer>

As shown in FIG. 27, the printer 3010 according to the present embodiment is provided with a charging unit 3030, an exposing unit 3040, a YMCK developing unit 3050, a first transferring unit 3060, an intermediate transferring body 3070, and a cleaning unit 3075. These components are arranged in the direction of rotation of a photoconductor 3020, which is an example of an "image bearing member" that bears latent images. The printer 3010 is further provided with a second transferring unit 3080, a fixing unit 3090, a displaying unit 3095 constructed of a liquid-crystal panel and serving as means for making notifications to a user, and a control unit 3100 for controlling these units etc. and managing the operations as a printer.

The photoconductor 3020 has a cylindrical electrically-conductive base and a photoconductive layer formed on the outer peripheral surface of the electrically-conductive base, and it is rotatable about its central axis. In the present embodiment, the photoconductor 3020 rotates clockwise, as shown by the arrow in FIG. 27.

The charging unit 3030 is a device for electrically charging the photoconductor 3020. The exposing unit 3040 is a device for forming a latent image on the charged photoconductor 3020 by radiating a laser beam thereon. The exposing unit 3040 has, for example, a semiconductor laser, a polygon mirror, and an F-θ lens, and radiates a modulated laser beam onto the charged photoconductor 3020 in accordance with image signals having been input from a not-shown host computer such as a personal computer or a word processor.

The YMCK developing unit 3050 is a device for developing the latent image formed on the photoconductor 3020 using toner T, that is, black (K) toner contained in a black developing unit 3051, magenta (M) toner contained in a magenta developing unit 3052, cyan (C) toner contained in a cyan developing unit 3053, and yellow (Y) toner contained in a yellow developing unit 3054. The toner T is an example of a "developer" contained in each of the developing units 3051, 3052, 3053, and 3054, which are an example of a "developing device".

The YMCK developing unit 3050 can move the positions of the four developing units 3051, 3052, 3053, and 3054 by rotating while the developing units 3051, 3052, 3053, and 3054 are in an attached state. More specifically, the YMCK developing unit 3050 holds the four developing units 3051, 3052, 3053, and 3054 with four holding sections 3055*a*, 3055*b*, 3055*c*, and 3055*d*. The four developing units 3051, 3052, 3053, and 3054 can be rotated about a central shaft 3050*a* while maintaining their relative positions. Every time an image forming process for one page is finished, one of the four developing units 3051, 3052, 3053, and 3054 selectively opposes the photoconductor 3020 to successively develop the latent image formed on the photoconductor 3020 using the toner T contained in the opposing developing unit 3051, 3052, 3053, or 3054. It should be noted that each of the four developing units 3051, 3052, 3053, and 3054 described above is attachable to and detachable from the respective holding sections of the YMCK developing unit 3050. Details on the developing units will be described further below.

The first transferring unit 3060 is a device for transferring, onto the intermediate transferring body 3070, a single-color toner image formed on the photoconductor 3020. When the toners of all four colors are successively transferred in a superimposing manner, a full-color toner image will be formed on the intermediate transferring body 3070.

The intermediate transferring body 3070 is a laminated endless belt that is made by providing an aluminum layer on the surface of a PET film by vapor deposition, and then further applying semiconducting coating on the outer layer thereof. The intermediate transferring body 3070 is driven to rotate at substantially the same circumferential speed as the photoconductor 3020.

The second transferring unit 3080 is a device for transferring the single-color toner image or the full-color toner image formed on the intermediate transferring body 3070 onto a medium such as paper, film, and cloth.

The fixing unit 3090 is a device for fusing the single-color toner image or the full-color toner image, which has been transferred onto the medium, to the medium to make it into a permanent image.

The cleaning unit 3075 is a device that is provided between the first transferring unit 3060 and the charging unit 3030, that has a rubber cleaning blade 3076 made to abut against the surface of the photoconductor 3020, and that is for removing the toner T remaining on the photoconductor 3020 by scraping it off with the cleaning blade 3076 after the toner image has been transferred onto the intermediate transferring body 3070 by the first transferring unit 3060.

The control unit 3100 is provided with a main controller 3101 and a unit controller 3102 as shown in FIG. 28. Image signals and control signals are input to the main controller 3101, and according to instructions based on the image signals and control signals, the unit controller 3102 controls each of the above-mentioned units etc. to form an image.

The main controller 3101 is connected to a host computer via the interface 3112, and is provided with an image memory 3113 for storing the image signals that have been input from the host computer, a CPU 3111 that controls the entire printer 3010, and so forth.

The unit controller 3102 has a CPU 3120, a memory 3116 such as a RAM and a ROM, drive control circuits for driving and controlling the units in the body of the apparatus (i.e., the charging unit 3030, the exposing unit 3040, the first transferring unit 3060, the cleaning unit 3075, the second transferring unit 3080, the fixing unit 3090, and the displaying unit 3095) and the YMCK developing unit 3050, and so forth, and it controls the units based on the signals that are input from the main controller 3101.

<Operation of Printer>

Next, operations of the printer 3010 will be described.

First, when image signals and control signals are input from the not-shown host computer to the main controller 3101 of the printer 3010 through an interface (I/F) 3112, the photoconductor 3020, a developing roller which is an example of a "developer bearing roller", and the intermediate transferring body 3070 rotate under the control of the unit controller 3102 based on the instructions from the main controller 3101. While being rotated, the photoconductor 3020 is successively charged by the charging unit 3030 at a charging position.

With the rotation of the photoconductor 3020, the charged area of the photoconductor 3020 reaches an exposing position. A latent image that corresponds to the image information about the first color, for example, yellow Y, is formed in that area by the exposing unit 3040. The YMCK developing unit 3050 positions the yellow developing unit 3054, which contains yellow (Y) toner, at the developing position, which is in opposition to the photoconductor 3020.

With the rotation of the photoconductor 3020, the latent image formed on the photoconductor 3020 reaches the developing position, and is developed with the yellow toner by the yellow developing unit 3054. Thus, a yellow toner image is formed on the photoconductor 3020.

With the rotation of the photoconductor 3020, the yellow toner image formed on the photoconductor 3020 reaches a first transferring position, and is transferred onto the intermediate transferring body 3070 by the first transferring unit 3060. At this time, a first transferring voltage, which is in an opposite polarity from the polarity to which the toner T has been charged, is applied to the first transferring unit 3060. It should be noted that, during this process, the photoconductor 3020 and the intermediate transferring body 3070 are placed in contact with each other, but the second transferring unit 3080 is kept separated from the intermediate transferring body 3070.

By subsequently performing the above-mentioned processes for the second, the third, and the fourth colors using each of the developing units, toner images in four colors corresponding to the respective image signals are transferred onto the intermediate transferring body 3070 in a superimposed manner. As a result, a full-color toner image is formed on the intermediate transferring body 3070.

With the rotation of the intermediate transferring body 3070, the full-color toner image formed on the intermediate transferring body 3070 reaches a second transferring position, and is transferred onto a medium by the second transferring unit 3080. It should be noted that the medium is carried from the paper supply tray 3092 to the second transferring unit 3080 via the paper-feed roller 3094 and resisting rollers 3096. During transferring operations, a second transferring voltage is applied to the second transferring unit 3080 and also the unit 3080 is pressed against the intermediate transferring body 3070.

The full-color toner image transferred onto the medium is heated and pressurized by the fixing unit 3090 and fused to the medium.

On the other hand, after the photoconductor 3020 passes the first transferring position, the toner T adhering to the surface of the photoconductor 3020 is scraped off by the cleaning blade 3076 that is supported on the cleaning unit 3075, and the photoconductor 3020 is prepared for electrical charging for forming the next latent image. The scraped-off toner T is collected in a remaining-toner collector of the cleaning unit 3075.

===(3) Configuration Example of Developing Unit===

Figure 29:
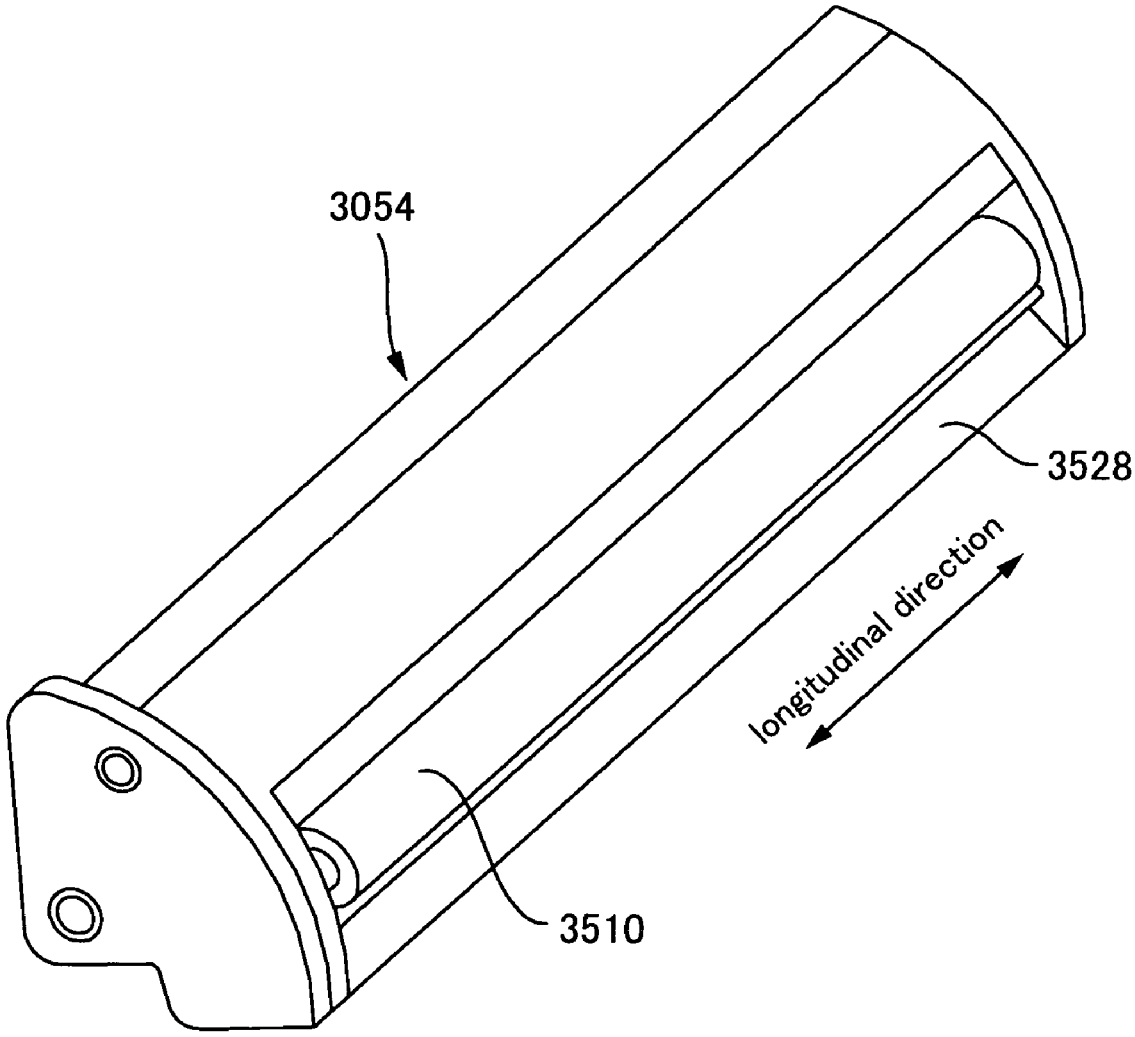
FIG. 29 is a conceptual diagram of a developing unit.
Figure 30:
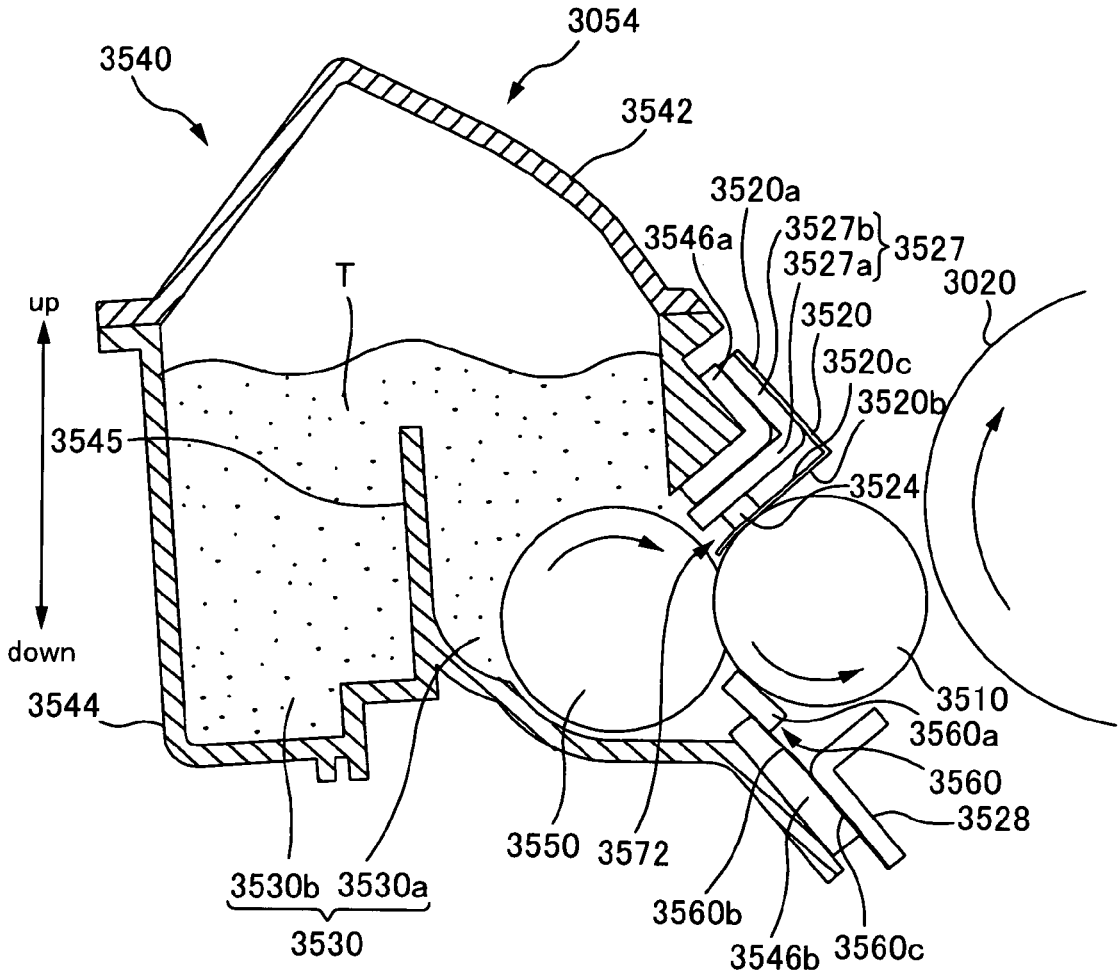
FIG. 30 is a section view showing main structural components of the developing unit.

Next, with reference to FIG. 29 and FIG. 30, a configuration example of the developing unit will be described. FIG. 29 is a conceptual diagram of a developing unit. FIG. 30 is a section view showing main structural components of the developing unit. It should be noted that the section view shown in FIG. 30 is a section of the developing unit bisected by a plane orthogonal to the longitudinal direction shown in FIG. 29. Further, in FIG. 30, the arrow indicates the vertical direction as in FIG. 27, and, for example, the central axis of the developing roller 3510 is located below the central axis of the photoconductor 3020. Further, in FIG. 30, the yellow developing unit 3054 is shown positioned at the developing position, which is in opposition to the photoconductor 3020.

The YMCK developing unit 3050 is provided with: the black developing unit 3051 containing black (K) toner; the magenta developing unit 3052 containing magenta (M) toner; the cyan developing unit 3053 containing cyan (C) toner; and the yellow developing unit 3054 containing yellow (Y) toner. Since the configuration of each of the developing units is the same, description will be made only about the yellow developing unit 3054 below.

<Configuration of Yellow Developing Unit>

The yellow developing unit 3054 has, for example: a developing roller 3510; an upper seal member 3520 which is an example of a "seal member"; a toner containing body 3530; a housing 3540; a toner supplying roller 3550 which is an example of a "developer supplying roller"; and a restriction blade 3560.

The developing roller 3510 bears toner T and delivers it to the developing position opposing the photoconductor 3020. The developing roller 3510 is made of, for example, aluminum alloy such as aluminum alloy 5056 or aluminum alloy 6063, or iron alloy such as STKM, and where necessary, the roller 3510 is plated with, for example, nickel plating or chromium plating.

The developing roller 3510 has a shaft section 3510*a* and a large-diameter section 3510*b*. The developing roller 3510 is rotatably supported by both ends of its shaft section 3510*a* being supported by developing-roller supporting sections 3529 of a holder 3526 (described later) via bearings 3576 (see FIG. 32). As shown in FIG. 30, the developing roller 3510 rotates in the opposite direction (counterclockwise in FIG. 30) to the rotating direction of the photoconductor 3020 (clockwise in FIG. 30). The central axis of the roller 3510 is located below the central axis of the photoconductor 3020.

Further, in a state where the yellow developing unit 3054 is in opposition to the photoconductor 3020, there is a gap between the developing roller 3510 and the photoconductor 3020. That is, the yellow developing unit 3054 develops the latent image formed on the photoconductor 3020 in a non-contacting state. It should be noted that an alternating field is generated between the developing roller 3510 and the photoconductor 3020 upon development of the latent image formed on the photoconductor 3020.

The housing 3540 is manufactured by welding together a plurality of integrally-molded housing sections made of resin, that is, an upper housing section 3542 and a lower housing section 3544. In the housing 3540 is formed a toner containing body 3530 for containing the toner T. The toner containing body 3530 is divided into two toner containing sections, namely, the first toner containing section 3530*a* and the second toner containing section 3530*b*, by a partitioning wall 3545 that protrudes inwards (in the up/down direction of FIG. 30) from the inner wall. The first toner containing section 3530*a* and the second toner containing section 3530*b* are connected at their upper sections, and in the state shown in FIG. 30, movement of the toner T is restricted by the partitioning wall 3545. However, when the YMCK developing unit 3050 is rotated, the toner contained in the first toner containing section 3530*a* and the second toner containing section 3530*b* is once gathered on the side of the section where the containing sections are connected, which is on the upper side when in the developing position, and when the YMCK developing unit 3050 returns to the state shown in FIG. 30, the toner gets mixed and is returned to the first toner containing section 3530*a* and the second toner containing section 3530*b*. In other words, the toner T is appropriately stirred within the developing unit by the rotation of the YMCK developing unit 3050.

Therefore, in the present embodiment, no stirring member is provided in the toner containing body 3530. However, it is possible to provide a stirring member for stirring the toner T contained in the toner containing body 3530. Further, as shown in FIG. 30, the housing 3540 (more specifically, the first toner containing section 3530*a*) has an opening 3572 in its lower section, and the developing roller 3510 described below is provided facing the opening 3572.

The toner supplying roller 3550 is provided in the first toner containing section 3530*a* described above and supplies the toner T contained in the first toner containing section 3530*a* to the developing roller 3510. It also strips off, from the developing roller 3510, the toner T remaining on the developing roller 3510 after development. The toner supplying roller 3550 is arranged in a lower section of the first toner containing section 3530*a*. The toner T contained in the first toner containing section 3530*a* is supplied by the toner supplying roller 3550 to the developing roller 3510 at the lower section of the first toner containing section 3530*a*. The toner supplying roller 3550 is made of, for example, polyurethane foam, and is made to abut against the developing roller 3510 in an elastically deformed state. The developing roller 3510 and the toner supplying roller 3550 are provide in opposition to one another such that their axes are parallel to one another. The toner supplying roller 3550 abutting against the developing roller 3510 is elastically deformed by the rollers 3510 and 3550 being urged in the direction toward each other at both ends where the developing roller 3510 and the toner supplying roller 3550 are being supported. The toner supplying roller 3550 is rotatable about its central axis, and the central axis of the toner supplying roller 3550 is located lower than the central axis of rotation of the developing roller 3510. Further, the toner supplying roller 3550 rotates in the opposite direction (clockwise in FIG. 30) to the rotating direction of the developing roller 3510 (counterclockwise in FIG. 30).

The upper seal member 3520 abuts against the developing roller 3510 along the axial direction thereof to allow the toner T remaining on the developing roller 3510 after passing the developing position to move into the housing 3540 and also to restrict the toner T in the housing 3540 from moving out therefrom. The configuration of the upper seal member 3520 and its peripheral area will be described in detail further below.

The restriction blade 3560 abuts against the developing roller 3510 along the axial direction thereof, and restricts the thickness of the layer of the toner T borne by the developing roller 3510 as well as gives an electric charge to the toner T borne by the developing roller 3510. The restriction blade 3560 includes a rubber section 3560*a* and a rubber-supporting section 3560*b*. The rubber section 3560*a* is made of, for example, silicone rubber or urethane rubber. The rubber-supporting section 3560*b* is a thin plate that is made of, for example, phosphor bronze or stainless steel, and that has a spring-like characteristic.

The rubber section 3560*a* is supported by the rubber-supporting section 3560*b*. The rubber-supporting section 3560*b* presses, with its urging force, the rubber section 3560*a* against the developing roller 3510. The rubber-supporting section 3560*b* is attached to a restriction-blade supporting section 3528 of the holder 3526, which is described later, in a state where one end of the rubber-supporting section 3560*b* is supported by the restriction-blade supporting section 3528.

The end of the restricting blade 3560 opposite from the end that is being supported by the restriction-blade supporting section 3528, i.e., the tip end of the restriction blade 3560, is not placed in contact with the developing roller 3510; rather, a section at a predetermined distance away from the tip end contacts, with some breadth, the developing roller 3510. That is, the restriction blade 3560 does not abut against the developing roller 3510 at its edge, but abuts against the roller 3510 near its central portion. Further, the restriction blade 3560 is arranged so that its tip end faces toward the upstream side of the rotating direction of the developing roller 3510, and thus, makes a so-called counter-abutment with respect to the roller 3510. It should be noted that the abutting position at which the restriction blade 3560 abuts against the developing roller 3510 is below the central axis of the developing roller 3510 and is also below the central axis of the toner supplying roller 3550. It should be noted that the restriction blade 3560 also has the function of preventing the toner T from spilling from the toner containing body 3530 by abutting against the developing roller 3510 along its axial direction.

Figure 31:
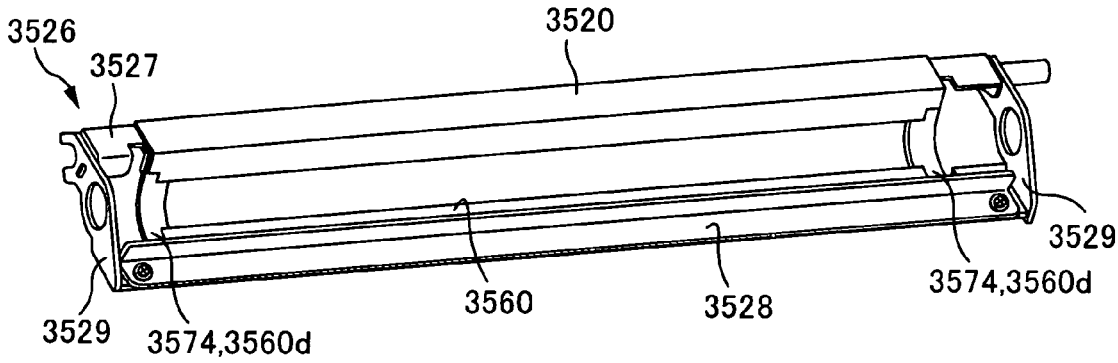
FIG. 31 is a perspective view showing how a holder supports an upper seal member, a restriction blade, and end seals.

Further, the restriction blade 3560 supports end seals 3574 at its ends 3560*d* in the longitudinal direction (see FIG. 31). The end seals 3574 are made of nonwoven fabric, and the end seals 3574 have the function of preventing the toner T from spilling from between the housing 3540 and the circumferential surface of the developing roller 3510 by abutting against the end in the axial direction of the developing roller 3510, along the circumferential direction of the developing roller 3510.

In the yellow developing unit 3054 structured as above, the toner supplying roller 3550 supplies the toner T contained in the toner containing body 3530 to the developing roller 3510. With the rotation of the developing roller 3510, the toner T, which has been supplied to the developing roller 3510, reaches the abutting position of the restriction blade 3560; then, as the toner T passes the abutting position, the toner is electrically charged and its layer thickness is restricted. With further rotation of the developing roller 3510, the toner T on the developing roller 3510, which has been electrically charged and whose layer thickness has been restricted, reaches the developing position opposing the photoconductor 3020; then, under the alternating field, the toner T is used at the developing position for developing the latent image formed on the photoconductor 3020. With further rotation of the developing roller 3510, the toner T on the developing roller 3510, which has passed the developing position, passes the upper seal member 3520 and is collected into the developing unit by the upper seal member 3520 without being scraped off. Further, the toner T that still remains on the developing roller 3510 can be stripped off by the toner supplying roller 3550.

===(3) Configuration of Upper Seal Member and its Periphery===

The configuration of the upper seal member 3520, which is an example of a "seal member", and the peripheral area thereof will be described with reference to FIG. 30 through FIG. 37.

Figure 32:
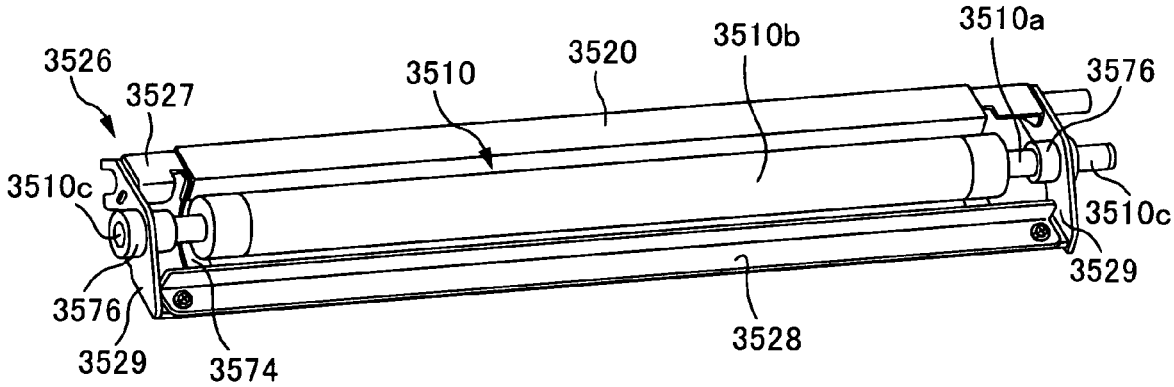
FIG. 32 is a perspective view showing how the holder supports the upper seal member, the restriction blade, the end seals, and a developing roller 3510.
Figure 33:
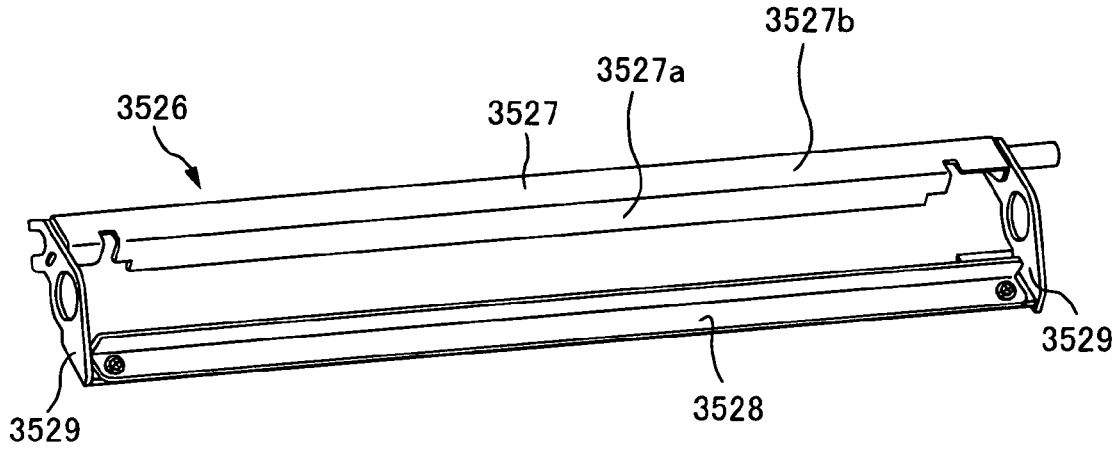
FIG. 33 is a perspective view of the holder.
Figure 34:
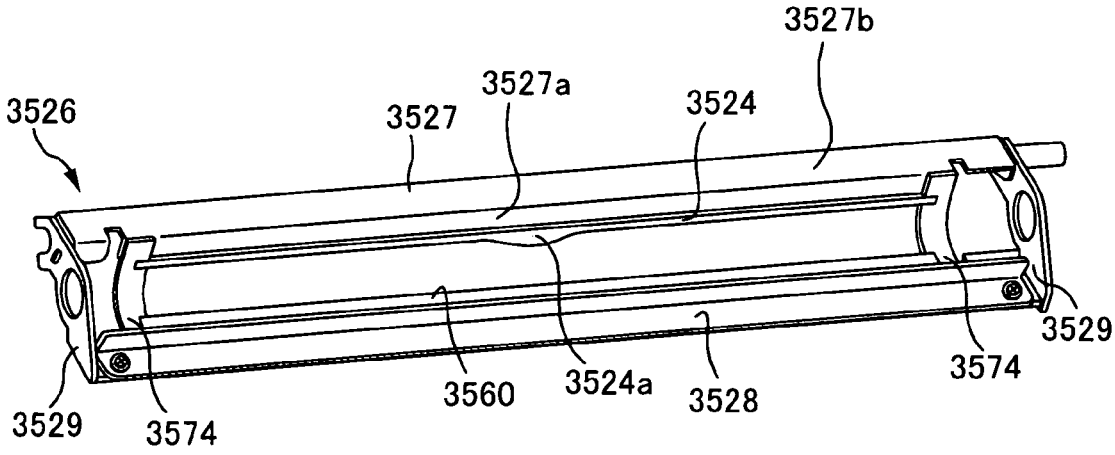
FIG. 34 is a perspective view showing an upper-seal urging member fixed to the holder.
Figure 35:
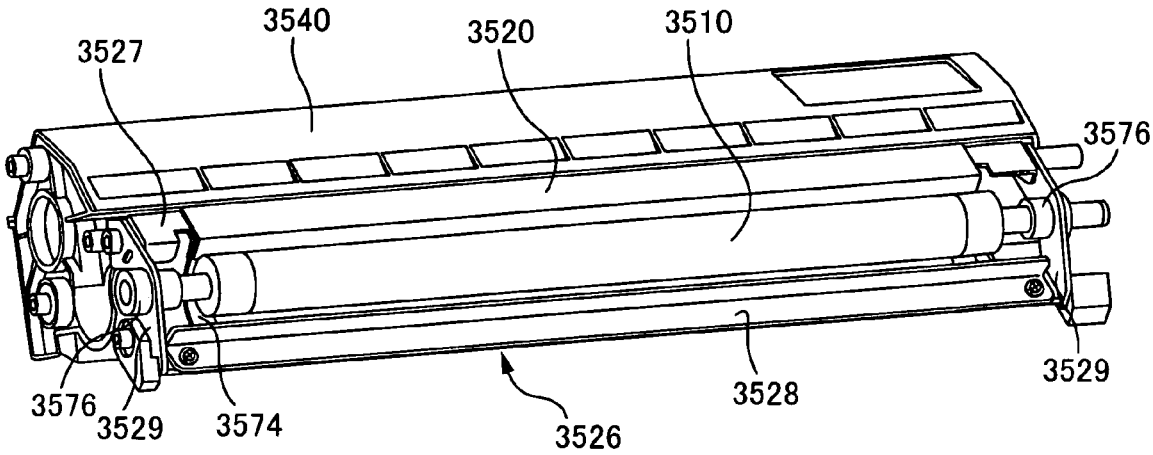
FIG. 35 is a perspective view showing how the holder is attached to the housing via a housing seal.
Figure 36:
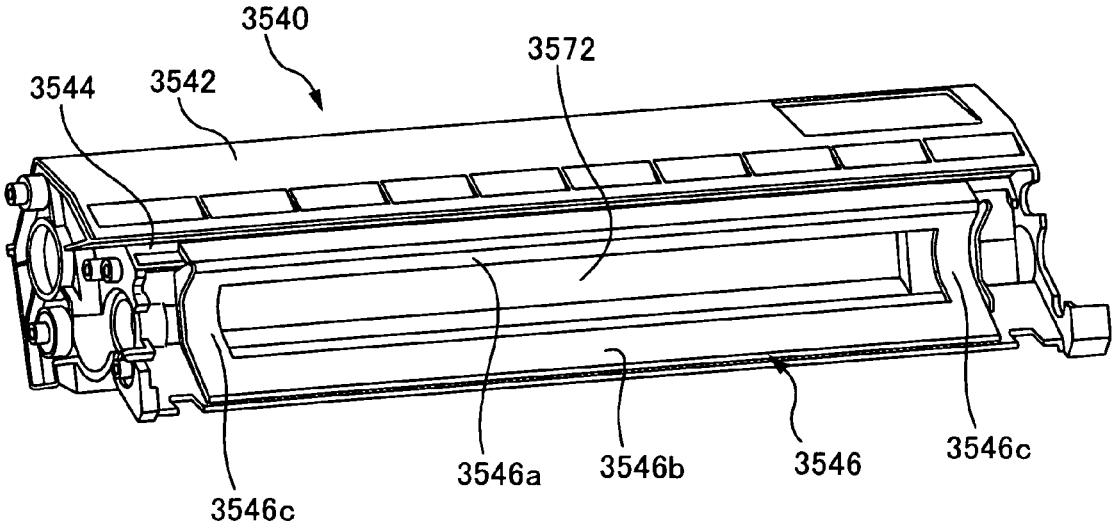
FIG. 36 is a perspective view showing how the housing seal is fixed to the housing.
Figure 37:
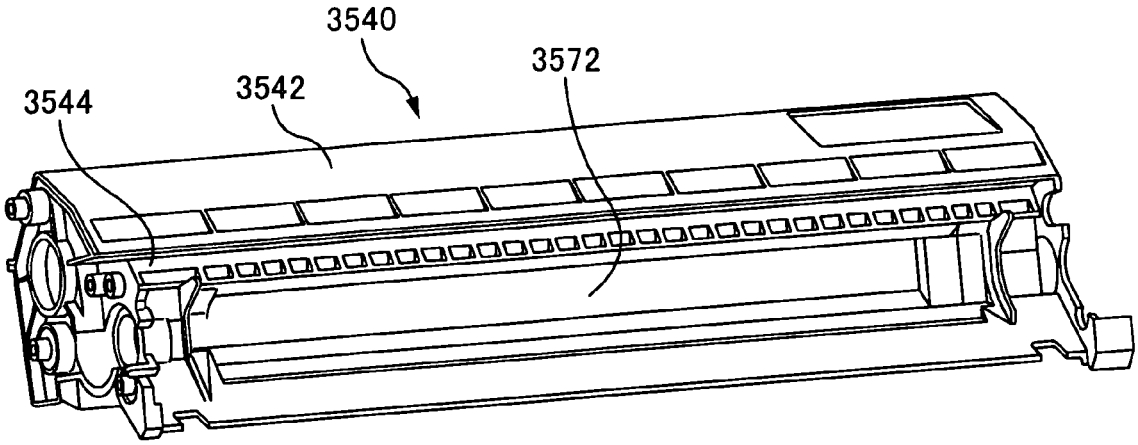
FIG. 37 is a perspective view showing the section of the housing to which the housing seal is fixed.

FIG. 31 is a perspective view showing how the holder 3526 supports the upper seal member 3520, the restriction blade 3560, and the end seals 3574. FIG. 32 is a perspective view showing how the holder 3526 supports the upper seal member 3520, the restriction blade 3560, the end seals 3574, and the developing roller 3510. FIG. 33 is a perspective view of the holder 3526. FIG. 34 is a diagram in which the upper seal member 3520 is removed from the perspective view of FIG. 31, and is a perspective view showing the upper-seal urging member 3524 fixed to the holder 3526. FIG. 35 is a perspective view showing how the holder 3526 is attached to the housing 3540. FIG. 36 is a diagram in which the holder 3526 is removed from the perspective view of FIG. 35, and is a perspective view showing how the housing seal 3546 is fixed to the housing 3540. FIG. 37 is a diagram in which the holder 3526 and the housing seal 3546 are removed from the perspective view of FIG. 35, and is a perspective view showing the section of the housing 3540 to which the housing seal 3546 is fixed.

As described above, the upper seal member 3520 abuts against the developing roller 3510 along its axial direction to allow the toner T that remains on the developing roller 3510 after passing the developing position to move into the housing 3540, but to restrict the toner T in the housing 3540 from moving out from the housing 3540. The upper seal member 3520 is a seal made, for example, of polyethylene film. As shown in FIG. 30 and FIG. 31, the upper seal member 3520 is supported by the holder 3526, which is an example of a "support member", and as shown in FIG. 32, the longitudinal direction of the upper seal member 3520 is arranged parallel to the axial direction of the developing roller 3510. The abutting position where the upper seal member 3520 abuts against the developing roller 3510 is above the central axis of the developing roller 3510.

The holder 3526 is a support member made of metal for supporting the developing roller 3510, the restriction blade 3560, and the upper seal member 3520. As shown in FIG. 33, the holder 3526 has an upper-seal supporting member 3527 along its longitudinal direction (i.e., the axial direction of the developing roller 3510), a restriction-blade supporting section 3528 also along its longitudinal direction (i.e., the axial direction of the developing roller 3510), and developing-roller supporting sections 3529 that are arranged on the outer sides, in the longitudinal direction (axial direction), of the upper-seal supporting member 3527 and the restriction-blade supporting section 3528 and that intersect the longitudinal direction (the axial direction). The holder 3526 forms a substantially rectangular shape by the upper-seal supporting member 3527 and the restriction-blade supporting section 3528 arranged parallel to one another being fixed to the developing-roller supporting sections 3529 arranged on both sides thereof in the longitudinal direction. The developing-roller supporting sections 3529 are fixed to the housing 3540.

The upper seal member 3520 is supported by the upper-seal supporting member 3527 at its lateral-direction end 3520*a* (see FIG. 30). It should be noted that as described above, the developing roller 3510 is supported by the developing-roller supporting sections 3529 at both its axial-direction ends 3510*c* in its axial direction, and the restriction blade 3560 is supported by the restriction-blade supporting section 3528 at its lateral-direction end 3560*c* (see FIG. 30). That is, the developing roller 3510 is supported at both its ends by the housing 3540 via the holder 3526.

Further, as shown in FIG. 30, in between the holder 3526 and a surface of the upper seal member 3520 (which is also referred to as the opposite surface 3520*c*) on the opposite side from the abutting surface 3520*b* of the upper seal member 3520 with which it abuts against the developing roller 3510, there is provided an upper-seal urging member 3524, which is an example of an "urging member", made of an elastic body such as Moltoprene. As shown in FIG. 34, the upper-seal urging member 3524 is arranged such that its longitudinal direction is parallel to the axial direction of the developing roller 3510, and one side of the upper-seal urging member 3524 is fixed to the upper-seal supporting member 3527 of the holder 3526, which is positioned on the side of the housing 3540 with respect to the developing roller 3510. More specifically, a folded section 3527*a* is formed by folding the upper-seal supporting member 3527 along its longitudinal direction, and the upper-seal urging member 3524 is fixed to this folded section 3527*a*. On the other hand, the upper seal member 3520 is fixed to a plate section 3527*b* (which is referred to below as "outer-circumferential-side plate section") which is a portion of the upper-seal supporting member 3527 that is not the folded section 3527*a*. The upper-seal urging member 3524 is positioned between the opposite surface 3520*c* and the folded section 3527*a*, and in a state where the developing unit has been assembled, the other side of the upper-seal urging member 3524 abuts against the upper seal member 3520. In this state, the upper-seal urging member 3524 is compressed between the folded section 3527*a* and the upper seal member 3520 abutting against the developing roller 3510, and presses the upper seal member 3520 toward the developing roller 3510 using the restitution force caused by compression of the elastic member as the urging force for urging the upper seal member 3520 toward the developing roller 3510. The upper-seal urging member 3524 of the present embodiment is designed so that the urging force at a central section 3524*a* in the axial direction of the developing roller 3510 is different from the urging force of the rest of the member 3524. The urging force of the upper-seal urging member 3524 and its function will be described further below.

As shown in FIG. 35 through FIG. 37, in a state where the developing roller 3510, the restriction blade 3560, the end seals 3574, the upper seal member 3520, and the upper-seal urging member 3524 have been assembled to the holder 3526, the holder 3526 is attached to the housing 3540 via the housing seal 3546, which is an example of an "other seal member" that is different from the upper seal member 3520.

The housing seal 3546 has the function of preventing the toner T from spilling from between the housing 3540 and the holder 3526, or the components assembled to the holder 3526. As shown in FIG. 36, the housing seal 3546 is made by cutting out the central section (a rectangular section) of a rectangular elastic member made, for example, of Moltoprene, and includes a first seal section 3546*a*, a second seal section 3546*b*, and third seal sections 3546*c*.

The first seal section 3546*a* abuts against the upper-seal supporting member 3527 of the holder 3526 and the housing 3540 to achieve the function of preventing the toner T from spilling from between the upper-seal supporting member 3527 and the housing 3540. The second seal section 3546*b* abuts against the rubber-supporting section 3560*b* of the restriction blade 3560 and the housing 3540 to achieve the function of preventing the toner T from spilling from between the rubber-supporting section 3560*b* and the housing 3540. The third seal sections 3546*c* abut against the end seals 3574 and the housing 3540 to achieve the function of preventing the toner T from spilling from between the end seals 3574 and the housing 3540.

It should be noted that, among the holder 3526 and the housing 3540, the housing seal 3546 is fixed only to the housing 3540. Further, the second seal section 3546*b* not only has the function of preventing the toner T from spilling, but also has the function of stabilizing the elastic force resulting from bending of the rubber-supporting section 3560*b* and making the rubber section 3560*a* abut against the developing roller 3510 more evenly.

As described above, in order to appropriately make the abutting pressure of the upper seal member 3520 against the developing roller 3510 even, in the present embodiment, the upper-seal urging member 3524 is provided between the holder 3526 and the opposite surface 3520*c* of the upper seal member 3520 on the opposite side from the abutting surface 3520*b* with which the upper seal member 3520 abuts against the developing roller 3510.

More specifically, in order for the upper seal member 3520 to achieve the function of preventing the developer from spilling, it is necessary to make the abutting pressure of the upper seal member 3520 against the developing roller 3510 even. To achieve this, the holder 3526 is provided with the upper-seal urging member 3524, the developing roller 3510, and the upper seal member 3520 such that the position of the upper-seal urging member 3524—for example, the relative positioning among the developing roller 3510, the upper seal member 3520, and the member with which the upper-seal urging member 3524 abuts on the opposite side from the upper seal member 3520 (in this embodiment, the holder 3526)—is appropriately set at a desired position.

===(3) Urging Force of Upper-seal Urging Member 3524 and its Function===

As described above, the upper-seal urging member 3524 of the present embodiment is designed so that the urging force at a central section 3524*a* in the axial direction of the developing roller 3510 is different from the urging force of the rest of the member 3524. This is done because, even in a correctly-assembled developing unit, there is a possibility that the urging force for urging the upper seal member 3520 toward the developing roller 3510 is not exerted properly at the central section in the axial direction, and in order to make the urging force be exerted appropriately, the urging force of the central section is made different from that of the other sections.

First, the reason why the urging force for urging the upper seal member 3520 toward the developing roller 3510 may not be exerted properly at the central section in the axial direction, even in a correctly-assembled developing unit, will be described. In order to prevent the toner from spilling from between the developing roller 3510 and the housing 3540, it is necessary to make the abutting pressure of the upper seal member 3520 against the developing roller 3510 (i.e., the urging force of the upper-seal urging member 3524) even, as described above. Here, "the abutting pressure of the upper seal member 3520 against the developing roller 3510 being even" means that the abutting pressure is within a predetermined range along the axial direction and a predetermined pressure is reliably achieved. In cases where, however, the printer 3010 or the developing unit itself is inadvertently dropped during shipping etc., then an impactive force may be applied to the printer 3010 or the components of the developing unit.

Figure 38:
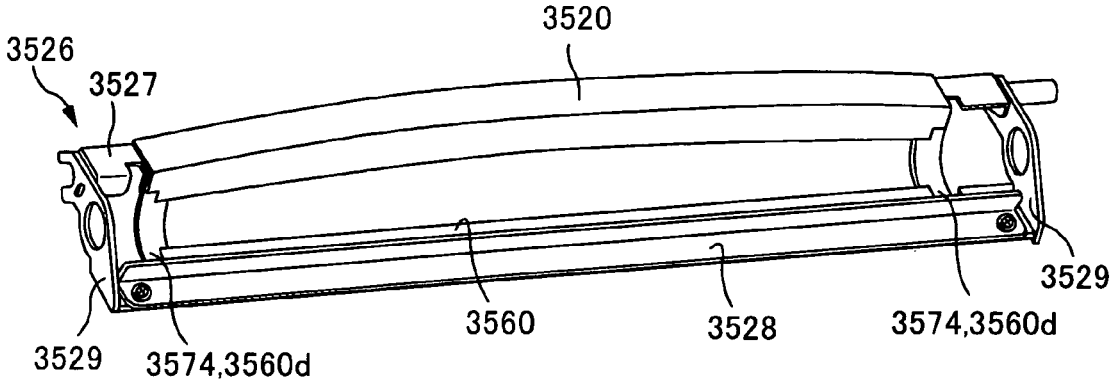
FIG. 38 is a diagram showing a first example of a warp that occurs in the upper-seal supporting member due to a shock.
Figure 39:
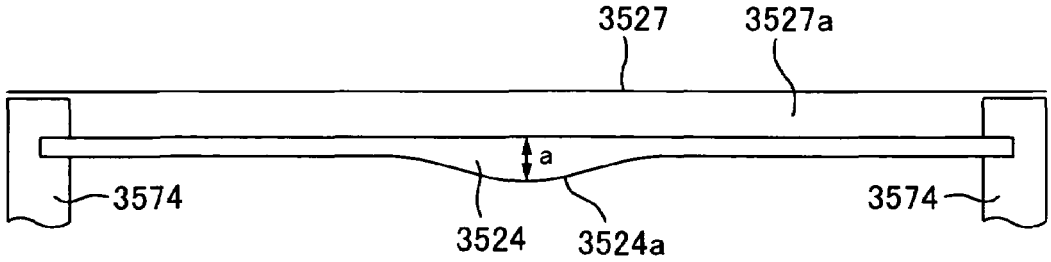
FIG. 39 is a diagram for describing the upper-seal urging member when such a warp of the first example occurs in the upper-seal supporting member.
Figure 40:
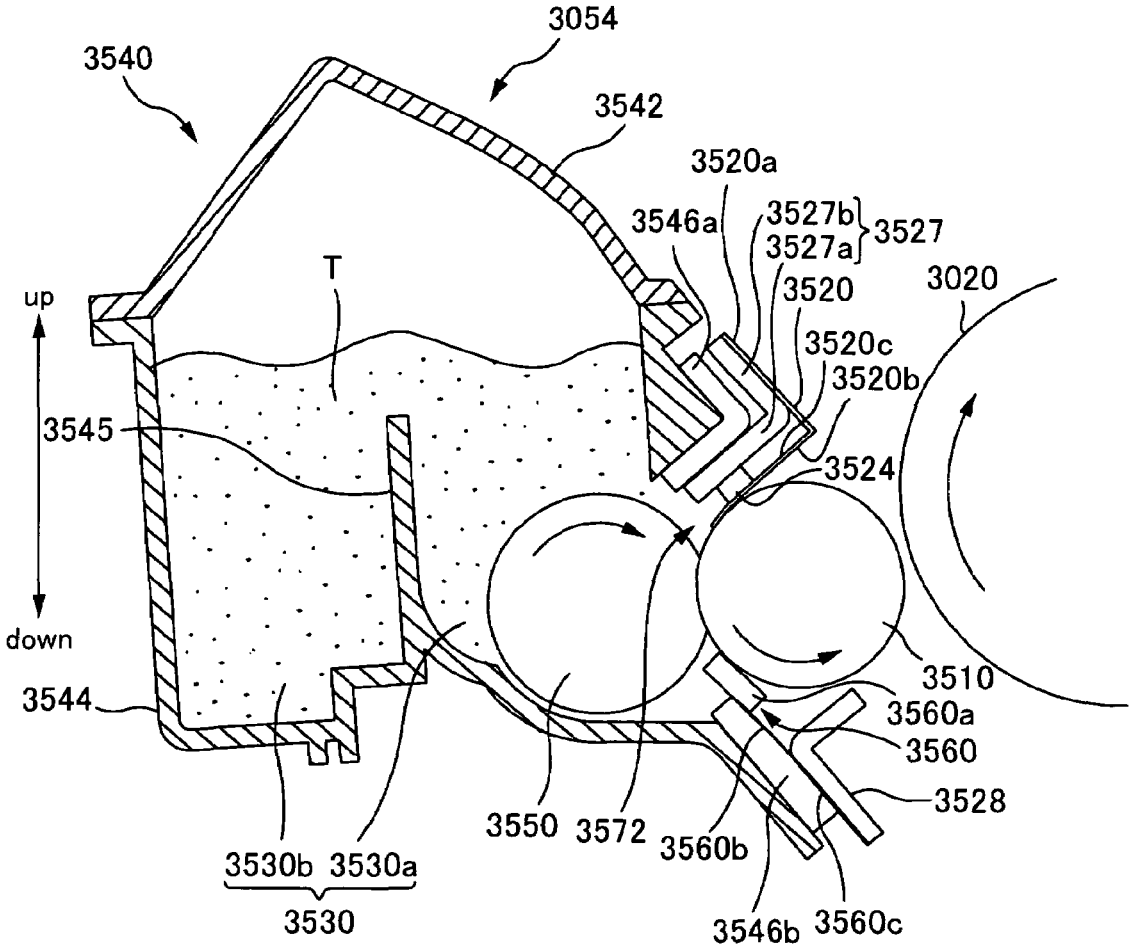
FIG. 40 is a section view taken at the center in the axial direction, for describing a state in which the warp of the first example has occurred in the upper-seal supporting member due to the shock.

FIG. 38 is a diagram showing a first example of a warp that occurs in the upper-seal supporting member 3527 due to a shock. FIG. 39 is a diagram for describing the upper-seal urging member when such a warp of the first example occurs in the upper-seal supporting member 3527. FIG. 40 is a section view taken at the center in the axial direction, for describing a state in which the warp of the first example has occurred in the upper-seal supporting member 3527 due to the shock.

When an impactive force is applied to the holder 3526, which is held by the housing 3540 at both ends in the axial direction of the developing roller 3510, then a warp such as that shown in FIG. 38 may occur in the upper-seal supporting member 3527, which is arranged in the longitudinal direction of the holder 3526 and fixed at both its ends to the developing-roller supporting sections 3529. If the warping direction is in a direction toward the photoconductor 3020 when the developing unit is attached to the printer 3010, that is, in a direction in which the central section of the outer-circumferential-side plate section 3527*b* of the upper-seal supporting member 3527 projects outwards, then the upper seal member 3520 and the upper-seal urging member 3524, which are fixed to the folded section 3527*a* of the upper-seal supporting member 3527, will also curve with the upper-seal supporting member 3527. At this time, the amount of positional change in the upper-seal urging member 3524 becomes largest at the central section in the axial direction of the developing roller 3510. As a result, the upper-seal urging member 3524 moves away from the developing roller 3510 in the tangential direction of the developing roller 3510, as shown in FIG. 40. Thus, the distance between developing roller 3510 and the folded section 3527*a*, which is the section to which the upper-seal urging member 3524 is fixed, changes in the widening direction, thereby making the urging force in the central section of the developing roller 3510 smaller than that of the other sections. To supplement this difference in the urging force, the upper-seal urging member 3524 of the present embodiment is configured such that the length "a" in the circumferential direction at the central section 3524*a* in the axial direction is made long toward the inner direction of the housing, as shown in FIG. 39. In other words, the upper-seal urging member 3524 is made so that the abutting area between the upper-seal urging member 3524 and the developing roller 3510 at the central section in the axial direction does not become small, even when, in particular, the upper-seal urging member 3524 curves with the upper-seal supporting member 3527 and moves away from the developing roller 3510. In this way, the urging force at the central section is made larger than that of the other sections so that the urging force is reliably achieved even when the pressing point of the upper-seal urging member 3524 against the developing roller 3510 relatively changes in the circumferential direction of the developing roller 3510.

Figure 41:
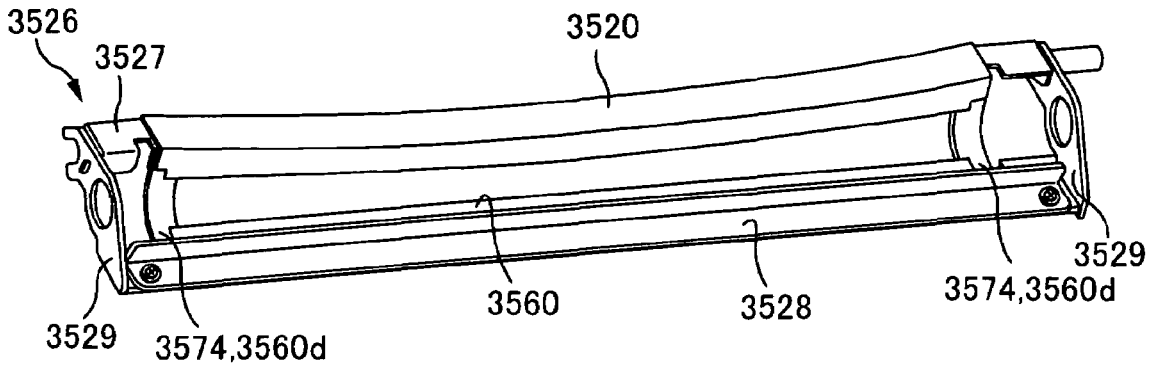
FIG. 41 is a diagram showing a second example of a warp that occurs in the upper-seal supporting member due to a shock.
Figure 42:
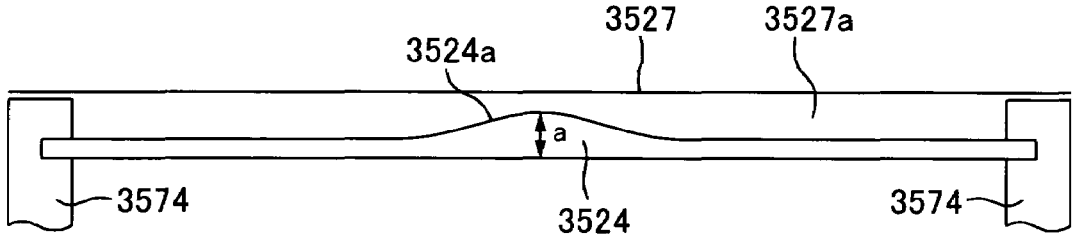
FIG. 42 is a diagram for describing the upper-seal urging member when such a warp of the second example occurs in the upper-seal supporting member.

The warp of the first example described above was in the direction toward the photoconductor 3020. However, depending, for example, on the structure of the developing unit and/or the direction in which the developing unit is dropped, a warp such as that of a second example may occur in the upper-seal supporting member 3527 in an opposite direction from the first example. FIG. 41 is a diagram showing a second example of a warp that occurs in the upper-seal supporting member 3527 due to a shock. FIG. 42 is a diagram for describing the upper-seal urging member when such a warp of the second example occurs in the upper-seal supporting member 3527. In a case where warping of the second example occurs, the upper seal member 3520 and the upper-seal urging member 3524 curve with the upper-seal supporting member 3527 in the direction away from the photoconductor 3020. Even in this case, the upper-seal urging member 3524 moves away from the developing roller 3510 in the tangential direction of the developing roller 3510 as with the case of the warp of the first example. However, since the warping direction is opposite from that of the first example, the upper-seal urging member 3524 is formed so that the length "a" in the circumferential direction at the axial-direction central section 3524*a* is made long toward the outer direction of the housing. In this way, it is possible to make the urging force at the central section larger than that of the other sections so that the urging force is appropriately achieved.

Figure 43:
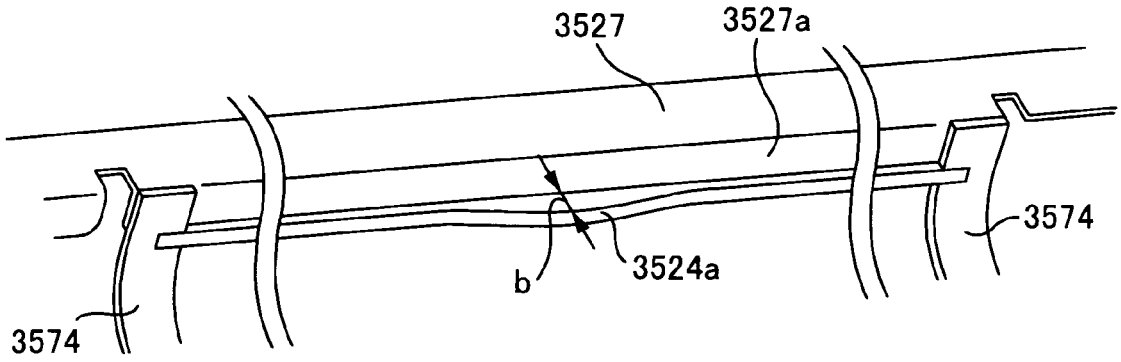
FIG. 43 is a diagram showing a modified example of an upper-seal urging member that may be used when warping of the first or second example occurs in the upper-seal supporting member.

FIG. 43 is a diagram showing a modified example of an upper-seal urging member 3524 that may be used when warping of the first or second example occurs in the upper-seal supporting member 3527.

That is, it is possible to make the thickness "b" at the central section 3524*a* of the upper-seal urging member 3524 thicker than the other sections, as shown in FIG. 43, in cases where the warping of the first or second example in the upper-seal supporting member 3527 causes the distance between developing roller 3510 and the upper-seal supporting member 3527 to change in the widening direction, which makes the urging force in the central section smaller than that of the other sections. For example, if warping of the first example occurs in the upper-seal supporting member 3527, then the upper-seal urging member 3524 will curve, thereby decreasing the abutting area between the upper-seal urging member 3524 and the developing roller 3510 at the central section in the axial direction. However, by forming the central section 3524*a* of the upper-seal urging member 3524 thick, the amount of compression is large, and it is possible to achieve a predetermined urging force even when the abutting area is small. As for cases in which the upper-seal supporting member 3527 warps in the direction toward the photoconductor 3020 as in the first example, the seal supporting member 3527 may be warped in advance in the direction away from the photoconductor 3020, as shown in FIG. 41. On the other hand, for cases in which the upper-seal supporting member 3527 warps in the direction away from the photoconductor 3020 as in the second example, the upper-seal supporting member 3527 may be warped in advance in the direction toward the photoconductor 3020, as shown in FIG. 38. By warping the seal supporting member 3527 in advance in this way, it becomes possible to make the upper-seal urging member 3524 exert an appropriate urging force and keep the abutting pressure of the upper seal member 3520 in the axial direction within the predetermined range, even when a shock etc. gives rise to such an impactive force that makes the upper-seal supporting member 3527 warp.

Figure 44:
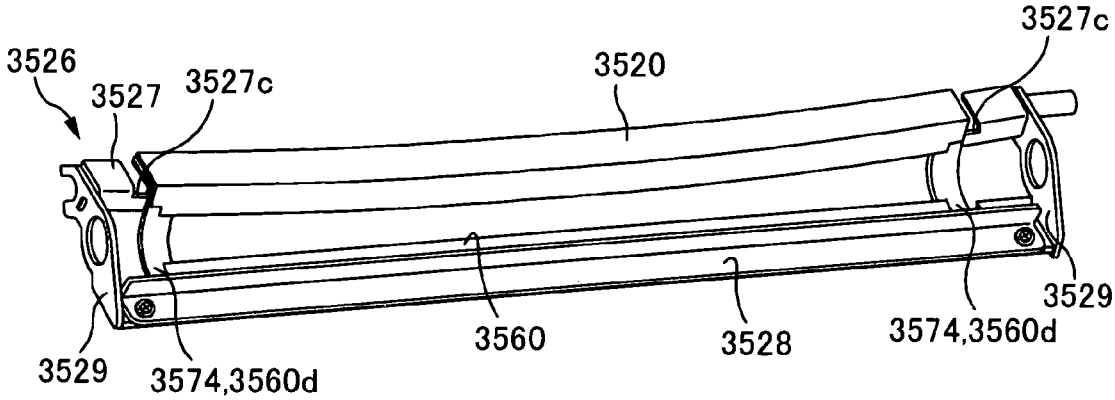
FIG. 44 is a diagram showing a third example of a warp that occurs in the upper-seal supporting member due to a shock.
Figure 45:
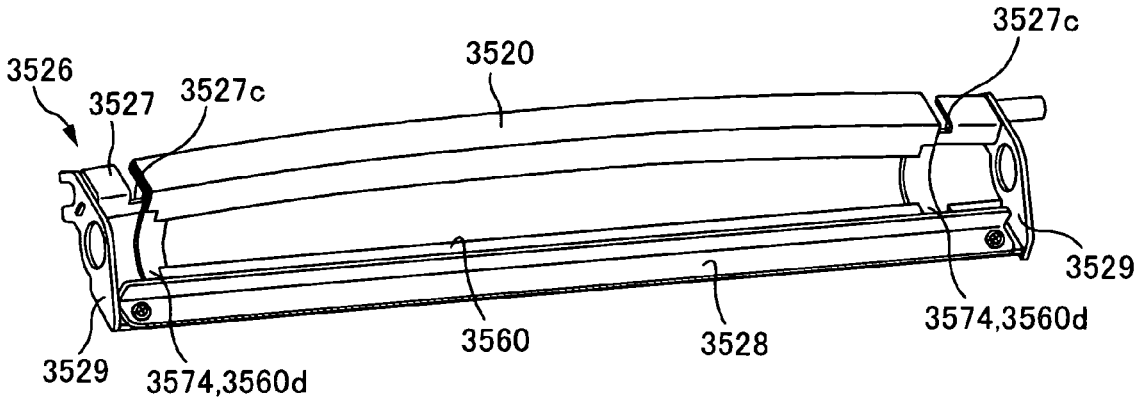
FIG. 45 is a diagram showing a fourth example of a warp that occurs in the upper-seal supporting member due to a shock.
Figure 46:
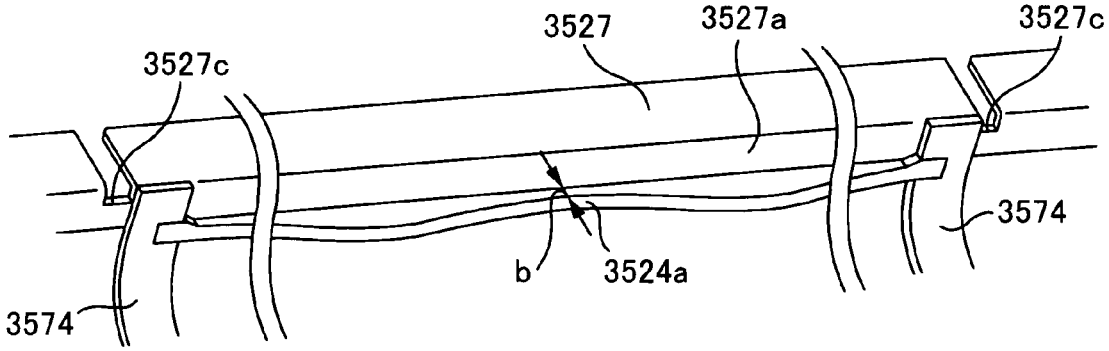
FIG. 46 is a diagram for describing the state of the upper-seal urging member when warping of the third example occurs in the upper-seal supporting member.

Further, depending on the shape of the upper-seal supporting member 3527, the upper-seal supporting member 3527 may warp in a different way when receiving the shock, compared to the warping of the first or second example described above. FIG. 44 is a diagram showing a third example of a warp that occurs in the upper-seal supporting member 3527 due to a shock. FIG. 45 is a diagram showing a fourth example of a warp that occurs in the upper-seal supporting member 3527 due to a shock. FIG. 46 is a diagram for describing the state of the upper-seal urging member when warping of the third example occurs in the upper-seal supporting member.

As shown in FIG. 44 and FIG. 45, assume a case where, for example, the upper-seal supporting member 3527 is formed such that the sections on both ends attached to the developing-roller supporting sections 3529 and the section to which the upper-seal urging member 3524 is fixed are all connected in the axial direction, and the section to which the upper seal member 3520 is fixed is bent. In this case, the rigidity of the section of the upper-seal supporting member 3527 on the side opposing the developing roller 3510 becomes small, and that section may deform due to a shock. More specifically, since the direction of the cut-out sections 3527*c* that have to be formed in order to bend the upper-seal supporting member 3527 is different, the section on the side opposing the developing roller 3510 is prone to deform. In this case, the direction of warping that occurs in the section to which the upper-seal urging member 3524 is fixed due to a shock, such as dropping of the unit, is in a direction in which the central section in the axial direction moves in the radial direction of the developing roller 3510. That is, when the central section of the section to which the upper-seal urging member 3524 is fixed moves in the direction toward the developing roller 3510 due to the shock and warping of the third example occurs in the upper-seal supporting member 3527 as shown in FIG. 44, the distance between the developing roller 3510 and the section to which the upper-seal urging member 3524 is fixed changes such that the distance becomes small. In such a case, it is preferable to use an upper-seal urging member 3524 whose thickness "b" of the central section 3524*a* of the upper-seal urging member 3524 is thinner than that of the other sections, as shown in FIG. 46. In this way, even when the distance between the developing roller 3510 and the section to which the upper-seal urging member 3524 is fixed becomes small due to a shock, it is possible to prevent the urging force of the upper-seal urging member 3524 from becoming significantly larger than that of the other sections because the thickness of the central section 3524*a* is thinner than that of the other sections of the upper-seal urging member 3524. Further, by warping the supporting member 3527 in advance in the direction in which the central section of the section to which the upper-seal urging member 3524 is fixed is moved away from the developing roller 3510, it becomes possible to make the upper-seal urging member 3524 exert an appropriate urging force and keep the abutting pressure of the upper seal member 3520 in the axial direction within the predetermined range, even when a shock etc. gives rise to such an impactive force that causes warping of the third example to occur in the upper-seal supporting member 3527.

Further, when the central section of the section to which the upper-seal urging member 3524 is fixed moves in the direction away from the developing roller 3510 due to the shock and warping of the fourth example occurs in the upper-seal supporting member 3527 as shown in FIG. 45, the distance between the developing roller 3510 and the section to which the upper-seal urging member 3524 is fixed changes such that the distance becomes large. In such a case, it is preferable to use an upper-seal urging member 3524 whose thickness "b" of the central section 3524*a* of the upper-seal urging member 3524 is thicker than that of the other sections, as shown in FIG. 43. In this way, even when the distance between the developing roller 3510 and the section to which the upper-seal urging member 3524 is fixed becomes large due to a shock, it is possible to prevent the urging force of the upper-seal urging member 3524 from becoming significantly smaller than that of the other sections because the thickness of the central section 3524*a* is thicker than that of the other sections of the upper-seal urging member 3524. Further, by warping the seal supporting member 3527 in advance in the direction in which the central section of the section to which the upper-seal urging member 3524 is fixed is moved toward the developing roller 3510, it becomes possible to make the upper-seal urging member 3524 exert an appropriate urging force and keep the abutting pressure of the upper seal member 3520 in the axial direction within the predetermined range, even when a shock etc. gives rise to such an impactive force that causes warping of the fourth example to occur in the upper-seal supporting member 3527.

Incidentally, the cause of a change in the distance between the developing roller 3510 and the upper-seal supporting member 3527, which is the section to which the upper-seal urging member 3524 is fixed, is not limited only to a shock such as dropping of the unit. For example, warping in the developing roller 3510 may also be a cause. In the developing unit of the present embodiment, the upper seal member 3520 and the upper-seal urging member 3524 are fixed to a metal upper-seal supporting member 3527 that has been bent along a straight line in the axial direction, and the developing roller 3510 is a metal roller with which it is easy to obtain straightness. Therefore, it can be considered that the upper seal member 3520 can easily abut against the developing roller 3510 evenly. However, the toner supplying roller 3550 abuts against the developing roller 3510 as described above, and the developing roller 3510 and the toner supplying roller 3550 press against one another at both ends thereof in the direction toward each other. That is, since the two rollers receive a pressing force at both ends thereof, the developing roller 3510 warps in a direction in which its central section moves away from the toner supplying roller 3550, that is, in a direction away from the upper seal member 3520. As a result, even though the upper seal member 3520 and the upper-seal urging member 3524 are fixed to the upper-seal supporting member 3527 which is made of metal, the distance between the developing roller 3510 and the folded section 3527*a* to which the upper-seal urging member 3524 is fixed changes in the widening direction particularly at the central section. The change in the distance between the developing roller 3510 and the folded section 3527*a*, to which the upper-seal urging member 3524 is fixed, due to warping of the developing roller 3510 is similar to the warping of the first example in the upper-seal supporting member 3527 described above. Therefore, by making the length in the circumferential direction at the central section 3524*a*, in the axial direction, of the upper-seal urging member 3524 long toward the inner direction of the housing, it becomes possible to make the urging force larger than that of the other sections such that an appropriate urging force is achieved at the central section. Further, it is also possible to make the thickness at the central section 3524*a* of the upper-seal urging member 3524 thicker than that of the other sections as shown in FIG. 43. Further, it is also possible to warp the seal supporting member 3527 in beforehand in the direction away from the photoconductor 3020, as shown in FIG. 44.

In the foregoing embodiment, examples of making the length in the circumferential direction of the developing roller 3510 and/or the thickness at the central section 3524*a* of the upper-seal urging member 3524 different from that of the other sections were described as the method of making the urging force with which the upper-seal urging member 3524 urges the upper seal member 3520 differ between the central section in the axial direction and the other section, to adapt to the change in the distance between the developing roller 3510 and the upper-seal supporting member 3527. However, the length and the thickness of the upper-seal urging member 3524 do not have to be made different from the other sections only at the central section 3524*a*, and for example, it is also possible to make sections in the vicinity of the ends of the developing roller 3510 different from the other sections in order to prevent the toner from spilling from the central section 3524*a* and also from areas in the vicinity of the ends of the developing roller 3510.

===(3) Other Considerations===

In the foregoing embodiment, an upper seal member 3520 whose longitudinal direction is arranged along the axial direction of the developing roller 3510 is described as an example of a seal member. This, however, is not a limitation. The invention is applicable to any type of seal member that is supported by the holder 3526 and that prevents the toner T from spilling by abutting against the developing roller 3510.

Further, in the foregoing embodiment, an upper seal member 3520 that has the functions of allowing the toner T remaining on the developing roller 3510 to move into the housing 3540 and restricting the toner T inside the housing 3540 from moving out therefrom, is described as an example of a seal member. This, however, is not a limitation, and the seal member does not necessarily have to have these two functions.

Further, in the foregoing embodiment, the holder 3526 has an upper-seal supporting member 3527 arranged in the axial direction of the developing roller 3510 and developing-roller supporting sections 3529 that are arranged on the outside of the upper-seal supporting member 3527 in the axial direction and arranged in a direction intersecting with the axial direction. Further, the upper seal member 3520 is supported by the upper-seal supporting member 3527 at its lateral-direction end 3520*a*, and the developing roller 3510 is supported by the developing-roller supporting sections 3529 at its axial-direction ends 3510*c*. The way of supporting the upper seal member 3520 and the developing roller 3510, however, is not limited to the above.

Further, in the foregoing embodiment, the upper-seal urging member 3524 is fixed to the upper-seal supporting member 3527 of the holder 3526. This, however, is not a limitation. For example, it may be fixed to the upper seal member 3520.

In cases where the upper-seal urging member 3524 is fixed to the upper-seal supporting member 3527 of the holder 3526, the upper-seal urging member 3524 can be relatively positioned more appropriately with respect to the developing roller 3510, the upper seal member 3520, and the holder 3526. Thus, the abutting pressure of the upper seal member 3520 against the developing roller 3510 can be made even more appropriately. The foregoing embodiment is therefore more preferable.

Figure 47:
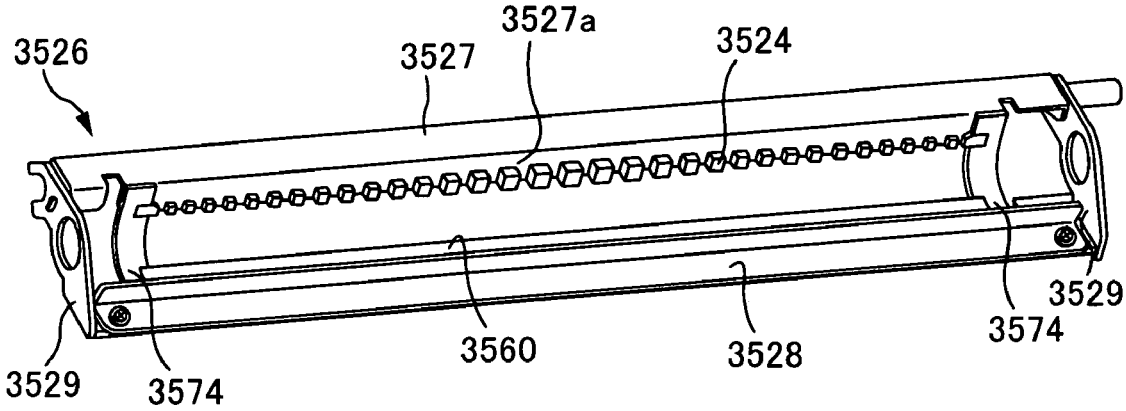
FIG. 47 is a perspective view showing upper-seal urging members fixed to the holder.

Further, in the foregoing embodiment, the upper-seal urging member 3524 is arranged such that its longitudinal direction is parallel to the axial direction of the developing roller 3510. This, however, is not a limitation. For example, as shown in FIG. 47, it is possible to provide a plurality of upper-seal urging members 3524 whose longitudinal direction is not in the axial direction of the developing roller 3510, and the size of some of the upper-seal urging members 3524 provided in the center may be made different from the upper-seal urging members 3524 provided in sections other than the central section.

The foregoing embodiment, however, is more preferable in terms that the abutting pressure of the upper seal member 3520 against the developing roller 3510 can be made even more appropriately. It should be noted that FIG. 47 is a perspective view showing upper-seal urging members 3524 fixed to the holder 3526.

Further, in the foregoing embodiment, the upper-seal urging member 3524 is elastic and is provided in a compressed state between the opposite surface 3520*c* of the upper seal member 3520 and the holder 3526. This, however, is not a limitation. For example, the upper-seal urging member 3524 does not have to be elastic, and does not have to be provided in a compressed state between the opposite surface 3520*c* of the upper seal member 3520 and the holder 3526.

The foregoing embodiment, however, is more preferable in terms that the upper seal member 3520 can be urged toward the developing roller 3510 more appropriately.

Further, in the foregoing embodiment, the holder 3526 is made of metal, and the housing 3540 is made of resin. This, however, is not a limitation. For example, the holder 3526 may be made of resin, and the housing 3540 may be made of metal.

Components made of resin is prone to deformation due to heat and/or pressure that is applied compared to components made of metal. Therefore, an upper-seal urging member 3524 provided between the upper seal member 3520 and the holder 3526 made of metal, and not between the upper seal member 3520 and the housing 3540 made of resin, is less prone to the influence of deformation of components due to heat and pressure, and thus, the abutting pressure of the upper seal member 3520 against the developing roller 3510 is made even more appropriately. The foregoing embodiment is therefore more preferable.

Further, in the foregoing embodiment, the holder 3526 is attached to the housing 3540 via a housing seal 3546. This, however, is not a limitation. For example, the holder 3526 may be attached to the housing 3540 without providing the housing seal 3546 therebetween.

The foregoing embodiment, however, is more preferable in terms that it is possible to appropriately prevent the toner T from spilling from between the holder 3526 and the housing 3540.

Other Embodiments

In the foregoing, an image forming apparatus, a developing device, etc. of the present invention was described according to embodiments thereof. However, the foregoing embodiments of the invention are for the purpose of elucidating the present invention and are not to be interpreted as limiting the present invention. The present invention can be altered and improved without departing from the gist thereof, and needless to say, the present invention includes its equivalents.

In the foregoing embodiments, an intermediate transferring type full-color laser beam printer was described as an example of the image forming apparatus, but the present invention is also applicable to various types of image forming apparatuses, such as full-color laser beam printers that are not of the intermediate transferring type, monochrome laser beam printers, copying machines, and facsimiles.

Also, in the foregoing embodiments, an image forming apparatus provided with developing units in a rotary arrangement was explained as an example, but there is no limitation to this. For example, it is also possible to apply the present invention to image forming apparatuses provided with developing units in a tandem arrangement.

Also, in the foregoing embodiments, the photoconductor serving as the image bearing member was explained to have a configuration in which a photoconductive layer is provided on the outer circumferential surface of a cylindrical conductive base, but there is no limitation to this. For example, it may also be a so-called photoconductive belt configured by providing the photoconductive layer on the surface of a belt-shaped conductive base.

<<<Configuration of Image Forming System etc.>>>

Next, an embodiment of an image forming system, which serve as an example of an embodiment of the present invention, is described with reference to the drawings.

Figure 48:
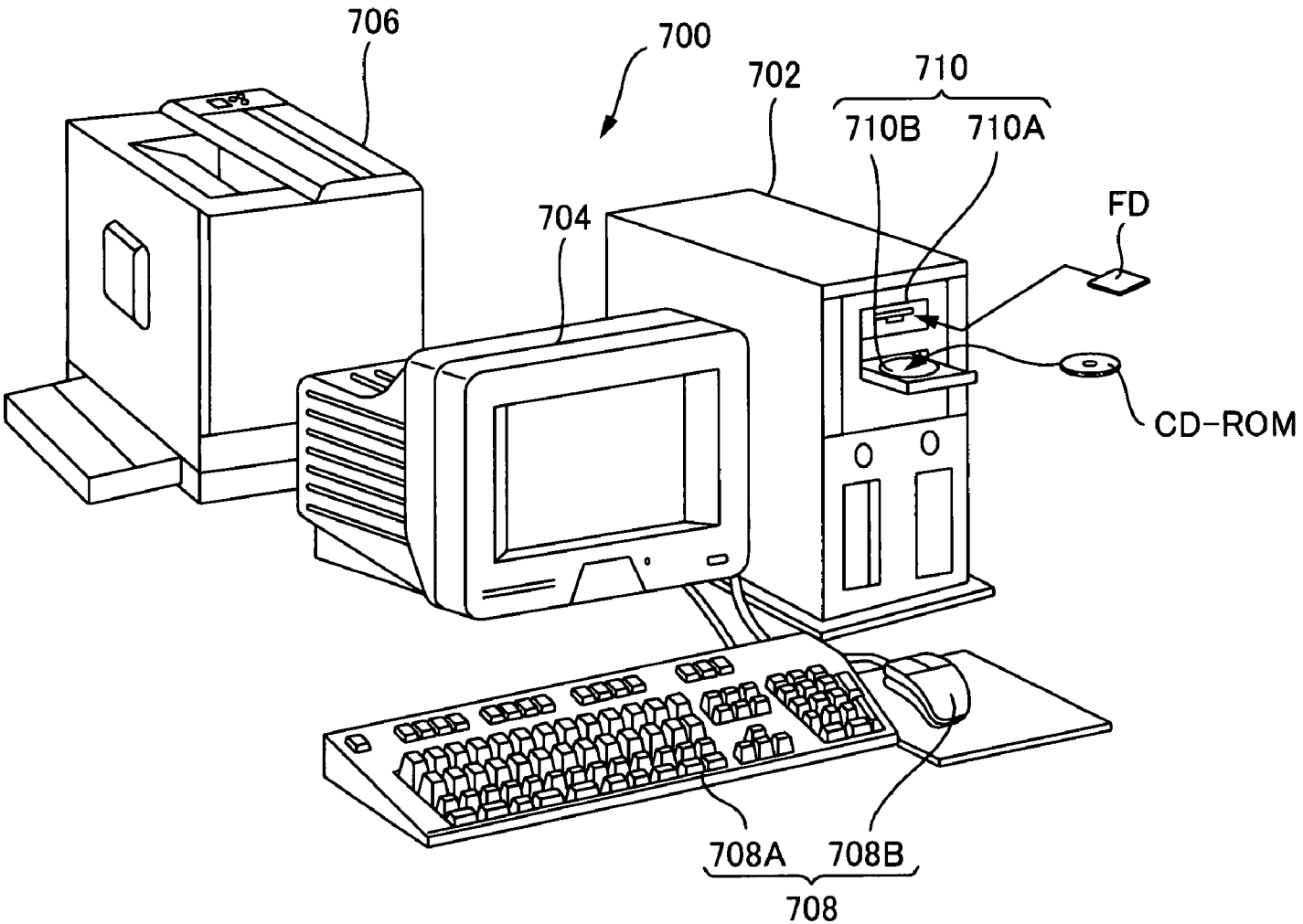
FIG. 48 is an explanatory drawing showing an external structure of an image forming system.

FIG. 48 is an explanatory drawing showing an external structure of an image forming system. The image forming system 700 comprises a computer 702, a display device 704, a printer 706, an input device 708, and a reading device 710. In this embodiment, the computer 702 is accommodated in a mini-tower type housing, but this is not a limitation. A CRT (cathode ray tube), a plasma display, or a liquid crystal display device, for example, is generally used as the display device 704, but this is not a limitation. The printer described above is used as the printer 706. In this embodiment, a keyboard 708A and a mouse 708B are used as the input device 708, but this is not a limitation. In this embodiment, a flexible disk drive device 710A and a CD-ROM drive device 710B are used as the reading device 710, but the reading device is not limited to these, and other devices such as an MO (magneto optical) disk drive device or a DVD (digital versatile disk) may be used.

Figure 49:
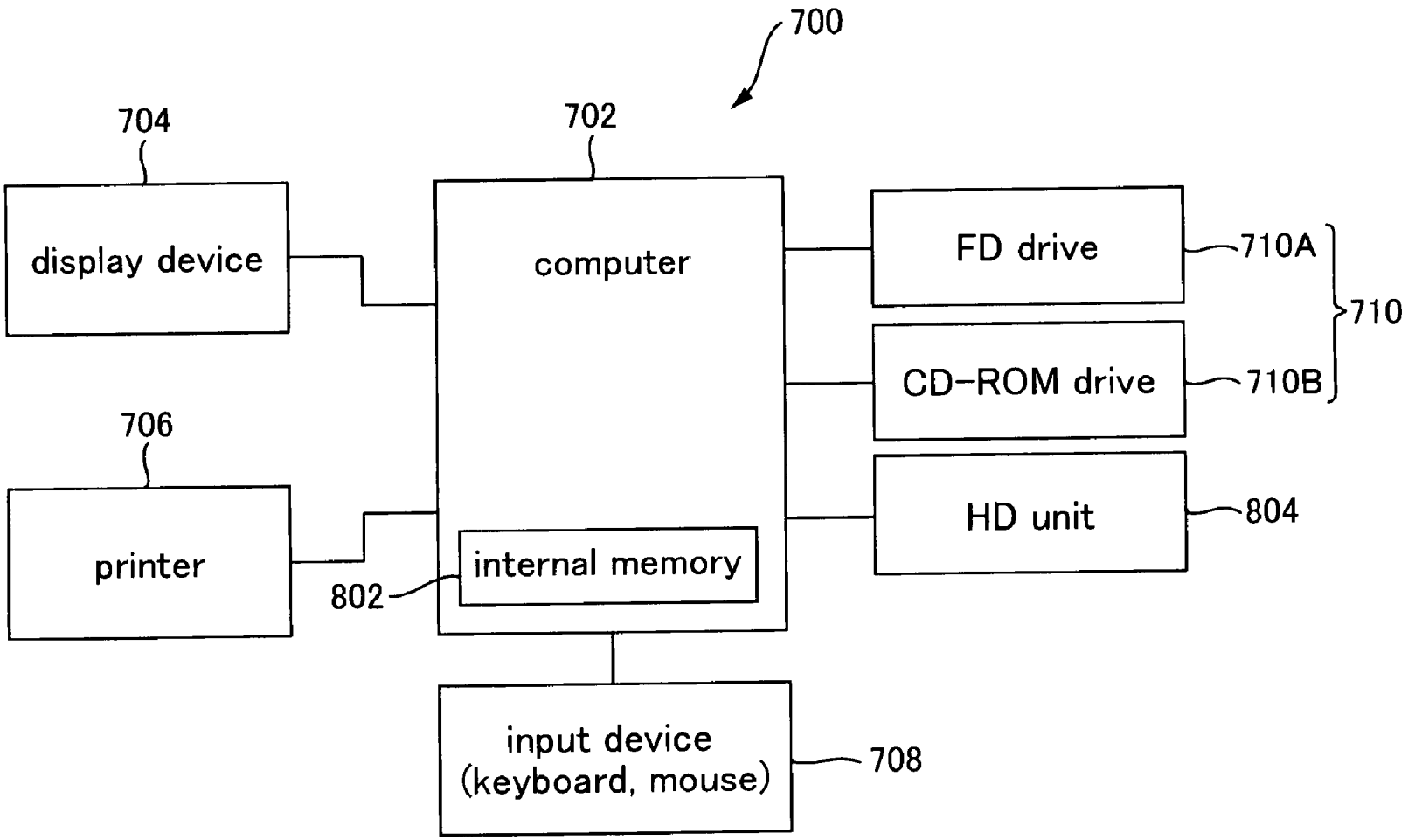
FIG. 49 is a block diagram showing a configuration of the image forming system shown in FIG. 48.

FIG. 49 is a block diagram showing a configuration of the image forming system shown in FIG. 48. Further provided are an internal memory 802, such as a RAM inside the housing accommodating the computer 702, and an external memory such as a hard disk drive unit 804.

It should be noted that in the above description, an example in which the image forming system is structured by connecting the printer 706 to the computer 702, the display device 704, the input device 708, and the reading device 710 was described, but this is not a limitation. For example, the image forming system can be made of the computer 702 and the printer 706, and the image forming system does not have to be provided with one of the display device 704, the input device 708, and the reading device 710.

Further, for example, the printer 706 can have some of the functions or mechanisms of the computer 702, the display device 704, the input device 708, and the reading device 710. As an example, the printer 706 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. A developing device comprising:

a developer containing body adapted to contain a developer;

a developer bearing member adapted to bear and carry the developer;

a developer supplying roller having an elastic roller section that is accommodated inside the developer containing body, and a shaft element that is rotatably supported by the developer containing body and that has, in a portion that is projected outside the developer containing body, a pin hole into which a pin is inserted, the developer supplying roller being adapted to supply the developer to the developer bearing member; and a gear that rotates along with the developer supplying roller and that has a pin-accommodating section opened to the outside, the pin-accommodating section allowing the shaft element and the pin inserted into the shaft element to move relative to one another in an axial direction of the shaft element, but restricting the shaft element and the pin from moving relative to one another in the rotating direction of the shaft element;

wherein, in a state where the developer supplying roller is supported by the developer containing body without the developer containing body interfering with the roller section, the pin hole is covered by the gear, and when the developer supplying roller is moved in the axial direction and the roller section is elastically deformed due to the developer containing body interfering with the roller section, the pin hole is exposed outside the gear so that the pin can be inserted therein and pulled out therefrom.

2. A developing device according to claim 1, wherein the developer supplying roller is supported by the developer containing body via a bearing; and wherein, in the state where the developer supplying roller is supported by the developer containing body without the developer containing body interfering with the roller section, the gear is restricted from moving in the axial direction by the bearing.

3. A developing device according to claim 1, wherein the developing device further comprises a movement-restricting member that restricts the developer supplying roller from moving in the axial direction in the state where the developer supplying roller is supported by the developer containing body without the developer containing body interfering with the roller section.

4. A developing device according to claim 1, wherein a distance in the axial direction between the developer supplying roller and the developer containing body in the state where the developer supplying roller is supported by the developer containing body, is shorter than a length of the pin-accommodating section in the axial direction.

5. A developing device according to claim 1, wherein a distance for which the developer supplying roller can be moved due to the developer supplying roller being moved in the axial direction and the roller section being elastically deformed by the developer containing body interfering with the roller section, is longer than a length of the pin-accommodating section in the axial direction.

6. A developing device according to claim 1, wherein the roller section is formed using urethane foam.

7. A developing device according to claim 2, wherein the developer containing body has an interfering section that interferes with the roller section, and a gap that is provided between the interfering section and the bearing and into which the roller section fits, when the developer supplying roller is moved in the axial direction.

8. A developing device according to claim 7, wherein the interfering section is chamfered.

9. A developing device comprising:

a developer containing body adapted to contain a developer;

a developer bearing member adapted to bear and carry the developer;

a developer supplying roller having an elastic roller section that is accommodated inside the developer containing body, and a shaft element that is rotatably supported by the developer containing body and that has, in a portion that is projected outside the developer containing body, a pin hole into which a pin is inserted, the developer supplying roller being adapted to supply the developer to the developer bearing member; and a gear that rotates along with the developer supplying roller and that has a pin-accommodating section opened to the outside, the pin-accommodating section allowing the shaft element and the pin inserted into the shaft element to move relative to one another in an axial direction of the shaft element, but restricting the shaft element and the pin from moving relative to one another in the rotating direction of the shaft element;

wherein, in a state where the developer supplying roller is supported by the developer containing body without the developer containing body interfering with the roller section, the pin hole is covered by the gear, and when the developer supplying roller is moved in the axial direction and the roller section is elastically deformed due to the developer containing body interfering with the roller section, the pin hole is exposed outside the gear so that the pin can be inserted therein and pulled out therefrom;

wherein the developer supplying roller is supported by the developer containing body via a bearing;

wherein, in the state where the developer supplying roller is supported by the developer containing body without the developer containing body interfering with the roller section, the gear is restricted from moving in the axial direction by the bearing;

wherein the developing device further comprises a movement-restricting member that restricts the developer supplying roller from moving in the axial direction in the state where the developer supplying roller is supported by the developer containing body without the developer containing body interfering with the roller section;

wherein a distance in the axial direction between the developer supplying roller and the developer containing body in the state where the developer supplying roller is supported by the developer containing body, is shorter than a length of the pin-accommodating section in the axial direction;

wherein a distance for which the developer supplying roller can be moved due to the developer supplying roller being moved in the axial direction and the roller section being elastically deformed by the developer containing body interfering with the roller section, is longer than the length of the pin-accommodating section in the axial direction;

wherein the roller section is formed using urethane foam;

wherein the developer containing body has an interfering section that interferes with the roller section, and a gap that is provided between the interfering section and the bearing and into which the roller section fits, when the developer supplying roller is moved in the axial direction; and wherein the interfering section is chamfered.

10. An image forming apparatus comprising:

(a) an image bearing member that bears a latent image; and (b) a developing device including:

a developer containing body adapted to contain a developer;

a developer bearing member adapted to bear and carry the developer;

a developer supplying roller having an elastic roller section that is accommodated inside the developer containing body, and a shaft element that is rotatably supported by the developer containing body and that has, in a portion that is projected outside the developer containing body, a pin hole into which a pin is inserted, the developer supplying roller being adapted to supply the developer to the developer bearing member; and a gear that rotates along with the developer supplying roller and that has a pin-accommodating section opened to the outside, the pin-accommodating section allowing the shaft element and the pin inserted into the shaft element to move relative to one another in an axial direction of the shaft element, but restricting the shaft element and the pin from moving relative to one another in the rotating direction of the shaft element;

wherein, in a state where the developer supplying roller is supported by the developer containing body without the developer containing body interfering with the roller section, the pin hole is covered by the gear, and when the developer supplying roller is moved in the axial direction and the roller section is elastically deformed due to the developer containing body interfering with the roller section, the pin hole is exposed outside the gear so that the pin can be inserted therein and pulled out therefrom.

11. An image forming system comprising:

(A) a computer; and (B) an image forming apparatus connected to the computer and having:

(a) an image bearing member that bears a latent image; and (b) a developing device including:

a developer containing body adapted to contain a developer;

a developer bearing member adapted to bear and carry the developer;

a developer supplying roller having an elastic roller section that is accommodated inside the developer containing body, and a shaft element that is rotatably supported by the developer containing body and that has, in a portion that is projected outside the developer containing body, a pin hole into which a pin is inserted, the developer supplying roller being adapted to supply the developer to the developer bearing member; and a gear that rotates along with the developer supplying roller and that has a pin-accommodating section opened to the outside, the pin-accommodating section allowing the shaft element and the pin inserted into the shaft element to move relative to one another in an axial direction of the shaft element, but restricting the shaft element and the pin from moving relative to one another in the rotating direction of the shaft element;

wherein, in a state where the developer supplying roller is supported by the developer containing body without the developer containing body interfering with the roller section, the pin hole is covered by the gear, and when the developer supplying roller is moved in the axial direction and the roller section is elastically deformed due to the developer containing body interfering with the roller section, the pin hole is exposed outside the gear so that the pin can be inserted therein and pulled out therefrom.

12. A method of assembling a developer supplying roller, comprising:

inserting, inside a developer containing body that contains a developer, a developer supplying roller that has an elastic roller section on a shaft element, whose shaft element is supported by the developer containing body, and that is adapted to supply the developer to a developer bearing member adapted to bear and carry the developer, and elastically deforming the roller section by making the developer containing body interfere with the roller section, to cause the shaft element to project outside the developer containing body;

attaching, from outside the developer containing body, a gear that rotates along with the developer supplying roller to the projected shaft element, and causing a pin hole provided in the shaft element to be exposed outside the gear in order to insert, into the pin hole, a pin adapted to fix the gear and the shaft element;

inserting the pin into the pin hole that has been exposed; and fixing the gear to the developer supplying roller by moving the developer supplying roller in an axial direction thereof, so that the developer containing body rotatably supports the developer supplying roller without the developer containing body interfering with the roller section and the pin is accommodated inside a pin-accommodating section that is provided in the gear and that is opened to the outside.

* * * * *